US010683704B2

(12) United States Patent
Wang et al.

(10) Patent No.: US 10,683,704 B2
(45) Date of Patent: Jun. 16, 2020

(54) DRILL WITH REMOTELY CONTROLLED OPERATING MODES AND SYSTEM AND METHOD FOR PROVIDING THE SAME

(71) Applicant: RAMAX, LLC, Lakewood, CO (US)

(72) Inventors: Fun-Den Wang, Lakewood, CO (US); Horace M. Varner, Littleton, CO (US)

(73) Assignee: Ramax, LLC, Lakewood, CO (US)

( * ) Notice: Subject to any disclaimer, the term of this patent is extended or adjusted under 35 U.S.C. 154(b) by 47 days.

(21) Appl. No.: 16/153,316

(22) Filed: Oct. 5, 2018

(65) Prior Publication Data

US 2019/0040686 A1 Feb. 7, 2019

Related U.S. Application Data

(63) Continuation of application No. 15/232,744, filed on Aug. 9, 2016, now Pat. No. 10,094,172, which is a continuation-in-part of application No. 13/974,970, filed on Aug. 23, 2013, now Pat. No. 9,410,376.

(60) Provisional application No. 61/742,949, filed on Aug. 23, 2012, provisional application No. 61/742,950, filed on Aug. 23, 2012.

(51) Int. Cl.

| | |
|---|---|
| ***E21B 7/18*** | (2006.01) |
| ***E21B 7/15*** | (2006.01) |
| ***E21B 21/10*** | (2006.01) |
| ***E21B 43/26*** | (2006.01) |
| ***E21B 7/04*** | (2006.01) |
| ***E21B 7/06*** | (2006.01) |

(52) U.S. Cl.

CPC ..... *E21B 7/18* (2013.01); *E21B 7/046* (2013.01); *E21B 7/065* (2013.01); *E21B 7/15* (2013.01); *E21B 21/10* (2013.01); *E21B 43/26* (2013.01); *Y10T 137/8593* (2015.04)

(58) Field of Classification Search

CPC . E21B 7/18; E21B 7/046; E21B 7/065; E21B 7/15

USPC ..... 175/61

See application file for complete search history.

(56) References Cited

U.S. PATENT DOCUMENTS

| | | | |
|---|---|---|---|
| 1,959,174 | A | 5/1934 | Moore |
| 2,169,718 | A | 8/1939 | Boll et al. |
| 2,756,020 | A | 7/1956 | D'Audiffret et al. |
| 2,886,281 | A | 5/1959 | Canalizo |
| 3,081,828 | A | 3/1963 | Quick |
| 3,112,800 | A | 12/1963 | Bobo |

(Continued)

OTHER PUBLICATIONS

International Search Report and Written Opinion for International Patent Application No. PCT/US2013/056470, dated Jan. 9, 2014, 9 pages.

(Continued)

*Primary Examiner* — Taras P Bemko

(74) *Attorney, Agent, or Firm* — Sheridan Ross P.C.

(57) ABSTRACT

The present invention relates to a drilling system with a multi-function drill head used in, among other applications, oil and gas drilling. The system is used to enhance the effective permeability of an oil and/or gas reservoir by drilling or cutting new structures into the reservoir. The system is capable of cutting straight bores, radius bores, or side panels, by water jets alone or in combination with lasers. In various embodiments, a device for remotely controlling the mode of the system by variations in the pressure of a drilling fluid is also provided, allowing an operator to switch between various modes (straight drilling, radius bore drilling, panel cutting, etc.) without withdrawing the drill string from the well bore.

20 Claims, 32 Drawing Sheets

(56) References Cited

U.S. PATENT DOCUMENTS

| | | | |
|---|---|---|---|
| 3,155,177 | A | 11/1964 | Fly |
| 3,231,031 | A | 1/1966 | Cleary |
| 3,301,522 | A | 1/1967 | Ashbrook et al. |
| 3,324,957 | A | 6/1967 | Goodwin et al. |
| 3,402,780 | A | 9/1968 | Goodwin et al. |
| 3,417,829 | A | 12/1968 | Acheson et al. |
| 3,542,142 | A | 11/1970 | Hasiba et al. |
| 3,576,222 | A | 4/1971 | Acheson et al. |
| 3,744,579 | A | 7/1973 | Godfrey |
| 3,871,485 | A | 3/1975 | Keenan |
| 3,882,945 | A | 5/1975 | Keenan |
| 3,924,805 | A | 12/1975 | Nebeker et al. |
| 3,977,478 | A | 8/1976 | Shuck |
| 3,998,281 | A | 12/1976 | Salisbury et al. |
| 4,047,580 | A | 9/1977 | Yahiro et al. |
| 4,066,138 | A | 1/1978 | Salisbury et al. |
| 4,084,648 | A | 4/1978 | Yahiro et al. |
| 4,090,572 | A | 5/1978 | Welch |
| 4,113,036 | A | 9/1978 | Stout |
| 4,119,160 | A | 10/1978 | Summers et al. |
| 4,141,225 | A | 2/1979 | Varner |
| 4,199,034 | A | 4/1980 | Salisbury et al. |
| 4,206,902 | A | 6/1980 | Barthel et al. |
| 4,227,582 | A | 10/1980 | Price |
| 4,282,940 | A | 8/1981 | Salisbury et al. |
| 4,302,051 | A | 11/1981 | Bass et al. |
| 4,442,902 | A | 4/1984 | Doremus et al. |
| 4,474,251 | A | 10/1984 | Johnson |
| 4,477,052 | A | 10/1984 | Knoblauch et al. |
| 4,479,541 | A | 10/1984 | Wang |
| 4,624,326 | A | 11/1986 | Loegel |
| 4,624,327 | A | 11/1986 | Reichman |
| 4,625,941 | A | 12/1986 | Johnson |
| 4,739,841 | A | 4/1988 | Das |
| 4,787,465 | A | 11/1988 | Dickinson et al. |
| 4,852,668 | A | 8/1989 | Dickinson et al. |
| 4,878,712 | A | 11/1989 | Wang |
| 4,976,321 | A | 12/1990 | Van Meter |
| RE33,660 | E | 8/1991 | Jelsma |
| 5,199,512 | A | 4/1993 | Curlett |
| 5,291,957 | A | 3/1994 | Curlett |
| 5,361,855 | A | 11/1994 | Schuermann et al. |
| 5,361,856 | A | 11/1994 | Surjaatmadja et al. |
| 5,363,927 | A | 11/1994 | Frank |
| 5,375,625 | A | 12/1994 | Reynolds |
| 5,462,129 | A | 10/1995 | Best et al. |
| 5,490,569 | A | 2/1996 | Brotherton et al. |
| 5,558,786 | A | 9/1996 | Couch et al. |
| 5,787,998 | A | 8/1998 | O'Hanlon et al. |
| 5,887,667 | A | 3/1999 | Van Zante et al. |
| 5,897,095 | A | 4/1999 | Hickey |
| 5,934,390 | A | 8/1999 | Uthe |
| 5,968,382 | A | 10/1999 | Kazui et al. |
| 6,035,952 | A | 3/2000 | Bradfield et al. |
| 6,142,246 | A | 11/2000 | Dickinson et al. |
| 6,189,629 | B1 | 2/2001 | McLeod et al. |
| 6,206,112 | B1 | 3/2001 | Dickinson et al. |
| 6,263,984 | B1 | 7/2001 | Buckman |
| 6,283,230 | B1 | 9/2001 | Peters |
| 6,315,062 | B1 | 11/2001 | Alft et al. |
| 6,588,116 | B2 | 7/2003 | Dallas et al. |
| 6,626,249 | B2 | 9/2003 | Rosa |
| 6,648,084 | B2 | 11/2003 | Morey et al. |
| 6,668,948 | B2 | 12/2003 | Buckman et al. |
| 6,817,427 | B2 | 11/2004 | Matsuo et al. |
| 6,834,719 | B2 | 12/2004 | Fritchley et al. |
| 6,866,106 | B2 | 3/2005 | Trueman et al. |
| 6,876,959 | B1 | 4/2005 | Peirce et al. |
| 6,880,646 | B2 | 4/2005 | Batarseh |
| 6,980,571 | B1 | 12/2005 | Press et al. |
| 7,147,064 | B2 | 12/2006 | Batarseh et al. |
| 7,434,633 | B2 | 10/2008 | Lynde et al. |
| 7,540,339 | B2 | 6/2009 | Kolle |
| 7,699,107 | B2 | 4/2010 | Butler et al. |
| 7,841,396 | B2 | 11/2010 | Surjaatmadja |
| 8,056,576 | B2 | 11/2011 | Van Weelden |
| 8,074,744 | B2 | 12/2011 | Watson et al. |
| 8,087,637 | B2 | 1/2012 | Sun et al. |
| 8,240,634 | B2 | 8/2012 | Jarchau et al. |
| 8,253,068 | B2 | 8/2012 | Yuan et al. |
| 8,256,530 | B2 | 9/2012 | Kobayashi et al. |
| 8,424,620 | B2 | 4/2013 | Perry et al. |
| 8,475,230 | B2 | 7/2013 | Summers et al. |
| 9,371,693 | B2 | 6/2016 | Wang et al. |
| 9,410,376 | B2 | 8/2016 | Wang et al. |
| 1,009,417 | A1 | 10/2018 | Wang et al. |
| 2002/0011357 | A1 | 1/2002 | Trueman et al. |
| 2002/0023781 | A1 | 2/2002 | Peters |
| 2008/0073605 | A1 | 3/2008 | Ishigaki et al. |
| 2009/0078464 | A1 | 3/2009 | Cheng |
| 2009/0288884 | A1 | 11/2009 | Jelsma |
| 2010/0032207 | A1 | 2/2010 | Potter et al. |
| 2010/0044103 | A1 | 2/2010 | Moxley et al. |
| 2010/0044104 | A1 | 2/2010 | Zediker et al. |
| 2010/0044106 | A1 | 2/2010 | Zediker et al. |
| 2010/0084588 | A1 | 4/2010 | Curtiss et al. |
| 2011/0220409 | A1 | 9/2011 | Foppe |
| 2012/0067643 | A1 | 3/2012 | DeWitt et al. |
| 2012/0138826 | A1 | 6/2012 | Morris et al. |
| 2012/0160567 | A1 | 6/2012 | Belew et al. |
| 2012/0228033 | A1 | 9/2012 | Mazarac |
| 2012/0255774 | A1 | 10/2012 | Grubb et al. |
| 2012/0261188 | A1 | 10/2012 | Zediker et al. |
| 2012/0261194 | A1 | 10/2012 | Blange |
| 2012/0273276 | A1 | 11/2012 | Freyer |
| 2012/0273277 | A1 | 11/2012 | Blange et al. |
| 2013/0112478 | A1 | 5/2013 | Braga et al. |
| 2013/0112901 | A1 | 5/2013 | Biddick |
| 2013/0175090 | A1 | 7/2013 | Zediker et al. |
| 2013/0192893 | A1 | 8/2013 | Zediker et al. |
| 2013/0192894 | A1 | 8/2013 | Zediker et al. |
| 2013/0269935 | A1 | 10/2013 | Cao et al. |
| 2015/0027694 | A1 | 1/2015 | Vinegar et al. |
| 2015/0167436 | A1 | 6/2015 | Frederick et al. |
| 2015/0330163 | A1 | 11/2015 | Lindberg |
| 2016/0130890 | A1 | 5/2016 | Wase |

OTHER PUBLICATIONS

International Preliminary Report on Patentability for International (PCT) Patent Application No. PCT/US2013/056470, dated Feb. 24, 2015 7 pages.

Official Action for U.S. Appl. No. 14/423,200, dated Jan. 14, 2016, 19 pages.

Notice of Allowance for U.S. Appl. No. 14/423,200, dated Mar. 24, 2016, 8 pages.

Official Action for U.S. Appl. No. 14/423,200, dated Oct. 22, 2015, 13 pages.

Notice of Allowance for U.S. Appl. No. 14/423,200, dated Feb. 24, 2016, 5 pages.

Official Action for U.S. Appl. No. 15/232,744, dated Jan. 12, 2018, 15 pages.

Notice of Allowance for U.S. Appl. No. 15/232,744, dated Jun. 5, 2018, 5 pages.

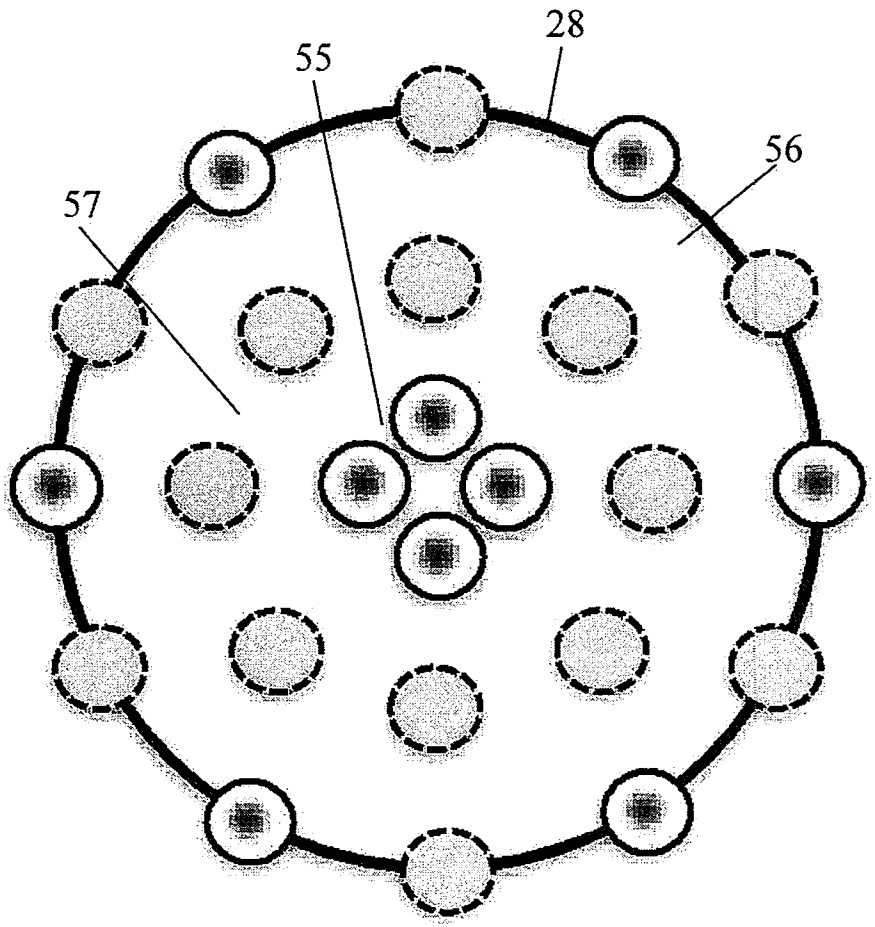
Figure 18
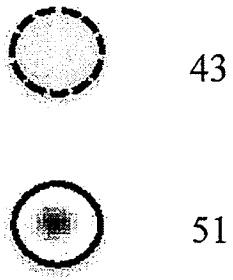

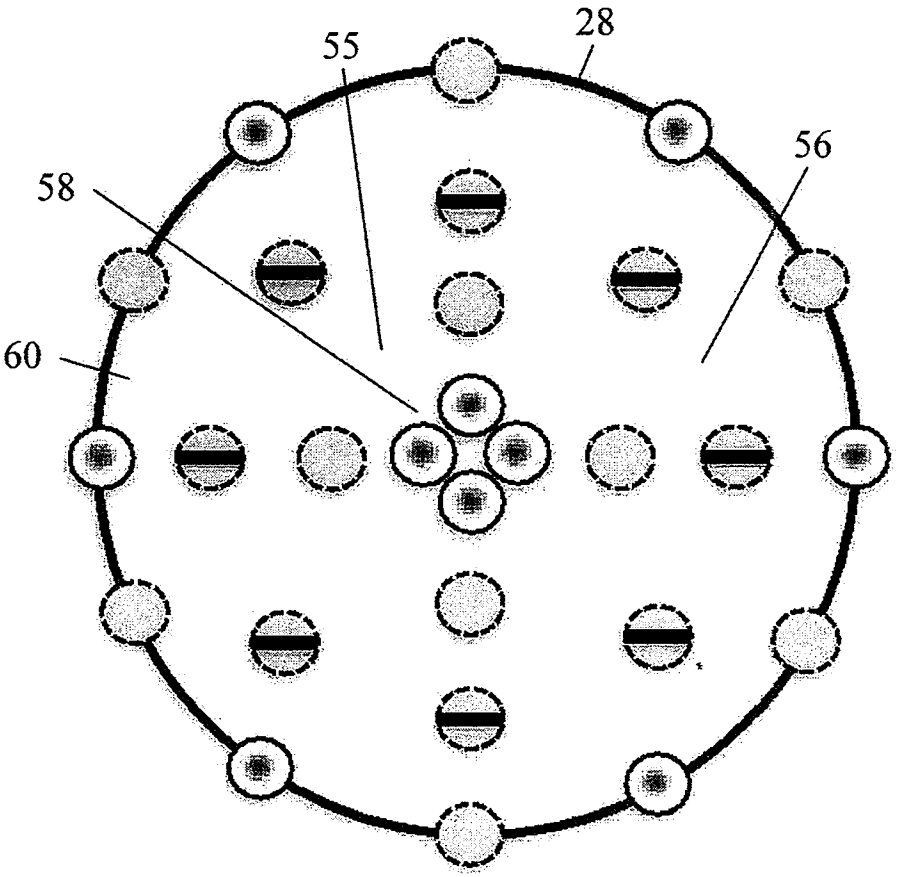
Figure 20
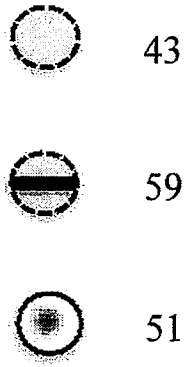

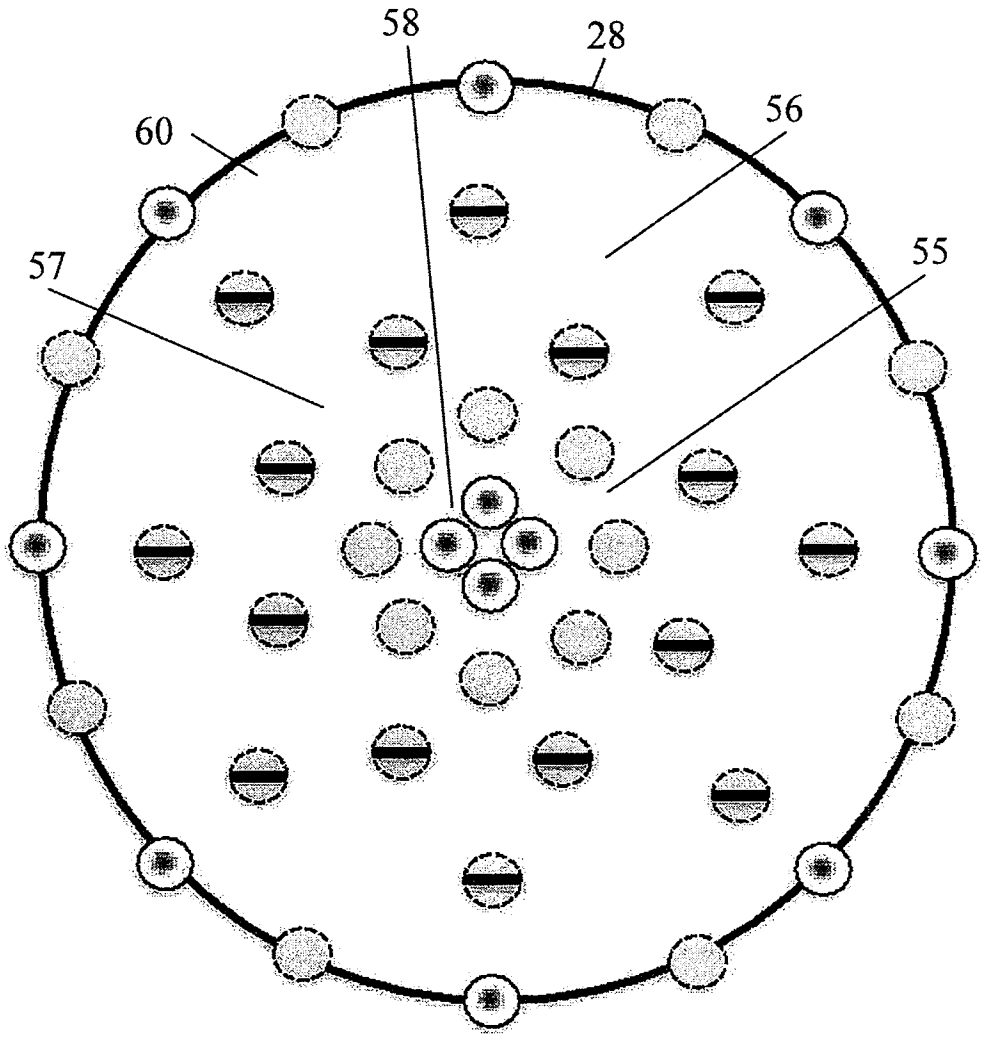
Figure 21
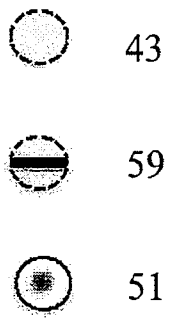

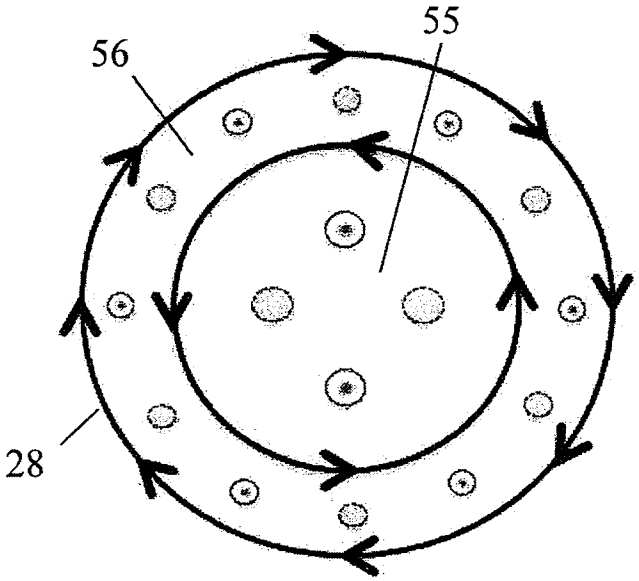
Figure 22
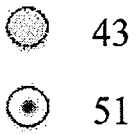

DRILL WITH REMOTELY CONTROLLED OPERATING MODES AND SYSTEM AND METHOD FOR PROVIDING THE SAME

This Application is a Continuation application and claims the benefit of priority of U.S. patent application Ser. No. 15/232,744 filed on Aug. 9, 2016, which is a Continuation-In-Part application and claims the benefit of priority of U.S. patent application Ser. No. 13/974,970 filed on Aug. 23, 2013, now U.S. Pat. No. 9,410,376, which is a non-provisional application of and claims the benefit of priority from U.S. Provisional Patent Application Ser. No. 61/742,949 filed on Aug. 23, 2012, and U.S. Provisional Patent Application Ser. No. 61/742,950, filed on Aug. 23, 2012, the entire disclosures of which are hereby incorporated by reference in their entireties.

FIELD OF THE INVENTION

Embodiments of the present invention generally relate to methods and systems for controlling drilling and cutting functions remotely and drilling systems incorporating such methods. More specifically, embodiments of the present invention relate to drilling systems which utilize water jet heads, alone or in combination with lasers, and which may be remotely switched between various operating modes.

BACKGROUND OF THE INVENTION

Compared with conventional oil and gas resources, production of unconventional shale oil or tight gas faces more challenges, because low-permeability reservoir rock generally results in low productivity and low recovery rates. Currently, the two technologies most frequently used in shale oil and gas recovery are horizontal drilling and hydraulic fracturing (also called "fracking" or "fracing" herein). Horizontal drilling and hydraulic fracturing have made possible the successful development of shale oil and gas and tight oil and gas resources by effectively reducing oil and gas flow resistance and increasing flow rates by increasing the contact area between the wellbore and the reservoir, but also have serious shortcomings. First, formation damage due to water imbibing and fluid trapping hinders the production of oil and gas; this problem is particularly severe in low-permeability reservoirs due to the elevated capillary pressure. Second, hydraulic fracturing operations use large amounts of water, proppants, and chemical additives. There has been rising concern about the environmental impact of conventional fracking technology, and in particular about groundwater and surface water contamination and inadequate treatment of the wastewater generated by fracking, leading to restrictions on fracking in the interest of public safety. It is therefore a top priority to develop alternative and effective well and reservoir stimulation technologies that significantly reduce the use of chemicals, conserve water, avoid structural damage to groundwater-bearing strata, and prevent groundwater contamination.

In all unconventional oil and gas reservoir development, some form of well and reservoir stimulation is required. The technique most commonly used is hydraulic fracturing, an established technique in the United States. Fracturing can provide hydraulic conductivity throughout the reservoir and reach deep into the reservoir for improved reserve recovery. Rising public concerns over water usage and groundwater contamination make it necessary to consider alternatives or supplementary techniques that will mitigate public and environmental concerns and improve the oil and gas recovery from unconventional resources with minimal damage to overburdened groundwater-bearing strata.

In addition, one of the costliest and most time-consuming operations in conventional oil and gas drilling occurs when an operator desires to change operating modes. Many existing systems and methods utilize a drill head with a single function and/or single mode, or with multiple functions or modes that cannot be switched remotely. The use of such drill heads requires the operator to withdraw the drill string from the reservoir, switch or adjust the drill head, and reinsert the drill string back into the reservoir. This withdrawal and reinsertion of the drill string is known as "tripping," because it involves a "round trip" of the drill string. Depending on local conditions, tripping can take multiple hours to complete, greatly increasing the amounts of time and money needed to drill wells. There is thus a need for drilling devices, methods, and systems which may be switched remotely from aboveground, eliminating the need for arduous tripping of the drill string.

SUMMARY OF THE INVENTION

These and other needs are addressed by the various embodiments and configurations of the present invention. This invention relates to a novel system, device, and methods for drilling straight bores, short radius bores, and panels, with a device for remotely switching between various operating modes using variations in fluid pressure. The novel drilling device, method, and system provided herein allow the drill to change from one operating mode, e.g., a drilling mode, to another operating mode, e.g., a panel cutting mode, without withdrawing the drill string.

Due to the numerous limitations associated with the prior art described above, the following disclosure describes an innovative technology for enhanced gas recovery (EGR) from oil and gas reservoir formations, and in particular low-permeability shale and tight gas reservoirs. Specifically, the disclosure describes innovative and effective well stimulation through an unconventional drilling and panel cutting system. This is achieved by expanding the accessible drill-hole surface area in large oil and gas reservoir zones by creating unique structural spaces, including narrow openings—e.g., panels, pancakes, and spirals-using specially designed water-jet and/or laser drilling and panel cutting equipment. Please note that the drills, systems, and jets of the present invention may operate using water or any other fluid (either liquid or gas), including liquid drilling fluid known in the art as drilling "mud," such as water-based mud, oil-based mud, or other non-aqueous mud. Thus, the term "water" may be used interchangeably with "fluid" herein.

The structural spaces created by drilling permit oil and gas to flow into the drill hole. The drilling part of the water jet and/or laser drill tool is designed to create boreholes projecting out horizontally from a vertical well. The cutting part of the drill tool is also capable of cutting panels extending laterally from the drill hole by utilizing a second set of mounted water jets and/or lasers cutting outward from the produced horizontal hole. These panels increase the area of the reservoir exposed to the borehole and thereby significantly enhance stimulated reservoir volume (SRV). Upon completion of the horizontal drill hole and while retreating, the water-jet and/or laser drill may cut multiple wide panels extending from the drill hole to form large, open producing surfaces. The design and configuration of the panels may be multiple rectangular panels along several sides of the lateral drill hole, consecutive pancake panels radiating out perpendicularly from the drill hole at a predetermined spacing, or a continuous spiral as the drill head is retreating. Panel geometry may be designed and configured to benefit from in situ stresses that allow the expanded SRV to provide greater effective permeability, leading to increased production rates for oil and gas recovery. The surfaces within the producing zones may be drilled and cut such that the surfaces will not affect the integrity or stability of the geological formation, including water-bearing reservoirs above the oil and gas production zone.

Panels are traditionally rectangular shaped with square or rounded corners and are cut in pairs or multiple pairs extending in any direction from the axis of the drill hole. Panels can be created in various sizes, depending on the well, target material, and amount of oil and gas trapped in the target material. Pancakes are round or oval-shaped cavities with entrance openings from the axis of the drill hole. Pancakes can be oriented in any direction relative to the drill hole axis, but they typically extend radially or perpendicular to the drill hole axis. Pancakes can be formed as wedges with pillars depending on the geology and formation strength of the target material. A single pancake or multiple pancakes can be cut along the formation or in the target material. Butterfly panels are formed by cutting multiple rectangular panels that extend radially outward from the drill hole axis and above a certain horizontal angle in the formation. It is one aspect of the present invention to use a drill head according to embodiments of the present invention to cut panels, pancake panels, and butterfly panels. Alternatively, various panel shapes can be used in 3D space and attached to wells, drill holes, shafts, slopes, drifts, tunnels, underground chambers, etc. These panel shapes include rectangular, circular, square, triangular, oval, and cylindrical. The panels or slots can be oriented at any orientation relative to in situ stresses and rock structures.

The fundamental advantage of creating panels with fluid jets is that it significantly increases the exposed surface area within the oil-bearing geological structures. This increase in surface area directly translates to improved oil recovery and production and is more efficient per unit volume. For example, from a horizontal or inclined drill hole, a single pair or multiple pairs of panels can be cut in the reservoir using a percussive jet to form the butterfly panels. The process can be augmented with steam or water to produce oil or gas and/or a heater may be inserted into the drill hole to maintain the temperature of the water. The horizontal drill hole and pairs of panels can be drilled in multiple depths in the same formation.

Another aspect of embodiments of the present invention is to more effectively and efficiently recover oil and oil-rich bitumen from tar sands, recover heavy oil and conventional oil from reservoirs, and recover oil through secondary recovery techniques. Accordingly, embodiments of the present invention include a method for the in situ separation of viscous crude oil from a reservoir, such as oil sands or tar sands, using water jets to create a cavity into which hot water and/or steam is pumped. The water jets may be percussive jets in some embodiments. The hot water can be introduced to the top surface of the reservoir while steam is injected into the reservoir through drill holes. In various embodiments, the hot water and steam may contain a surfactant. Additionally, a heater can be inserted into the cavity's water zone to maintain the water's high temperature. The resulting oil buoyancy creates a "flip-flop" effect where the water and oil "flip-flop" and the oil rises to the top of the cavity and separates from the remainder of the reservoir material, which facilitates extraction of the oil. A horizontal drill hole may be drilled past the cavity to increase the effect of the hot water in some embodiments. U.S. Pat. No. 4,302,051 to Bass et al., which is incorporated by reference herein in its entirety, discloses a method for the in situ separation of viscous crude oil from a reservoir.

It is another aspect of embodiments of the present invention to provide a drill head with a more efficient water jet. In one embodiment, the drill head includes one or more percussive jets. A percussive jet (also called a "pulsed jet" herein), can be characterized as a rapidly pulsing jet in which quasi-discrete fluid slugs are generated in the free-stream by modulating flow prior to acceleration in the nozzle relative to a specific frequency, amplitude and/or waveform. The importance of controlling these variables can be shown by examining the impact mechanisms and aerodynamics of a pulsing percussive jet. Control of these variables produce a novel jet configuration with very unique impact dynamics and aerodynamic properties far superior to those of continuous water jets. Furthermore, this process of discharge modulation produces free-stream bunching within the free-stream that is fundamentally different from other types of pulsed, intermittent, or off-and-on steady jet flow. Percussive water jets are described in U.S. Pat. No. 3,924,805 to Nebeker et al., which is incorporated by reference herein in its entirety.

Features of the present invention may be employed in a wide range of applications. In mineral and oil extraction, embodiments may be applied to sublevel caving, block caving, and longwall mining. In oil extraction, embodiments may be used to form underground structures and openings to enhance effective permeability for higher extraction and production rates. In geothermal engineering, multiple chambers, panels, and openings may be created from the vertical drill hole to increase the surface area exposure of the water or steam. In civil engineering, embodiments may be applied to create foundations of buildings, etc. and retaining walls. In construction, embodiments may be used to create underground structures. Embodiments of the present invention may be used for enhanced recovery of coal, metallic minerals, non-metallic minerals, gold, etc., in formations ranging from narrow veins to large ore bodies, including when the coal, minerals, and/or gold are in hard rock and sedimentary rock. Embodiments of the present invention may also be used for excavating seabeds in seabed mining. One advantage obtained in all of these applications is that the drilling methods described herein are more environmentally friendly than conventional methods.

Thus, it is one aspect of various embodiments of the present invention to provide a drilling system with a control device to remotely switch between various operating modes. This remote control capability allows the system to be switched between various drilling modes without withdrawing the drill string from the drill hole.

It is one aspect of embodiments of the present invention to avoid the requirement of "tripping" the drill string when a change in operating mode is desired. One advantage of some embodiments is that a single drill head may implement multiple drilling modes depending on the fluid pressure inputs provided by the operator, eliminating the need for switching or adjusting the drill head aboveground.

Many of the drilling systems in the prior art have a single-function drill head, or a drill head with multiple functions that cannot be controlled remotely from above ground. This requires the operator to withdraw the drill string from underground and change or adjust the drill head when a change in operating mode is desired, then replace the drill string underground. This process is known as "tripping" the drill string because it requires a "round trip" of the drill string. It is thus one aspect of embodiments of the present invention to avoid the requirement of frequent tripping of the drilling string.

Another aspect of the invention is thus to substantially reduce the investments of time, money, and labor needed for drilling.

It is one aspect of embodiments of the present invention to provide a drill that can cut through a multitude of different materials having different physical properties without having to take the drill string out of the well bore to change the drill head. For example, in one embodiment the drill head comprises a water jet and a laser. Furthermore, the water jet can excrete water at various angles and pressures and the laser can be positioned at different angles and set to different intensities. Additionally, the water jet and laser can be turned on and off while the drill is in the well bore such that only the laser is cutting material, only the water jet is cutting material, or both the laser and water jet are cutting material. In some embodiments, the drill head can be used to change the physical properties of the target material, for example by changing the target material's mechanical properties, Young's Modulus, Poisson's Ratio, and electric properties. Furthermore, the drill head can cut and change the target material's physical properties, for target material positioned above, below, in front of, and/or surrounding the drill head. Having a drill head that can cause these changes in physical properties is extremely beneficial in mining operations, mineral extraction, petroleum extraction, cutting and drilling rock formations, and in civil engineering applications. For example, having a drill head that can change the physical properties of the target material can weaken the rock to ease mining efforts and/or change the reservoir rock causing the oil to flow faster, which reduces the time it takes to extract the oil. Additionally, embodiments of the present invention can be used to create an underground storage structure or a special foundation for surface structures.

Thus, in some embodiments, the drill head is a single unit that can turn about 15 degrees in any direction during drilling and cutting (including drilling and cutting using side jets) to turn the drill hole to a desired direction. The cutter head of the drill head may be a segmented unit with each segment's functions giving it the capability of turning smoothly and efficiently. The cutter head can have grippers on the side of the cutter head in some embodiments. In one embodiment, the cutter head has a set of two identical grippers orientated in opposing directions to ensure that loads can be resisted in both axial directions. In other embodiments, the cutter head has two identical sets of grippers orientated in opposing directions. A gripper is a device for handling a drill string component in a rock drill rig. Grippers are generally used for gripping a region of a drill string component. U.S. Patent Publication Nos. 2016/0130890 to Wase and 2015/0330163 to Lindberg describe gripper assemblies and are incorporated by reference herein in their entireties.

Another aspect of embodiments of the invention is to mine, cut target material, and change the physical properties of the target material more quickly and at a lower cost than apparatuses of the prior art. In some embodiments, the laser beam uses a lower energy level and a higher traverse velocity than lasers and drilling systems of the prior art. In some embodiments, the laser on the drill head is placed at an angle between about 10° and about 45° from the vertical or between about 5° and about 45° from the longitudinal axis of the drill head. If more than one laser is used, then the lasers can all impinge at one point or a cluster of points. Further, the intensity of each laser beam can be varied. By changing the angles of the lasers, the impingement points can be moved horizontally, vertically, and/or in a three-dimensional space. The lasers can form a zone of influence where the lasers alter the target material's properties within that zone. Additionally, the lasers can alter the target material's properties at a fast translating speed to control the energy absorption or alteration of properties such that the target material does not reach its melting point or evaporation point. Target materials include rock, soil, organic material, other geological material, plastic, metal, and other human-made materials. Embodiments of the present invention can be used in surface mining applications or underground mining applications to create fractures for in situ leaching, to form specific geological structures for partial removal of materials, or to create storage cavities. Embodiments of the present invention can also be used to alter or remove the reservoir rock for easier removal of oil and gas. Further, embodiments of the present invention can be used to change the physical properties of the target material to make the material tighter to keep gas in certain formations or to form underground storage tanks, e.g., oil tanks. Embodiments of the present invention can also be used to alter the chemical composition of materials, such as water to purify the water.

It is also one aspect of various embodiments of the present invention to provide a drilling system having a drill head with a pressure-sensitive control valve. Thus, in some embodiments, the operator need only modify the pressure of the drilling fluid to change from one drilling mode to another. This pressure is easily controllable at an aboveground (i.e., readily accessible) control point, by devices and methods well known and described in the art. Some examples of drilling devices and methods known and described in the art are described in U.S. Pat. No. 8,424,620, entitled "Apparatus and Method for Lateral Well Drilling," issued Apr. 23, 2013 to Perry et al.; U.S. Pat. No. 8,074,744, entitled "Horizontal Waterjet Drilling Method," issued Dec. 13, 2011 to Watson et al.; and U.S. Pat. No. 7,841,396, entitled "Hydrajet Tool for Ultra High Erosive Environment," issued Nov. 30, 2010 to Surjaatmadja, all of which are hereby incorporated by reference in their entireties.

In some embodiments, a pressure-sensitive control valve directs the flow of the drilling fluid through various ports on the end and/or sides of the drill head to implement a particular operating mode when the pressure of the drilling fluid provided to the drill head is increased, decreased, or maintained. In some embodiments, the valve may comprise a housing body, a valve spool, and a spring. When the operator changes the pressure of the drilling fluid being provided to the drill head from a first pressure range to a second pressure range, the valve spool may move axially within the drill head. This axial movement may close some fluid ports on the drill head to prevent the flow of fluid, and/or may open other fluid ports on the drill head to allow the flow of fluid. The alteration in the fluid flow may cause the drill head to drill or cut the surrounding reservoir via a different operating mode. In some embodiments, the valve may include a detent device for locking the valve in place when random fluctuations in fluid pressure occur. The detent prevents the unintended switching of the valve, and thus the drilling system, into a different operating mode during unexpected surges or lulls in drilling fluid pressure.

Another aspect of some embodiments of the invention is to provide the operator with additional assurances that the desired operating mode has been implemented. In various embodiments, the drilling system may include a feedback device for indicating to an operator the operating condition of the valve. The feedback device may confirm that the drill head has been placed into the desired operating mode.

One aspect of certain embodiments is to provide a drill head that is capable of cutting along different axes relative to the orientation and movement of the drill head and/or drill string. More specifically, certain embodiments may include a drill head that may cut straight ahead, parallel with the longitudinal axis of the drill head, and/or in the direction of travel of the drill string. In further embodiments, the drill head may be equipped to cut a curve, at an angle relative to the longitudinal axis of the drill head and/or the direction of travel of the drill string. A curve cut may be accomplished by attaching a swivel head containing the cutting implements on the front end (i.e., leading) surface of the drill head, the swivel head being angularly articulable relative to the longitudinal axis of the drill head, in response to changes in the pressure of the drilling fluid. In still further embodiments, the drill head may be capable of cutting "to the side," i.e., at a substantial angle relative to the longitudinal axis of the drill head or the direction of travel of the drill string. In some embodiments, the drill head may cut along any axis in response to an input by the operator. Such inputs include, by way of example, a change in the pressure of the drilling fluid provided to the drill head.

In another aspect of embodiments of the present invention, the drill head may cut bores of different shapes and orientations depending upon the movement of the drill string and other control inputs by the operator. In some embodiments, the drill head may cut straight cylindrical bores. In other embodiments, the drill head may cut curved, or radius, bores. In still other embodiments, the drill head may have the capability to cut more complex shapes into the reservoir. By way of example only, the drill head, while stationary or rotating in place, may cut panels or pancakes and, while being withdrawn from underground, may cut spirals.

Another aspect of embodiments of the present invention is to enhance the SRV of an oil and gas reservoir in such a way as to minimize the geological and environmental impacts of the drilling. In recent years, some public interest and regulatory groups have voiced concerns that pumping large quantities of extrinsic material into oil and gas reservoirs, which is required by conventional hydraulic fracturing techniques, may contribute to geological or seismic instability of the formation. In addition, there are worries that the particular materials used in hydraulic fracturing, and in particular hydraulic fracturing proppants (which often consist of sand or ceramics treated with undesirable chemicals, e.g., hydrochloric acid, biocides, radioactive tracer isotopes, or volatile organic compounds), may have an adverse effect on the quality of local groundwater and surface water. Various embodiments of the invention require much smaller quantities of cutting and fracturing materials than the techniques of the prior art, such as hydraulic fracturing. Some embodiments of the present invention use only ultra-high-pressure jets of water to cut into the reservoir, thus eliminating the need for proppants and other potentially harmful chemicals found in hydraulic fracturing and greatly reducing the quantity of extrinsic material pumped underground. The ultra-high-pressure water jets may be combined, in certain embodiments, with one or more abrasive materials to enhance the cutting efficiency of the fluid stream. By way of example, abrasive materials may include garnet, aluminum oxide, or other abrasive additives well-known to those skilled in the art. Known abrasive materials and methods are described in the art, as described in U.S. Pat. No. 8,475,230, entitled "Method and Apparatus for Jet-Assisted Drilling or Cutting," issued Jul. 2, 2013 to Summers et al., which is hereby incorporated by reference in its entirety. Embodiments of the invention may utilize lasers to cut into the reservoir by any one or more laser earth boring methods known in the art, including but not limited to vaporization cutting (as described in U.S. Pat. No. 8,253,068, entitled "Method of Cutting Bulk Amorphous Alloy," issued Aug. 28, 2012 to Yuan et al., which is hereby incorporated by reference in its entirety), melt-and-blow (as described in U.S. Pat. No. 6,980,571, entitled "Laser Cutting Method and System," issued Dec. 27, 2005 to Press et al., which is hereby incorporated by reference in its entirety), thermal stress cracking (as described in U.S. Pat. No. 5,968,382, entitled "Laser Cleavage Cutting Method and System," issued Oct. 19, 1999 to Kazui et al., which is hereby incorporated by reference in its entirety), and reactive cutting (as described in U.S. Pat. No. 5,558,786, entitled "Process for High Quality Plasma Arc and Laser Cutting of Stainless Steel and Aluminum," issued Sep. 24, 1996 to Couch et al., which is hereby incorporated by reference in its entirety). Likewise, embodiments of the invention may utilize any one or more type of fluid jet known in the art, including but not limited to continuous jets, pulse jets, cavitation jets, or slurry jets. Various embodiments may combine any one or more of water jet cutting (with or without abrasive additives), laser cutting, and mechanical (i.e., using a physical drill bit) cutting, as needed.

It is another aspect of the present invention to provide a drilling system with fewer parts and requiring less maintenance than conventional systems.

It is another aspect of the present invention to provide a drilling system which does not come into direct contact with the rock being excavated, thus improving the useful lifetime of the system.

It is another aspect of the present invention to provide a drilling system and method which allows for a casing of a borehole to be set directly behind the drill head.

It is one aspect of the present invention to provide a drill head which is partially or entirely self-propelled, thereby reducing the system's reliance on driving of the drill string and increasing drilling speed. In embodiments, the drill head may be equipped with backward-facing fluid jets to provide forward thrust to the drill head. Fluid may be forced to and through the backward-facing jets by a valve in the same way that fluid is forced to and through the cutting water jets of the drill head when the system is placed in, for example, a straight drilling mode, a radius bore drilling mode, or a side panel cutting mode. Thus, the system may in some embodiments have a propulsion mode or thrust mode in addition to the various drilling and cutting modes. As compared to conventional drilling, torque and thrust are not required to advance the drill head and drill string.

It is another aspect of the present invention to improve the efficiency of the removal of the waste materials generated by the operation of the drill head, i.e., rock cuttings, water, etc. The removal of waste materials is described herein as "mucking removal." In embodiments, the drill head may be equipped with backward-facing fluid jets to assist in mucking removal. In some embodiments the same backward-facing fluid jets on the drill head used to provide forward thrust to the drill head may be used to assist in mucking removal, while in other embodiments the drill head may have separate backward-facing fluid jets for providing thrust and for mucking removal. In one embodiment, one or more fluid jets are provided, at intervals, on the drill string upstream of the drill head to increase the system's capacity to remove waste materials and prevent rock cuttings from settling within the drilled space.

In one embodiment, a non-operational mode is provided for the system. Such a mode may correspond to a fluid pressure outside the ranges necessary to place the valve of the present invention in the appropriate position for a drilling, cutting, or propulsion mode. When the valve is placed in the position for the off mode, it may redirect drilling fluid through a particular configuration of water jets, such that the fluid is not being used to drill or cut into the reservoir, nor to provide thrust to the drill head. The addition of such a mode may be advantageous in that it does not require the operator to completely cut off the supply of drilling fluid to shut down the drilling system. In certain embodiments, the off mode may correspond to a low drilling fluid pressure, such that the non-operational mode may be an advantageous fail-safe position in case of a sudden unexpected loss of fluid pressure within the drill string or at the drill head.

In various embodiments, the number and configuration of water jets, lasers, and/or mechanical drill bits on the drill head may vary depending upon the application for which the drilling system is to be used. Various embodiments may include variations in the number of water jets, lasers, and/or mechanical drill bits on either or both of the swivel head attached to the front end (i.e., forward) surface of the drill head containing the swivel head and the circumferential (i.e., side) face of the drill head. In a first exemplary embodiment, the swivel head contains a single water jet and a single laser, arranged side by side. In a second exemplary embodiment, the swivel head contains a single laser and two water jets, one on either side of the laser. In a third exemplary embodiment, the swivel head contains an inner circular arrangement of two lasers and two water jets, arranged alternatingly, and an outer circular arrangement of six water jets and six lasers, arranged alternatingly. In a fourth exemplary embodiment, the swivel head contains an inner circular arrangement of four lasers, an outer circular arrangement of eight lasers, and a single large water jet surrounding the inner and outer circular arrangements of lasers. In a fifth exemplary embodiment, the side surface of the drill head contains a single water jet. In a sixth exemplary embodiment, the side surface of the drill head contains a single laser. In a seventh exemplary embodiment, the side surface of the drill head contains a single water jet and a single laser, arranged in close proximity to each other. In an eighth exemplary embodiment, the side surface of the drill head contains four water jets, spaced at substantially equal (e.g., about 90-degree) intervals around the circumference of the drill head. In a ninth exemplary embodiment, the side surface of the drill head contains four water jets and four lasers, arranged in four pairs of one water jet and one laser each, these pairs being spaced at substantially equal (e.g., about 90-degree intervals) around the circumference of the drill head. In a tenth exemplary embodiment, the side surface of the drill head contains eight water jets, spaced at substantially equal (e.g., about 45-degree) intervals around the circumference of the drill head. In an eleventh exemplary embodiment, the side surface of the drill head contains eight water jets and eight lasers, arranged in eight pairs of one water jet and one laser each, these pairs being spaced at substantially equal (e.g., about 45-degree) intervals around the circumference of the drill head. In a twelfth exemplary embodiment, the side surface of the drill head contains twelve water jets, spaced at substantially equal (e.g., about 30-degree) intervals around the circumference of the drill head. In a thirteenth exemplary embodiment, the side surface of the drill head contains twelve water jets and twelve lasers, arranged in twelve pairs of one water jet and one laser each, these pairs being spaced at substantially equal (e.g., about 30-degree) intervals around the surface of the drill head. In a fourteenth exemplary embodiment, the swivel head contains an inner circular arrangement of four lasers, a middle circular arrangement of eight water jets, and an outer circular arrangement of six water jets and six lasers, arranged alternatingly. In a fifteenth exemplary embodiment, the swivel head contains an inner circular arrangement of four lasers, a middle circular arrangement of eight water jets, and an outer circular arrangement of twelve lasers. In a sixteenth exemplary embodiment, the swivel head contains an innermost circular arrangement of four lasers, an inner circular arrangement of four water jets, an outer circular arrangement of eight combination water jet/mechanical drill tools, and an outermost circular arrangement of six water jets and six lasers, arranged alternatingly. In a seventeenth exemplary embodiment, the swivel head contains an innermost circular arrangement of four lasers, an inner circular arrangement of eight water jets, a middle circular arrangement of eight combination water jet/mechanical drill tools, an outer circular arrangement of eight combination water jet/mechanical drill tools, and an outermost circular arrangement of eight lasers and eight water jets, arranged alternatingly. In any of these embodiments, any or all of the circular arrangements contained in the swivel head may be disposed in independently rotatable rings capable of rotating in at least one of a clockwise direction and a counterclockwise direction. Likewise, in embodiments, the body of the drill head may be capable of rotating in at least one of a clockwise direction and a counterclockwise direction. It should be understood that these exemplary embodiments are provided for purposes of example and description only and should not be construed as limiting this disclosure. The making and use of the above-described embodiments and other similar embodiments is well-known in the art, as described in, for example, U.S. Pat. No. 6,283,230, entitled "Method and Apparatus for Lateral Well Drilling Utilizing a Rotating Nozzle," issued Sep. 4, 2001 to Peters, which is hereby incorporated by reference in its entirety.

In certain embodiments of the present invention, each water jet and/or each laser may be carried in separate tubes within the drill head.

In certain embodiments, laser(s) on the drill head may be circular or ovular in shape. Some embodiments may provide laser and water jets which are displaced off-center a few degrees from the vertical diameter of the swivel head to achieve more effective cutting. Various embodiments may also include different spacing between laser(s) and water jet(s) on the swivel head. In some embodiments, the distance between each laser and the closest water jet is between about 0.25 inches and about one inch. In other embodiments, the waterjet(s) may also protrude from, or be recessed within, the face of the swivel head such that the water jet(s) are behind or in front of the laser(s). In one embodiment, the water jet(s) are about 0.25 inches behind the laser(s). In another embodiment, the water jet(s) are about 0.25 inches in front of the laser(s).

In some embodiments, multiple discrete pressure ranges for the pressure of the drilling fluid are called for. Each discrete pressure range corresponds to a particular position of the valve spool within the valve and, thus, with a particular operating mode of the drilling system. In one embodiment, a drilling fluid pressure of at least about 55 kilopounds-force per square inch (kpsi) corresponds to a radius bore drilling mode, a pressure of between about 40 kpsi and about 55 kpsi corresponds to a straight drilling mode, a pressure of between about 20 kpsi and about 40 kpsi corresponds to a side panel cutting mode, a pressure of between about 10 kpsi and about 20 kpsi corresponds to a propulsion mode, and a pressure of less than about 10 kpsi corresponds to a non-operational mode. In another embodiment, a pressure of at least about 50 kpsi corresponds to a radius bore drilling mode, a pressure of between about 40 kpsi and about 50 kpsi corresponds to a straight drilling mode, a pressure of between about 30 kpsi and about 40 kpsi corresponds to a side panel cutting mode, a pressure of between about 20 kpsi and about 30 kpsi corresponds to a propulsion mode, and a pressure of less than about 20 kpsi corresponds to a non-operational mode. The two embodiments just described are provided for purposes of example and description only and should not be construed as limiting this disclosure. One of ordinary skill in the art may provide a drilling head having the first set of pressure ranges, the second set of pressure ranges, or other similar pressure ranges falling within the scope of the invention.

The invention also includes a method and apparatus for cutting ultra-short radius bores. Such bores are advantageous because they allow for a change in direction of a borehole or system of boreholes within a shorter distance, requiring less time and material to drill and preserving a greater share of the reservoir for targeted drilling of boreholes, panels, etc. In one embodiment, the ultra-short radius boring apparatus includes a series of straight, linked jackets surrounding and protecting the drill string, allowing for both radius and straight cuts, which allow the drill string to be inserted, withdrawn, advanced horizontally, or advanced through a radius bore in sections. The jackets are linked by rotatable links, allowing one jacket to be disposed at an angle with respect to another. A drill head for use with a series of linked jackets may contain a swivel head. The swivel head may, in response to a change in pressure of the drilling fluid, be disposed at an angle relative to the longitudinal axis of the drill head. Thus, when the drilling fluid or lasers exit the ports located on the swivel head, a portion of the reservoir lying proximate to, and at an angle with respect to, the longitudinal axis of the drill head may be cut. When a drill string having linked jackets and a drill head with a swivel head are combined in a single system, radius bores may be cut such that a single linked jacket lies in a given horizontal plane, and such that each successive linked jacket lies, with respect to the next linked jacket, at an angle equal to the angular displacement of the swivel head relative to the longitudinal axis of the drill head. In this manner, radius bores may be cut having a radius on the order of only a few times the length of a single linked jacket, resulting in radius bores with substantially smaller radius than may be achieved by conventional methods. In various embodiments, the radius may be as small as about two meters. The system of articulable linked jackets included as part of the method and apparatus for drilling ultra-short radius bores is described in U.S. Pat. No. 4,141,225, entitled "Articulated, Flexible Shaft Assembly with Axially Lockable Universal Joint," issued Feb. 27, 1979 to Varner, which is hereby incorporated by reference in its entirety.

In some embodiments, each jacketed section of the drill string may be at least about half a meter but no more than about a meter long. In other embodiments, each jacketed section of drill string may be at least about two, but no more than about four, meters long. Moreover, in embodiments, the angle of displacement of the swivel head with respect to the longitudinal axis of the drill head may be between about five and 25 degrees. In further embodiments, the angle of displacement of the swivel head with respect to the longitudinal axis of the drill head may be between about ten and twenty degrees. In still further embodiments, the angle of displacement of the swivel head with respect to the longitudinal axis of the drill head may be about fifteen degrees.

The drill head may, in some embodiments, include a laser distributor swivel, which may direct laser light provided from an aboveground source through any of various laser ports on the drill head. In embodiments, the laser distributor swivel may direct laser light through ports on a front swivel head, or on the sides of the drill head for panel cutting. The laser distributor swivel thus serves the same mode switching function for laser light as the valve does for the high-pressure drilling fluid.

In one embodiment, a valve assembly for controlling operating modes of a drill is provided. The valve assembly comprises: a housing, comprising a bore; a first end; a first hole; a second hole; a first body groove interconnected to the first hole, wherein the first body groove corresponds to a first operating mode; and a second body groove interconnected to the second hole, wherein the second body groove corresponds to a second operating mode; a spool having an axial bore, a first end, and a second end, wherein the spool is movable between a first position and a second position, wherein the first end of the spool is capable of receiving a drilling fluid and the second position corresponds to a second pressure of the drilling fluid; a spring located within the bore of the housing, biased against the second end of the spool and the first end of the housing body; and a detent.

In one embodiment, a rock drilling and paneling system is provided, comprising: at least two operating modes, wherein one of the at least two operating modes is selected from a group consisting of a straight drilling mode, a radius bore drilling mode, and a side panel cutting mode; a drilling fluid; a valve assembly comprising a housing, comprising a bore; a first end; a first hole; a second hole; a first body groove interconnected to the first hole, wherein the first body groove corresponds to a first operating mode; and a second body groove interconnected to the second hole, wherein the second body groove corresponds to a second operating mode; a spool having an axial bore, a first end, and a second end, wherein the spool is movable between a first position and a second position, wherein the first end of the spool is capable of receiving a drilling fluid and the second position corresponds to a second pressure of the drilling fluid; wherein one of the at least two operating modes corresponds to a first pressure of the drilling fluid and a second of the at least two operating modes corresponds to a second pressure of the drilling fluid.

In one embodiment a drilling system is provided comprising: a drill string; a drilling fluid for drilling into a geological formation, wherein the drilling fluid flows through the drill string; a drill head interconnected to the drill string, the drill head having at least two operating modes, wherein a first operating mode of the at least two operating modes is selected from a group consisting of a straight drilling mode, a radius bore drilling mode, a side panel cutting mode, a propulsion mode, and a non-operational mode, and wherein the drill head comprises a valve assembly, comprising: a housing comprising: a bore; a first end; a first hole; a second hole; a first body groove interconnected to the first hole, wherein the first body groove corresponds to the first operating mode; and a second body groove interconnected to the second hole, wherein the second body groove corresponds to a second operating mode of the at least two operating modes; and a spool having an axial bore, a first end, and a second end, wherein the spool is moveable between a first position and a second position, wherein the first end of the spool receives the drilling fluid, and wherein the first position corresponds to a first pressure of the drilling fluid and the second position corresponds to a second pressure of the drilling fluid; wherein the first operating mode corresponds to the first pressure of the drilling fluid and the second operating mode corresponds to the second pressure of the drilling fluid; a drill head body having a leading surface and a circumferential surface; and a swivel head interconnected to the leading surface of the drill head body, wherein the swivel head is angularly articulable relative to a longitudinal axis of the drill head body, and wherein the swivel head comprises: a first fluid jet cutter; a second fluid jet cutter; a first laser cutter; and a second laser cutter.

In further embodiments, the drilling system further comprises a side panel cutting head positioned on the circumferential surface of the drill head body; the housing further comprises: a third hole; a fourth hole; a third body groove interconnected to the third hole, wherein the third body groove corresponds to a third operating mode; and a fourth body groove interconnected to the fourth hole, wherein the fourth body groove corresponds to a fourth operating mode; wherein: the first pressure of the drilling fluid is between about 40 kpsi and about 50 kpsi; the second pressure of the drilling fluid is between about 30 kpsi and about 40 kpsi; the third operating mode corresponds to a third pressure of the drilling fluid, and wherein the third pressure is between about 20 kpsi and about 30 kpsi; and the fourth operating mode corresponds to a fourth pressure of the drilling fluid, and wherein the fourth pressure is less than about 20 kpsi. In some embodiments, the first hole of the housing is positioned on a downstream surface of the housing. In other embodiments, the first hole of the housing is positioned on a lateral surface of the housing. In still other embodiments, the first hole of the housing is positioned on an upstream face of the housing. In one embodiment, the drilling system further comprises a detent assembly for locking the spool in the first position and in the second position, wherein the detent comprises a spring biased against a locking pin, wherein the locking pin is biased against a first notch of the spool when the spool is in the first position and the locking pin is biased against a second notch of the spool when the spool is in the second position; wherein the locking pin of the detent assembly is selected from a group consisting of a ball, a pin, a sphere, a wheel, and a block. The drilling system may also comprise a percussive fluid jet. The drill head can comprise a laser distributor swivel. In various embodiments, the drill head body is displaced about fifteen degrees relative to the longitudinal axis of the drill head body.

In one embodiment, a drilling system is provided comprising: a drill string; a drilling fluid for drilling into a geological formation, wherein the drilling fluid flows through the drill string; a drill head interconnected to the drill string, the drill head having a first operating mode, a second operating mode, and a third operating mode, wherein the first operating mode is selected from a group consisting of a straight drilling mode, a radius bore drilling mode, a side panel cutting mode, a propulsion mode, and a non-operational mode, and wherein the drill head comprises: a first laser cutter with a first laser beam; a second laser cutter with a second laser beam; and a valve assembly comprising: a housing comprising: a bore; a first end; a first hole; a second hole; a first body groove interconnected to the first hole, wherein the first body groove corresponds to the first operating mode; and a second body groove interconnected to the second hole, wherein the second body groove corresponds to the second operating mode; and a spool having an axial bore, a first end, and a second end, wherein the spool is moveable between a first position and a second position, wherein the first end of the spool receives the drilling fluid, and wherein the first position corresponds to a first pressure of the drilling fluid and the second position corresponds to a second pressure of the drilling fluid; wherein the first operating mode corresponds to the first pressure of the drilling fluid, the second operating mode corresponds to the second pressure of the drilling fluid, and the third operating mode corresponds to the first and second laser beams pointing at an impingement point on the geological formation; a drill head body having a leading surface and a circumferential surface; a swivel head interconnected to the leading surface of the drill head body, wherein the swivel head has a cutting head; a side panel cutting head positioned on the circumferential surface of the drill head body; and wherein the swivel head is angularly articulable relative to a longitudinal axis of the drill head body.

In some embodiments, the drill head body is displaced about fifteen degrees relative to a longitudinal axis of the drill head body and the drilling system further comprises a fluid jet and/or a mechanical drill bit. In further embodiments, the spool further comprises a first notch and a second notch, wherein the valve assembly further comprises a detent assembly comprising a spring biased against a locking pin, and wherein the locking pin is biased against the first notch of the spool when the spool is in the first position and the locking pin is biased against the second notch of the spool when the spool is in the second position.

In one embodiment, a method for treating a tar sands formation, comprising: providing a well bore extending to an upper section of the tar sands formation, wherein the upper section is located directly below an overburden section; providing an injection well in the well bore, the injection well extending to the tar sands formation; providing a production well in the well bore, the production well extending to the upper section of the tar sands formation; cutting an initial cavity into the upper section of the tar sands formation, wherein the initial cavity is substantially longer and wider than the initial cavity is deep; providing a heater in the initial cavity; providing heated fluid into the initial cavity through the injection at a first pressure; heating the heated fluid in the initial cavity using the heater; mixing the heated fluid with hydrocarbons in the tar sands formation; increasing the size of the initial cavity by extending the cavity deeper down into the tar sands formation, wherein the cavity has an upper section and a lower section; allowing heat from the heaters and heated fluid to transfer to the hydrocarbons in the cavity; allowing the hydrocarbons to rise to the upper section of the cavity; allowing the heated fluid to gravity drain into the lower section of the cavity; extending the heater into the lower section of the cavity such that the heater is in contact with the heated fluid; and producing hydrocarbons from the upper section of the cavity through an opening in the production well.

In further embodiments, the method for treating a tar sands formation further comprising drilling a horizontal drill hole past the cavity to increase the effect of the heated fluid. Additionally, the initial cavity can be cut into the upper section of the tar sands formation using a percussive water jet and/or a laser.

In one embodiment, a method for enhancing a volume of a reservoir is provided, comprising: providing a drilling system comprising: a drill string; a drilling fluid for drilling into a geological formation, wherein the drilling fluid flows through the drill string; a drill head interconnected to the drill string, wherein the drill head comprises a valve assembly having a housing with a bore, a first end, a first hole, and a second hole, and the valve assembly comprising a spool having an axial bore, a first end, and a second end, wherein the spool is moveable between a first position and a second position, wherein the first end of the spool receives the drilling fluid, and wherein the first position corresponds to a first pressure of the drilling fluid and the second position corresponds to a second pressure of the drilling fluid; providing a vertical wellbore into the reservoir; drilling one or more horizontal boreholes extending outwardly from the vertical wellbore using a first drilling mode; changing the first drilling mode to a second drilling mode via a remote control while the drill head is in the reservoir; and cutting a plurality of spaces into the reservoir, wherein the plurality of spaces is interconnected to the horizontal borehole.

Although many of the embodiments are focused on drilling systems with a remotely controllable drill head for use in oil and gas drilling, the invention may be used in any application where excavation of spaces in hard materials is necessary or desirable. Such applications include heavy industrial activities that involve extensive drilling or cutting in places that are dangerous, difficult, or impossible for humans or heavy equipment to access directly. Such other applications include, but are not limited to: sublevel caving, block caving, longwall mining, forming underground structures and openings to enhance effective permeability for higher extraction and production rate of oil and gas, increasing the surface area exposure of water or steam in geothermal engineering, creating foundations or retaining walls, and creating underground structures for use by humans or machines.

For purposes of further disclosure and to comply with applicable written description and enablement requirements, the following references generally relate to drilling systems and methods for controlling functions remotely and are hereby incorporated by reference in their entireties:

U.S. Pat. No. 1,959,174, entitled "Method of and Apparatus for Sinking Pipes or Well Holes into the Ground," issued May 15, 1934 to Moore ("Moore"). Moore describes a method of and apparatus for sinking pipes or well holes into the ground, to be used either as a permanent foundation for portion of super-structures or for the removal of water from subterranean pockets through the medium of well-points.

U.S. Pat. No. 2,169,718, entitled "Hydraulic Earth-Boring Apparatus," issued Aug. 15, 1939 to Boll et al ("Boll"). Boll describes a boring apparatus by which a continual supply of water under pressure can be maintained to keep the soil in the bore hole suspended.

U.S. Pat. No. 2,756,020, entitled "Method and Apparatus for Projecting Pipes Through Ground," issued Jul. 24, 1956 to D'Audiffret et al ("D'Audiffret"). D'Audiffret describes a method and apparatus for projecting pipes through the ground, and particularly in connection with projecting imperforate pipes through the ground.

U.S. Pat. No. 2,886,281, entitled "Control Valve," issued May 12, 1959 to Canalizo ("Canalizo"). Canalizo describes valves and the like for controlling the passage of fluid therethrough, and in particular to provide a valve having flow passages therethrough with a resilient valve member operable to open and close said flow passages to flow therethrough.

U.S. Pat. No. 3,081,828, entitled "Method and Apparatus for Producing Cuts Within a Bore Hole," issued Mar. 19, 1963 to Quick ("Quick"). Quick describes a method and apparatus for producing lateral cuts within a bore hole that has been drilled into an earth formation for the recovery of water, gas, oil, minerals, and the like.

U.S. Pat. No. 3,112,800, entitled "Method of Drilling with High Velocity Jet Cutter Rock Bit," issued Dec. 3, 1963 to Bobo ("Bobo"). This patent describes high velocity jet cutters for use with rotary rock bits for drilling wells.

U.S. Pat. No. 3,155,177, entitled "Hydraulic Jet Well Under-Reaming Process," issued Nov. 3, 1964 to Fly ("Fly"). Fly describes an under-reaming process, and more particularly a process for hydraulically under-reaming the sidewalls of a well or bore.

U.S. Pat. No. 3,231,031, entitled "Apparatus and Method for Earth Drilling," issued Jan. 25, 1966 to Cleary ("Cleary"). Cleary describes a method and apparatus for earth borehole drilling wherein there is eroded a pilot hole and sections of the formation between the pilot hole and earth borehole are removed by hydrostatic pressure propagated fractures.

U.S. Pat. No. 3,301,522, entitled "Valve," issued Jan. 31, 1967 to Ashbrook et al ("Ashbrook"). This patent describes fluid valves and more particularly a novel expansible piston valve.

U.S. Pat. No. 3,324,957, entitled "Hydraulic Jet Method of Drilling a Well Through Hard Formations," issued Jun. 13, 1967 to Goodwin et al. ("Goodwin I"). Goodwin I relates to the art of drilling deep boreholes in the earth and in particular to a drill bit employing hydraulic jets to perform substantially all of the rock-cutting action.

U.S. Pat. No. 3,402,780, entitled "Hydraulic Jet Drilling Method," issued Sep. 24, 1968 to Goodwin et al ("Goodwin II"). Goodwin II describes a method by which wells are drilled through hard formations by discharging streams of abrasive-laden liquid from nozzles in a rotating drill bit at velocities in excess of 500 feet per second against the bottom of the borehole of a well.

U.S. Pat. No. 3,417,829, entitled "Conical Jet Bits," issued Dec. 24, 1968 to Acheson et al ("Acheson I"). Acheson I describes a method and apparatus for the hydraulic jet drilling of the borehole of a well in which high-velocity streams of abrasive-laden liquid are discharged from nozzles extending downwardly at different distances from the center of rotation of a drill bit having a downwardly tapering conical bottom member to cut a plurality of concentric grooves separated by thin ridges.

U.S. Pat. No. 3,542,142, entitled "Method of Drilling and Drill Bit Therefor," issued Nov. 24, 1970 to Hasiba et al ("Hasiba"). Hasiba describes a method of drilling wells by hydraulic jet drilling and more particularly to a method and drill bit for use in hydraulic jet drilling of hard formations.

U.S. Pat. No. 3,576,222, entitled "Hydraulic Jet Drill Bit," issued Apr. 27, 1971 to Acheson et al ("Acheson II"). Acheson II describes a drill bit for use in the hydraulic jet drilling of wells.

U.S. Pat. No. 3,744,579, entitled "Erosion Well Drilling Method and Apparatus," issued Jul. 10, 1973 to Godfrey ("Godfrey"). Godfrey describes a method and apparatus for the erosion drilling of wells, which enables rapid drilling with a minimum of equipment.

U.S. Pat. No. 3,871,485, entitled "Laser Beam Drill," issued Mar. 18, 1975 to Keenan ("Keenan I"). Keenan I describes a method using laser technology to bore into subterranean formations, and more particularly replacing the drilling heads normally used in drilling for underground fluids with a laser beam arrangement comprising a voltage generator actuated by the flow of drilling fluids through a drill pipe or collar in a wellhole and a laser beam generator which draws its power from a voltage generator, both positioned in an inhole laser beam housing and electrically connected.

U.S. Pat. No. 3,882,945, entitled "Combination Laser Beam and Sonic Drill," issued May 13, 1975 to Keenan ("Keenan II"). Keenan II describes a method using laser technology and sonic technology to bore into subterranean formations, and more particularly replacing the drilling heads normally used in drilling for underground fluids with a laser beam-sonic beam arrangement comprising a voltage generator actuated by the flow of drilling fluid through the drill pipe or collar and a laser beam generator and a sonic generator each drawing their respective power from a voltage generator also positioned in the in hole drilling housing and electrically connected to both the laser beam generator and the sonic generator.

U.S. Pat. No. 3,977,478, entitled "Method for Laser Drilling Subterranean Earth Formations," issued Aug. 31, 1976 to Shuck ("Shuck"). Shuck describes a method for laser drilling subsurface earth formations, and more particularly to a method for effecting the removal of laser-beam occluding fluids produced by such drilling.

U.S. Pat. No. 3,998,281, entitled "Earth Boring Method Employing High Powered Laser and Alternate Fluid Pulses," issued Dec. 21, 1976 to Salisbury et al ("Salisbury I"). Salisbury I describes a method comprising focusing and/or scanning a laser beam or beams in an annular pattern directed substantially vertically downwardly onto the strata to be bored, and pulsing the laser beam, alternately with a fluid blast on the area to be bored, to vaporize the annulus and shatter the core of the annulus by thermal shock.

U.S. Pat. No. 4,047,580, entitled "High-Velocity Jet Digging Method," issued Sep. 13, 1977 to Yahiro et al ("Yahiro I"). Yahiro I describes an improved method of digging by piercing and crushing the earth's soil and rock with a high-velocity liquid jet.

U.S. Pat. No. 4,066,138, entitled "Earth Boring Apparatus Employing High Powered Laser," issued Jan. 3, 1978 to Salisbury et al ("Salisbury II"). Salisbury II describes a method of earth boring comprising focusing and/or scanning a laser beam or beams in an annular pattern directed substantially vertically downwardly onto the strata to be bored, and pulsing the laser beam, alternately with a fluid blast on the area to be bored, to vaporize the annulus and shatter the core of the annulus by thermal shock.

U.S. Pat. No. 4,084,648, entitled "Process for the High-Pressure Grouting Within the Earth and Apparatus Adapted for Carrying Out Same," issued Apr. 18, 1978 to Yahiro et al ("Yahiro II"). Yahiro II describes a process for the high pressure grouting within the earth, and an apparatus adapted for carrying out same.

U.S. Pat. No. 4,090,572, entitled "Method and Apparatus for Laser Treatment of Geological Formations," issued May 23, 1978 to Welch ("Welch"). Welch describes a method and apparatus including a high power laser for drilling gas, oil or geothermal wells in geological formations, and for fracturing the pay zones of such wells to increase recovery of oil, gas or geothermal energy.

U.S. Pat. No. 4,113,036, entitled "Laser Drilling Method and System of Fossil Fuel Recovery," issued Sep. 12, 1978 to Stout ("Stout"). Stout describes a method and system for drilling of subterranean formations by use of laser beam energy in connection with in situ preparation and recovery of fossil fuel deposits in the form of gas, oil and other liquefied products.

U.S. Pat. No. 4,119,160, entitled "Method and Apparatus for Water Jet Drilling of Rock," issued Oct. 10, 1978 to Summers et al ("Summers"). Summers describes a method and apparatus for boring by fluid erosion, utilizing a water jet nozzle as a drill bit having a configuration of two jet orifices, specifically of different diameters, one directed axially along the direction of travel of the drill head, and the other inclined at the angle to the axis of rotation.

U.S. Pat. No. 4,199,034, entitled "Method and Apparatus for Perforating Oil and Gas Wells," issued Apr. 22, 1980 to Salisbury et al ("Salisbury III"). Salisbury III describes a novel method and apparatus for drilling new and/or extending existing perforation holes within existing or new oil and gas wells or similar excavations.

U.S. Pat. No. 4,206,902, entitled "Inner Element for a Flow Regulator," issued Jun. 10, 1980 to Barthel et al ("Barthel"). Barthel describes a new and improved inner member for controlling the flow of fluid through a flow regulator.

U.S. Pat. No. 4,227,582, entitled "Well Perforating Apparatus and Method," issued Oct. 14, 1980 to Price ("Price"). Price describes well completion methods and apparatus, and in particular improved methods and apparatus for perforating formations surrounding a well bore.

U.S. Pat. No. 4,282,940, entitled "Apparatus for Perforating Oil and Gas Wells," issued Aug. 11, 1981 to Salisbury et al ("Salisbury IV"). Salisbury IV describes a novel method and apparatus for drilling new and/or extending existing perforation holes within existing or new oil and gas wells or similar excavations.

U.S. Pat. No. 4,474,251, entitled "Enhancing Liquid Jet Erosion," issued Oct. 2, 1984 to Johnson ("Johnson I"). Johnson I describes a process and apparatus for pulsing, i.e., oscillating, a high velocity liquid jet at particular frequencies so as to enhance the erosive intensity of the jet when the jet is impacted against a surface to be eroded.

U.S. Pat. No. 4,477,052, entitled "Gate Valve," issued Oct. 16, 1984 to Knoblauch et al ("Knoblauch"). Knoblauch describes a gate valve for the selective blocking and unblocking of a flow path with the aid of a valve body which has at least one shutter member confronting an aperture of that flow path in a blocking position, this shutter member being fluidically displaceable into sealing engagement with a seating surface surrounding the confronting aperture.

U.S. Pat. No. 4,479,541, entitled "Method and Apparatus for Recovery of Oil, Gas, and Mineral Deposits by Panel Opening," issued Oct. 30, 1984 to Wang ("Wang I"). Wang I describes a method for oil, gas and mineral recovery by panel opening drilling including providing spaced injection and recovery drill holes which respectively straddle a deposit bearing underground region, each drill hole including a panel shaped opening substantially facing the deposit bearing region and injecting the injection hole with a fluid under sufficient pressure to uniformly sweep the deposits in the underground region to the recovery hole for recovery of the deposits therefrom.

U.S. Pat. No. 4,624,326, entitled "Process and Apparatus for Cutting Rock," issued Nov. 25, 1986 to Loegel ("Loegel"). Loegel describes a process and an apparatus for cutting rock by means of discharging a medium under high pressure from a nozzle head at a fixed oscillating angle.

U.S. Pat. No. 4,624,327, entitled "Method for Combined Jet and Mechanical Drilling," issued Nov. 25, 1986 to Reichman ("Reichman"). Reichman describes a method and apparatus for drilling in earthen formations for the production of gas, oil, and water.

U.S. Pat. No. 4,625,941, entitled "Gas Lift Valve," issued Dec. 2, 1986 to Johnson ("Johnson II"). Johnson II describes continuous operation, pressure-regulated valves, wherein such a valve may be opened to permit more or less fluid flow therethrough based, at least in part, on the amount of pressure applied to the valve generally from the downstream side.

U.S. Pat. No. 4,787,465, entitled "Hydraulic Drilling Apparatus and Method," issued Nov. 29, 1988 to Dickinson et al ("Dickinson I"). Dickinson I describes hydraulic drilling apparatus in which cutting is effected by streams of fluid directed against the material to be cut.

U.S. Pat. No. 4,852,668, entitled "Hydraulic Drilling Apparatus and Method," issued Aug. 1, 1989 to Dickinson et al ("Dickinson II"). Dickinson II describes hydraulic drilling apparatus in which cutting is effected by streams of fluid directed against the material to be cut.

U.S. Pat. No. 4,878,712, entitled "Hydraulic Method of Mining Coal," issued Nov. 7, 1989 to Wang ("Wang II"). Wang II describes a method of mining coal using water jets to remove a layer of thin horizontal slices of coal.

U.S. Pat. No. 5,199,512, entitled "Method of an Apparatus for Jet Cutting," issued Apr. 6, 1993 to Curlett ("Curlett I"). Curlett I describes a method of and apparatus for producing an erosive cutting jet stream for drilling, boring and the like.

U.S. Pat. No. 5,291,957, entitled "Method and Apparatus for Jet Cutting," issued Mar. 8, 1994 to Curlett ("Curlett II"). Curlett II describes a method of and apparatus for producing an erosive cutting jet stream for drilling, boring and the like.

U.S. Pat. No. 5,361,855, entitled "Method and Casing for Excavating a Borehole," issued Nov. 8, 1994 to Schuermann et al ("Schuermann"). Schuermann describes a method for the excavation of ground to located underground lines for repair of existing underground lines without use of mechanical digging apparatus which can damage the line.

U.S. Pat. No. 5,361,856, entitled "Well Jetting Apparatus and Met of Modifying a Well Therewith," issued Nov. 8, 1994 to Surjaatmadja et al ("Surjaatmadja"). Surjaatmadja describes a jetting apparatus for cutting fan-shaped slots in a plane substantially perpendicular to a longitudinal axis of the well.

U.S. Pat. No. 5,363,927, entitled "Apparatus and Method for Hydraulic Drilling," issued Nov. 15, 1994 to Frank ("Frank"). Frank describes hydraulic drilling apparatus comprising means comprising a drill head having a longitudinal axis, means parallel to the longitudinal axis for channeling high pressure fluid through the drill head, and means diverting the high pressure fluid to and through a plurality of horizontally extendable nozzle arms, wherein the high pressure fluid horizontally extends the nozzle arms and flows through the nozzle arm.

U.S. Pat. No. 5,462,129, entitled "Method and Apparatus for Erosive Stimulation of Open Hole Formations," issued Oct. 31, 1995 to Best et al ("Best"). Best describes an alternate apparatus and method for selectively treating open unlined well bores with skin damage by means of abrasive jetting of exposed formation surfaces.

U.S. Pat. No. 5,787,998, entitled "Down Hole Pressure Intensifier and Drilling Assembly and Method," issued Aug. 4, 1998 to O'Hanlon et al ("O'Hanlon"). O'Hanlon describes a pressure intensifier and drilling assembly having a down hole pump to provide for jet assisted drilling.

U.S. Pat. No. 5,887,667, entitled "Method and Means for Drilling an Earthen Hole," issued Mar. 30, 1999 to Van Zante et al ("Van Zante"). Van Zante describes a method of and means for drilling an earthen hole to locate underground lines that will not damage the line when located.

U.S. Pat. No. 5,897,095, entitled "Subsurface Safety Valve Actuation Pressure Amplifier," issued Apr. 27, 1999 to Hickey ("Hickey"). Hickey describes subsurface safety valves which are controlled from the surface and a control pressure amplifier which facilitates use of wellheads having lower pressure ratings for subsurface safety valves mounted at significant depths.

U.S. Pat. No. 5,934,390, entitled "Horizontal Drilling for Oil Recovery," issued Aug. 10, 1999 to Uthe ("Uthe"). Uthe describes an improved means and method for drilling at an angle to the axis of an existing bore hole.

U.S. Pat. No. 6,142,246, entitled "Multiple Lateral Hydraulic Drilling Apparatus and Method," issued Nov. 7, 2000 to Dickinson et al ("Dickinson III"). Dickinson III describes apparatus and a method of drilling by the use of hydraulic jets.

U.S. Pat. No. 6,189,629, entitled "Lateral Jet Drilling System," issued Feb. 20, 2001 to McLeod et al ("McLeod"). McLeod describes equipment used for drilling lateral channels into an oil or gas bearing formation of a well with the well either under pressure or not under pressure.

U.S. Pat. No. 6,206,112, entitled "Multiple Lateral Hydraulic Drilling Apparatus and Method," issued Mar. 27, 2001 to Dickinson et al ("Dickinson IV"). Dickinson IV describes apparatus and a method of drilling by the use of hydraulic jets.

U.S. Pat. No. 6,263,984, entitled "Method and Apparatus for Jet Drilling Drainholes from Wells," issued Jul. 24, 2001 to Buckman ("Buckman I"). Buckman I describes method and apparatus for drilling through casings and then drilling extended drainholes from wells.

U.S. Patent App. Publication No. 2002/0023781, entitled "Method and Apparatus for Lateral Well Drilling Utilizing a Rotating Nozzle," published Feb. 28, 2002 to Peters ("Peters"). Peters describes an improved method and apparatus for drilling into the earth strata surrounding a well casing utilizing a rotating fluid discharge nozzle and reduction of static head pressure in the well casing in conjunction with the drilling operation.

U.S. Pat. No. 6,626,249, entitled "Dry Geothermal Drilling and Recovery System," issued Sep. 30, 2003 to Rosa ("Rosa"). Rosa describes a system for laser drilling a dry hole under a vacuum and using the heat with a closed circulating heat recovery system, to produce geothermal electricity.

U.S. Pat. No. 6,648,084, entitled "Head for Injecting Liquid Under Pressure to Excavate the Ground," issued Nov. 18, 2003 to Morey et al ("Morey"). This patent describes an injection head for implementing the technique known as "jet grouting."

U.S. Pat. No. 6,668,948, entitled "Nozzle for Jet Drilling and Associated Method," issued Dec. 30, 2003 to Buckman et al ("Buckman II"). Buckman II describes a nozzle for drilling of drainholes from wells and other small-diameter holes.

U.S. Pat. No. 6,817,427, entitled "Device and Method for Extracting a Gas Hydrate," issued Nov. 16, 2004 to Matsuo et al ("Matsuo"). Matsuo describes a method for recovering gas from a gas hydrate deposited in a formation underground or on the sea floor, and for preventing the collapse of the formation from which the gas hydrate has been extracted.

U.S. Pat. No. 6,866,106, entitled "Fluid Drilling System with Flexible Drilling String and Retro Jets," issued Mar. 15, 2005 to Trueman et al ("Trueman"). Trueman describes a self-advancing fluid drilling system which can be used in a variety of mining applications, including but not limited to, drilling into coal seams, to drain methane gas.

U.S. Pat. No. 6,880,646, entitled "Laser Wellbore Completion Apparatus and Method," issued Apr. 19, 2005 to Batarseh ("Batarseh I"). Batarseh I describes an application of laser energy for initiating or promoting the flow of a desired resource, e.g. oil, into a wellbore, referred to as well completion.

U.S. Pat. No. 7,147,064, entitled "Laser Spectroscopy/Chromatography Drill Bit and Methods," issued Dec. 12, 2006 to Batarseh et al ("Batarseh II"). Batarseh II describes an apparatus for drilling oil and gas wells comprising a hybrid drill bit, which provides both a cutting function and a separate heating function.

U.S. Patent App. Publication No. 2008/0073605, entitled "Fluid-Controlled Valve," published Mar. 27, 2008 to Ishigaki et al ("Ishigaki"). Ishigaki describes a fluid-controlled valve, which has a load receiving portion in addition to a sealing lip.

U.S. Pat. No. 7,434,633, entitled "Radially Expandable Downhole Fluid Jet Cutting Tool," issued Oct. 14, 2008 to Lynde et al. ("Lynde"). Lynde describes a jet cutting tool having one or more arms that are extendable radially from the body of the tool.

U.S. Patent App. Publication No. 2009/0078464, entitled "Microtunneling Method," published Mar. 26, 2009 to Cheng ("Cheng"). Cheng describes a microtunneling method that comprises: (a) forming a working well; (b) boring a tunnel from the working well through water jet techniques which use at least one water jet cutter including a jet set and a jet nozzle mounted rotatably on the jet seat, the tunnel being bored by moving progressively the jet seat along a circular path and by rotating the jet nozzle relative to the jet seat; (c) removing excavated soil, rocks or gravel from the tunnel; and (d) advancing the water jet cutter along an axis of the circular path.

U.S. Pat. No. 7,540,339, entitled "Sleeved Hose Assembly and Method for Jet Drilling of Lateral Wells," issued Jun. 2, 2009 to Kolle ("Kolle"). Kolle describes a sleeved hose assembly configured to facilitate the drilling of a long lateral extension through a short radius curve without buckling.

U.S. Patent App. Publication No. 2009/0288884, entitled "Method and Apparatus for High Pressure Radial Pulsed Jetting of Lateral Passages from Vertical to Horizontal Wellbores," published Nov. 26, 2009 to Jelsma ("Jelsma"). This patent application describes a method and apparatus for conveyed high pressure hydraulic radial pulsed jetting in vertical to horizontal boreholes for jet formation of specifically oriented lateral passages in a subsurface formation surrounding a wellbore.

U.S. Patent App. Publication No. 2010/0044103, entitled "Method and System for Advancement of a Borehole using a High Power Laser," published Feb. 25, 2010 to Moxley et al ("Moxley"). Moxley describes methods, apparatus and systems for delivering advancing boreholes using high power laser energy that is delivered over long distances, while maintaining the power of the laser energy to perform desired tasks.

U.S. Patent App. Publication No. 2010/0044104, entitled "Apparatus for Advancing a Wellbore using High Power Laser Energy," published Feb. 25, 2010 to Zediker et al ("Zediker I"). Zediker I describes methods, apparatus and systems for delivering high power laser energy over long distances, while maintaining the power of the laser energy to perform desired tasks.

U.S. Patent App. Publication No. 2010/0044106, entitled "Method and Apparatus for Delivering High Power Laser Energy over Long Distances," published Feb. 25, 2010 to Zediker et al ("Zediker II"). Zediker II describes methods, apparatus and systems for delivering high power laser energy over long distances, while maintaining the power of the laser energy to perform desired tasks.

U.S. Patent App. Publication No. 2010/0084588, entitled "Deepwater Hydraulic Control System," published Apr. 8, 2010 to Curtiss et al ("Curtiss"). Curtiss describes a hydraulic control system and method for rapidly actuating subsea equipment in deep water comprising a combination of a subsea control valve having a small actuation volume with a small internal diameter umbilical hose extending downward to the control valve.

U.S. Pat. No. 7,699,107, entitled "Mechanical and Fluid Jet Drilling Method and Apparatus," issued Apr. 20, 2010 to Butler et al ("Butler"). Butler describes a method and apparatus of excavating using a self-contained system disposable within a wellbore, and a method and apparatus for excavating using ultra-high pressure fluids.

U.S. Patent App. Publication No. 2011/0220409, entitled "Method and Device for Fusion Drilling," published Sep. 15, 2011 to Foppe ("Foppe"). Foppe describes a method of and an apparatus for producing dimensionally accurate boreholes, manholes and tunnels in any kind of ground, for example rock, where a drill-hole floor is melted by a molten mass and the molten material of the floor is pressed into a region surrounding the drill hole, in particular the surrounding rock that has been cracked open by temperature and pressure, and where during drilling a drill-hole casing is formed by the solidifying molten mass around a well string formed by line elements.

U.S. Pat. No. 8,056,576, entitled "Dual Setpoint Pressure Controlled Hydraulic Valve," issued Nov. 15, 2011 to Van Weelden ("Van Weelden"). Van Weelden describes valve spool valves in which pressure applied to a port causes the position of the valve spool to change, thereby opening or closing a fluid path, having two electrically selectable setpoints that vary a pressure threshold which must be exceeded for the valve spool to change position.

U.S. Pat. No. 8,087,637, entitled "Self-Regulating Valve for Controlling the Gas Flow in High Pressure Systems," issued Jan. 3, 2012 to Sun et al ("Sun"). Sun describes a controlled pressure release valve which controls the gas flow in high pressure systems.

U.S. Patent App. Publication No. 2012/0067643, entitled "Two-Phase Isolation Methods and Systems for Controlled Drilling," published Mar. 22, 2012 to DeWitt et al ("DeWitt"). DeWitt describes methods and apparatus for laser assisted drilling of boreholes and for the directional control of laser assisted drilling of boreholes and for performing laser operations within a borehole.

U.S. Patent App. Publication No. 2012/0138826, entitled "Pneumatic Valve," published Jun. 7, 2012 to Morris et al ("Morris"). Morris describes a pneumatic valve including a first port and a second port, including a valve mechanism in fluidic communication with the first port and the second port, the valve mechanism being configured to receive a pneumatic control signal via the first port and advance to a next valve actuation state of a plurality of predetermined valve actuation states upon receipt of the pneumatic control signal.

U.S. Patent App. Publication No. 2012/0160567, entitled "Method and Apparatus for Drilling a Zero-Radius Lateral," published Jun. 28, 2012 to Belew et al ("Belew"). Belew describes a jet drilling lance assembly that is capable of providing high-pressure fluid to power a rotary jet drill while providing sufficient thrust to maintain face contact while drilling and sufficient lateral stiffness to prevent the lance from buckling and diverting from a straight lateral trajectory.

U.S. Pat. No. 8,240,634, entitled "High-Pressure Valve Assembly," issued Aug. 14, 2012 to Jarchau et al ("Jarchau"). Jarchau describes a high-pressure valve assembly including a flange defining an axis, a valve body projecting into the flange, a spring-loaded closure member supported for movement in a direction of the axis on one side of the valve body to form a suction valve, a spring-loaded tappet supported for movement in the direction of the axis on another side of the valve body in opposition to the one side to form a pressure valve, and a channel connecting the suction valve with the pressure valve and having one end porting into a pressure chamber of the valve body adjacent to the pressure valve, said pressure chamber extending in axial direction of the tappet and sized to extend substantially above a bottom edge of the ring seal.

U.S. Pat. No. 8,256,530, entitled "Method of Processing Rock with Laser and Apparatus for the Same," issued Sep. 4, 2012 to Kobayashi et al ("Kobayashi"). Kobayashi describes a technique for processing rock with a laser without any problem even when dross is deposited in working the rock.

U.S. Patent App. Publication No. 2012/0228033, entitled "Method and Apparatus for Forming a Borehole," published Sep. 13, 2012 to Mazarac ("Mazarac"). Mazarac describes a method and apparatus for drilling lateral boreholes from a main wellbore using a high pressure jetting hose for hydrocarbon recovery.

U.S. Patent App. Publication No. 2012/0255774, entitled "High Power Laser-Mechanical Drilling Bit and Methods of Use," published Oct. 11, 2012 to Grubb et al ("Grubb"). Grubb describes novel laser-mechanical drilling assemblies, such as drill bits, that provide for the delivery of high power laser energy in conjunction with mechanical forces to a surface, such as the end of a borehole, to remove material from the surface.

U.S. Patent App. Publication No. 2012/0261188, entitled "Method of High Power Laser-Mechanical Drilling," published Oct. 18, 2012 to Zediker et al ("Zediker III"). Zediker III describes a laser-mechanical method for drilling boreholes that utilizes specific combinations of high power directed energy, such as laser energy, in combination with mechanical energy to provide a synergistic enhancement of the drilling process.

U.S. Patent App. Publication No. 2012/0261194, entitled "Drilling a Borehole and Hybrid Drill String," published Oct. 18, 2012 to Blange ("Blange I"). Blange I describes a method of drilling a borehole into an object, and to a hybrid drill string.

U.S. Patent App. Publication No. 2012/0273276, entitled "Method and Jetting Head for Making a Long and Narrow Penetration in the Ground," published Nov. 1, 2012 to Freyer ("Freyer"). Freyer describes a method for making a long and narrow penetration in the ground where a jetting head that has a longitudinal axis is attached to a leading end of a tubular, and a jetting head for performing the method.

U.S. Patent App. Publication No. 2012/0273277, entitled "Method of Drilling and Jet Drilling System," published Nov. 1, 2012 to Blange et al ("Blange II"). Blange II describes a method of drilling into an object, in particular by jet drilling, and to a jet drilling system.

U.S. Patent App. Publication No. 2013/0112478, entitled "Device for Laser Drilling," published May 9, 2013 to Braga et al ("Braga"). Braga describes equipment for laser-drilling comprising an optical drill bit and a feed module with lasers embedded.

U.S. Patent App. Publication No. 2013/0112901, entitled "Reduced Length Actuation System," published May 9, 2013 to Biddick ("Biddick"). Biddick describes an actuation system in a space efficient form.

U.S. Patent App. Publication No. 2013/0175090, entitled "Method and Apparatus for Delivering High Power Laser Energy over Long Distances," published Jul. 11, 2013 to Zediker et al ("Zediker IV"). Zediker IV describes methods, apparatus and systems for delivering high power laser energy over long distances, while maintaining the power of the laser energy to perform desired tasks.

U.S. Patent App. Publication No. 2013/0192893, entitled "High Power Laser Perforating Tools and Systems Energy over Long Distances," published Aug. 1, 2013 to Zediker et al ("Zediker V"). Zediker V describes methods, apparatus and systems for delivering high power laser energy over long distances, while maintaining the power of the laser energy to perform desired tasks.

U.S. Patent App. Publication No. 2013/0192894, entitled "Methods for Enhancing the Efficiency of Creating a Borehole Using High Power Laser Systems," published Aug. 1, 2013 to Zediker et al ("Zediker VI"). Zediker VI describes methods, apparatus and systems for delivering high power laser energy over long distances, while maintaining the power of the laser energy to perform desired tasks.

U.S. Patent Publication No. 2013/0269935 to Cao et al. entitled "Treating Hydrocarbon Formations Using Hybrid In Situ Heat Treatment and Steam Methods" discloses heating tar sands to mobilize the hydrocarbons and remove the hydrocarbons from the formation.

U.S. Patent Publication No. 2015-0167436 to Frederick et al. entitled "Method to Maintain Reservoir Pressure During Hydrocarbon Recovery Operations Using Electrical Heating Means With or Without Injection of Non-Condensable Gases" discloses using electrical heating means in a first region where the electric heating affects the pressure by thermal expansion of the liquids and vapors present in or added to the first region and/or flashing of those liquids to vapors.

U.S. Patent Publication No. 2015/0027694 to Vinegar et al. entitled "Heater Pattern for In Situ Thermal Processing of a Subsurface Hydrocarbon Containing Formation" discloses using a heater cell divided into nested inner and outer zones and production wells located within one or both zones to produce hydrocarbon fluid. In the smaller inner zone, heaters are arranged at a relatively high spatial density while in the larger surrounding outer zone, the heater spatial density is significantly lower, which causes a rate of temperature increase in the smaller inner zone of the subsurface to exceed that of the larger outer zone, and the rate of hydrocarbon fluid production ramps up faster in the inner zone than in the outer zone.

The phrases "at least one," "one or more," and "and/or," as used herein, are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" means A alone, B alone, C alone, A and B together, A and C together, B and C together, or A, B, and C together.

Unless otherwise indicated, all numbers expressing quantities, dimensions, conditions, and so forth used in the specification and claims are to be understood as being modified in all instances by the term "about."

The term "a" or "an" entity, as used herein, refers to one or more of that entity. As such, the terms "a" (or "an"), "one or more," and "at least one" can be used interchangeably herein.

The use of "including," "comprising," or "having," and variations thereof, herein is meant to encompass the items listed thereafter and equivalents thereof as well as additional items. Accordingly, the terms "including," "comprising," or "having," and variations thereof, can be used interchangeably herein.

It shall be understood that the term "means" as used herein shall be given its broadest possible interpretation in accordance with Section 112(f) of Title 35 of the United States Code. Accordingly, a claim incorporating the term "means" shall cover all structures, materials, or acts set forth herein, and all of the equivalents thereof. Further, the structures, materials, or acts and the equivalents thereof shall include all those described in the summary of the invention, brief description of the drawings, detailed description, abstract, and claims themselves.

In one particular embodiment, the present inventive embodiment is directed to a valve assembly for controlling operating modes of a drill, comprising a housing having a bore, a first end, a first hole, a second hole and a first body groove interconnected to the first hole, wherein the first body groove corresponds to a first operating mode. A second body groove is interconnected to the second hole such that the second body groove corresponds to a second operating mode. A spool having an axial bore with first and second ends, is movable between first and second positions, wherein the first end of the spool receives an operating fluid and the first position corresponds to a first pressure of the operating fluid, and a second position corresponds to a second pressure of the operating fluid. A spring is biased against the second end of the spool and the first end of the housing.

In other embodiments, a drilling system comprises a system that has at least two operating modes, with a first mode selected from a group of straight drilling, radius bore drilling, side panel cutting and propulsion drilling. The system further includes a spool that has an axial bore, such spool movable between first and second positions, such that the spool receives an operating fluid having first and second pressures. In preferred embodiments, the drilling system includes at least one of a laser, a mechanical drill bit and a fluid jet, and still more preferred embodiments employing a laser distributor swivel. Other embodiments of the present invention are directed to a method for enhancing the simulated reservoir volume of an oil and/or gas reservoir, with such method steps comprising drilling a vertical well bore into a reservoir; drilling one or more horizontal bore holes branching from the vertical well bore; remotely switching drilling modes without withdrawing a drill string from underground and cutting panels, pancakes and/or spirals into the reservoir.

These and other advantages will be apparent from the disclosure of the invention contained herein. The above-described embodiments, objectives, and configurations are neither complete nor exhaustive. The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description and no limitation as to the scope of the present invention is intended by either the inclusion or non-inclusion of elements, components, etc. in this Summary of the Invention. Additional aspects of the present invention will become more readily apparent from the Detailed Description, particularly when taken together with the drawings.

BRIEF DESCRIPTION OF THE DRAWINGS

Those of skill in the art will recognize that the following description is merely illustrative of the principles of the invention, which may be applied in various ways to provide many different alternative embodiments. This description is made for illustrating the general principles of the teachings of this invention and is not meant to limit the inventive concepts disclosed herein.

The accompanying drawings, which are incorporated in and constitute a part of the specification, illustrate embodiments of the invention and together with the general description of the invention given above and the detailed description of the drawings given below, serve to explain the principles of the invention.

FIG. 18 is a front elevation view of an embodiment of water jets and lasers on a drill.

FIG. 20 is a front elevation view of an embodiment of water jets, lasers, and combination water jet/mechanical tool cutters on a drill.

FIG. 21 is a front elevation view of an embodiment of water jets, lasers, and combination water jet/mechanical tool cutters on a drill.

FIG. 22 is a front elevation view of an embodiment of a water jet and/or laser multi-function drill head having two concentric, rotatable, circular arrangements.

It should be understood that the drawings are not necessarily to scale, and various dimensions may be altered. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Although the following text sets forth a detailed description of numerous different embodiments, it should be understood that the legal scope of the description is defined by the words of the claims as set forth at the end of this disclosure. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

The invention described herein relates to a novel system, device, and methods for drilling straight bores, short radius bores, and panels, with a device for remotely switching between various operating modes by variations in fluid pressure. The novel drilling system provided herein allows the drilling system to change from one operating mode, e.g. a drilling mode, to another operating mode, e.g. a panel cutting mode, without requiring the withdrawal of the drill string from the vertical wellbore. This invention utilizes water jet and/or laser drilling and panel cutting heads to cut narrow openings, e.g. panels, pancakes, and spirals, into the reservoir to permit oil and gas to flow into the drill hole. The drilling part of the water jet and/or laser drill tool is designed to create boreholes projecting out horizontally from a vertical well. The cutting part of the drill tool is also capable of cutting panels extending laterally from the drill hole by utilizing a second set of mounted water jets and/or lasers cutting outward from the produced horizontal hole. These panels increase the area of the reservoir exposed to the borehole and thereby significant enhance stimulated reservoir volume.

Figure 1:
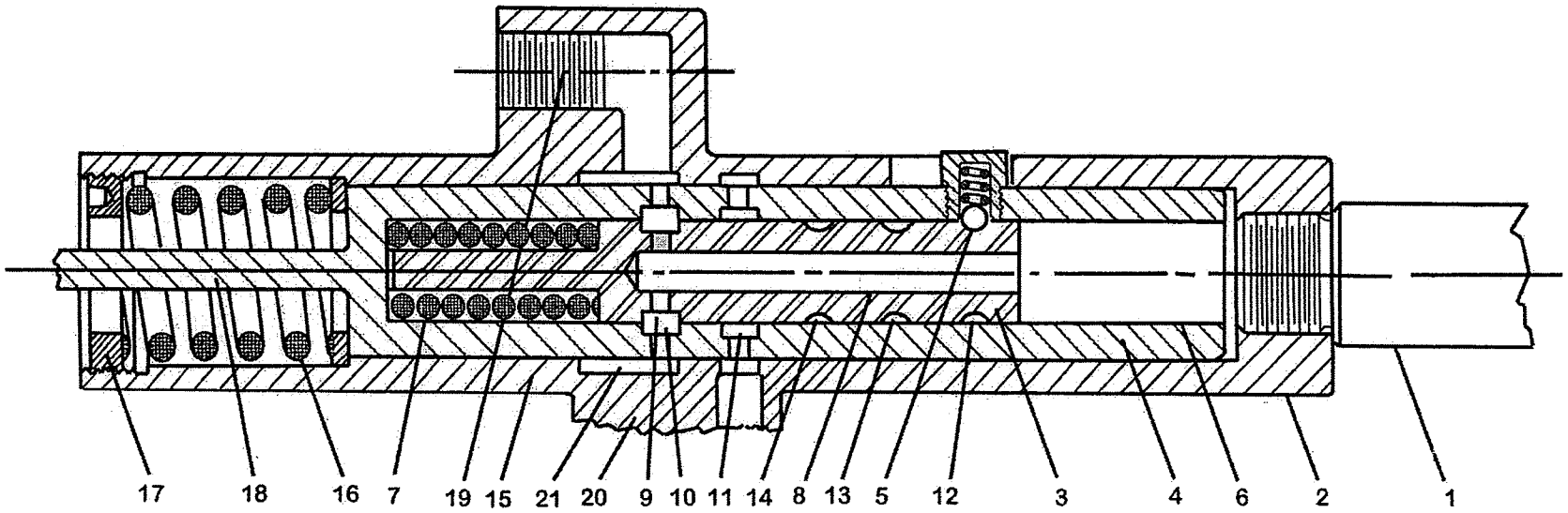
FIG. 1 is an embodiment of a control device for remotely changing between operating modes of a water jet drilling system.

FIG. 1 is an embodiment of a control device for remotely changing between operating modes of a water jet drilling system. The water jet drilling system may comprise a high-pressure hose 1 that leads from aboveground and is connected to a valve assembly 2. In some embodiments, the valve assembly 2 may incorporate a spool 3 that travels to different axial positions within a housing 4 based on the magnitude of the water pressure supplied. The spool 3 may be spring-loaded in some embodiments and may also be cylindrical in one embodiment.

In one embodiment, the water jet drilling system may comprise a spring-loaded detent assembly 5 to maintain the desired spool position and thus a desired mode when small variations of pressure occur. The detent assembly 5 locks the spool 3 in position for each mode of operation as long as the pressure for each mode is within a pressure tolerance compatible with a spool retaining force caused by the detent assembly 5.

The spool 3 may be positioned within a housing bore 6 that allows the spool 3 to move axially against a spring 7 positioned between the spool 3 and the housing 4. The spool 3 may have a center bore 8 that terminates at a radial groove 9. The radial groove 9 may be aligned with internal grooves 10, 11 in the housing 4. In some embodiments, the spool 3 may be positioned proximate to the internal grooves 10, 11 when biased against the spring 7 due to the different fluid pressures for the different modes of operation. The spool 3 may comprise notches 12, 13 that correspond axially with locations of the internal grooves 10, 11. The internal grooves 10, 11 may be in fluid communication with fluid passages. Different fluid passages may be used for each different mode of operation. Thus, the fluid passages may allow the pressurized fluid to pass through one or more sets of water jets when operating under different modes of operation. In some embodiments, a notch 12, 13, 14 may be provided to retain the spool 3 axially when there is little or no water pressure.

The housing 4 may be mounted within a secondary housing 15. The secondary housing may be axially fixed in position by a preloaded spring cartridge 16. In some embodiments, the cartridge 16 remains a fixed length until the preload is exceeded. The system may comprise a threaded ring 17 to allow for the adjustment of the cartridge 16 so that the cartridge 16 will remain at a fixed length until a certain fluid pressure is reached. When the fluid pressure exerts a force on the housing 4 exceeding the adjusted preload of the cartridge 16, the housing 4 advances within the secondary housing 15 causing the angular articulation of a drilling head. The movement of the housing 4, which may be movement in an axial direction in some embodiments, and a protruding member 18 cause a bore to be cut at a specific radius. For example, a curved bore may be cut linking a vertical bore to a horizontal bore to which the vertical bore was not previously interconnected. Thus, the linking allows for the joining together of discrete vertical wellbores into a single contiguous system of bores.

In some embodiments, fluid outlets 19, 20 may be provided in the valve assembly 2 for the two modes depicted in FIG. 1. One fluid outlet 19 may be for a highest-pressure mode. In the example shown in FIG. 1, fluid outlet 19 is configured to allow for straight drilling when the radial groove 9 of the spool 3 is aligned with both the internal groove 10 and an internal groove 21. Another fluid outlet 20 may be for a lower fluid pressure mode. In the example shown in FIG. 1, fluid outlet 20 is configured to allow for a panel cutting mode.

Figure 2:
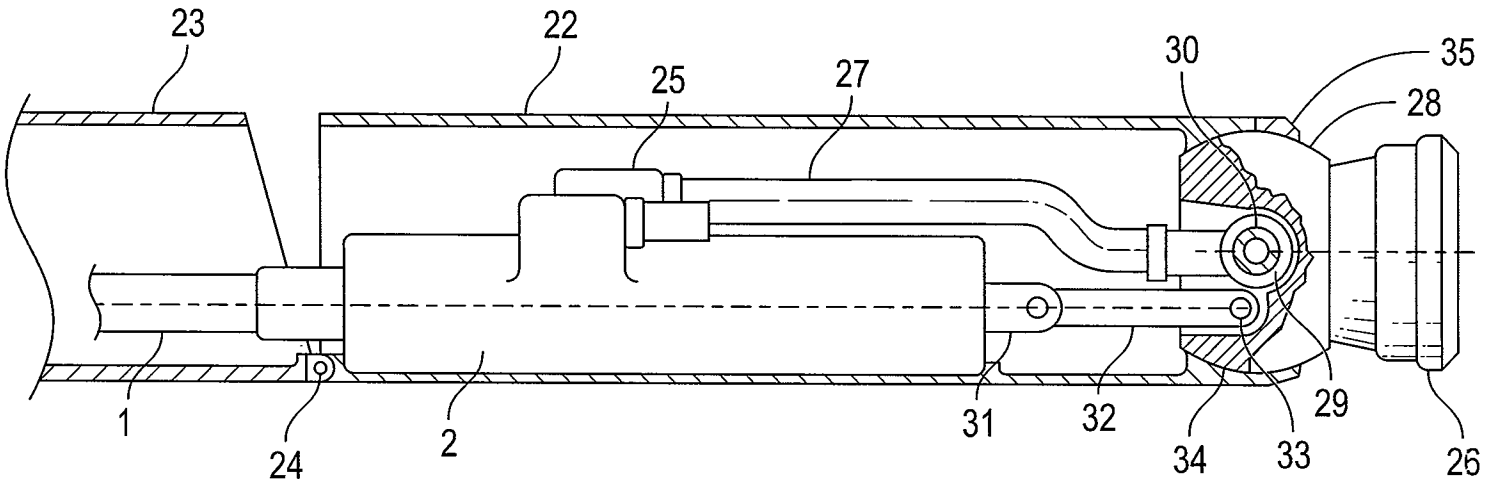
FIG. 2 is a cross-sectional view of an embodiment of a drill head assembly and a following link in a straight drilling mode.

Referring now to FIG. 2, a cross-sectional view of an embodiment of a drill head assembly and a following link in a straight drilling mode is provided. The drill head assembly may comprise a high-pressure hose 1, a valve assembly 2, a following link 23, a hinge pin 24, an exit port 25, a water jet assembly 26, a tube 27, a swivel head 28, a swivel fitting 29, a hollow shaft 30, an actuating rod 31, a link 32, a pin 33, a spherical surface 34, and a spherical clamp 35. The valve assembly 2 may be positioned within the drill head housing 22. The drill head housing may be interconnected to the following link 23. The following link 23 may be hinged to the drill head housing 22 and secured by a hinge pin 24. Additional following links 23 may be utilized, necessitated by the condition of the strata to be encountered.

In some embodiments, pressurized fluid is supplied through a high-pressure hose 1 from an aboveground pump system to the valve assembly 2. The fluid pressure may be controlled and changed to the specific pressures needed to operate the drilling system in the desired mode. An exit port 25 supplies pressurized fluid to a water jet assembly 26 via a tube 27. The water jet assembly 26 may comprise a swivel head 28 on one end. The swivel head 28 may be interconnected to the tube 27 by a swivel fitting 29, which is fitted to a hollow shaft 30 with ports. The shaft 30 may be mounted stationarily relative to the swivel head 28 to allow the swivel head 28 to be rotated for a radius bore mode.

The water jet assembly 26 contains fluid jet orifices and a rotary swivel to facilitate fluid jet cutting. An actuating rod 31 extends axially from the valve assembly 2 and is joined by a link 32 to a pin 33 in the swivel head 28, providing slight articulation of the link 32 to the actuating rod 31 due to the arc effect when the swivel head 28 is rotated to the angular position for cutting a radius bore.

The swivel head 28 has a spherical interface with a spherical surface 34 at the front of the drill head housing 22. A spherical clamp 35 retains the swivel head 28 in position at the front of the drill head housing 22. The configuration shown in FIG. 2 may be used to produce straight radial bores outward from a vertical shaft, among other straight drilling applications.

Figure 3:
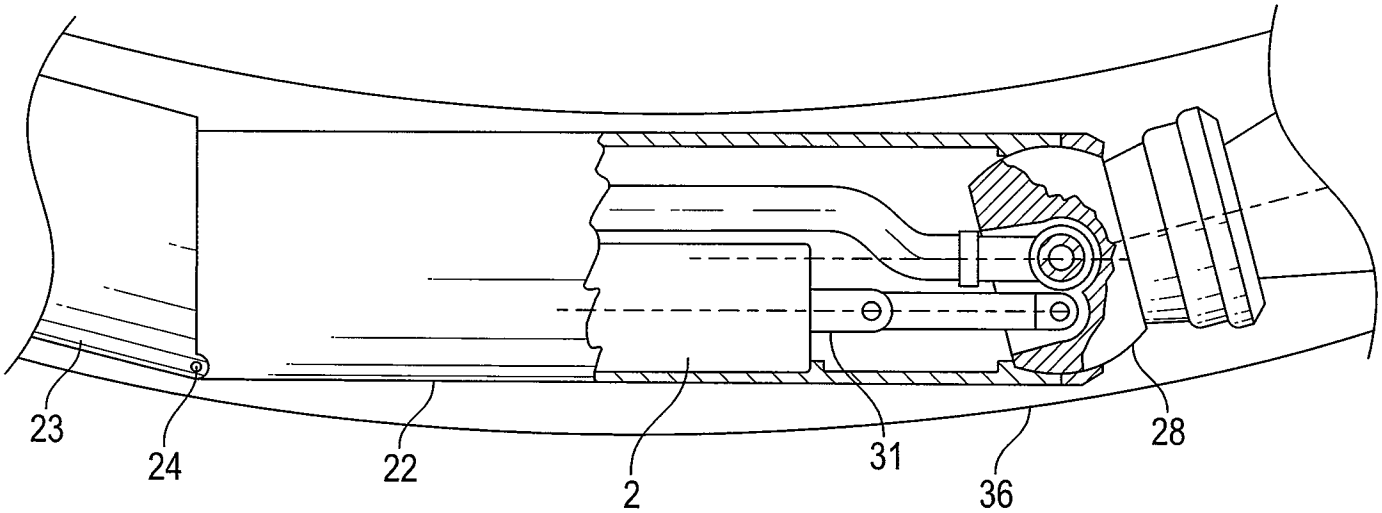
FIG. 3 is a cross-sectional view of an embodiment of a drill head assembly and a following link in a radius bore drilling mode.

Referring now to FIG. 3, the swivel head 28 is rotated to the radius bore drilling mode position by increasing the fluid pressure to the valve assembly 2 to the highest operating level. The valve actuating rod 31 is in an extended position due to the fluid pressure on the spool 3 exceeding the preload value of the preloaded spring cartridge 16, causing the swivel head 28 to rotate to the angle shown to produce the required bore radius.

The following link 23 is articulated about the hinge pin 24, closing the clearance angle between the drill head housing 22 and the following link 23 to clear a newly cut radius bore 36. The configuration shown in FIG. 3 may be used to produce curved radius bores.

Figure 5:
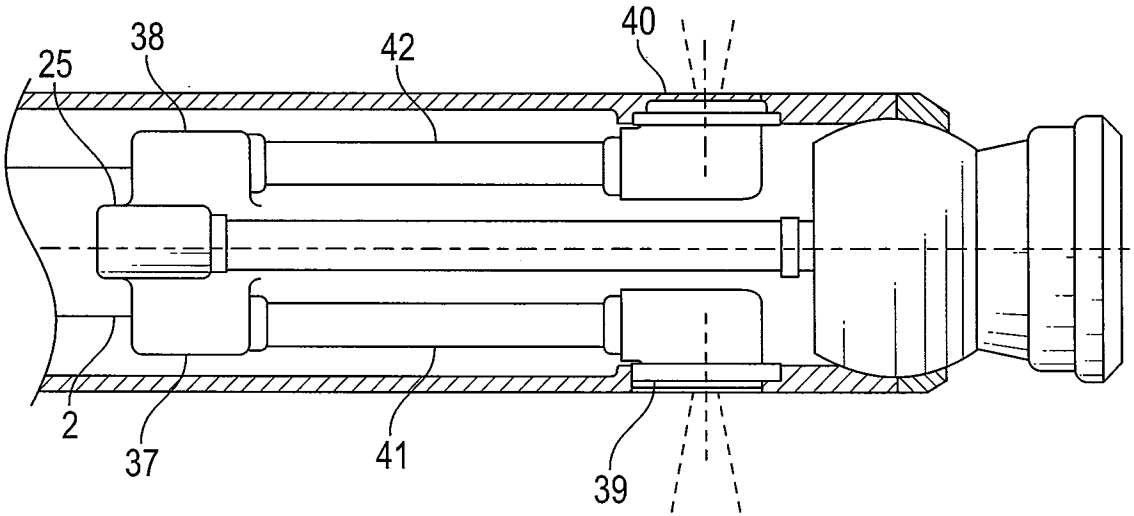
FIG. 5 is a partially sectioned top view of an embodiment of a drill head assembly with side panel cutting jets.
Figure 4:
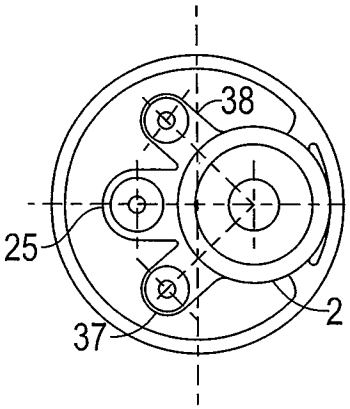
FIG. 4 is a front elevation view of an embodiment of a mode valve with exit ports.

Referring now to FIGS. 4 and 5, the valve assembly 2 includes water jet exit ports 37, 38 positioned adjacently to the exit port 25. When fluid pressure is controlled to the pressure values needed to keep the drilling system operating in a panel cutting mode, the valve assembly redirects fluid away from the exit port 25 into the water jet exit ports 37, 38. Side panel cutting water jets 39, 40 are connected by connecting fluid pipes 41, 42 to the water jet exit ports 37, 38. When the drilling system is placed in the panel cutting mode, fluid directed toward the water jet exit ports 37, 38 by the valve assembly 2 flows through the connecting fluid pipes 41, 42 and outwardly from side panel cutting water jets 39, 40 into the surrounding reservoir. The side panel cutting water jets 39, 40 may be used to cut, by way of example only, panels, pancakes, and/or spirals into the reservoir, depending on the movement and rotation of the drill head housing 22 during cutting.

Figure 6:
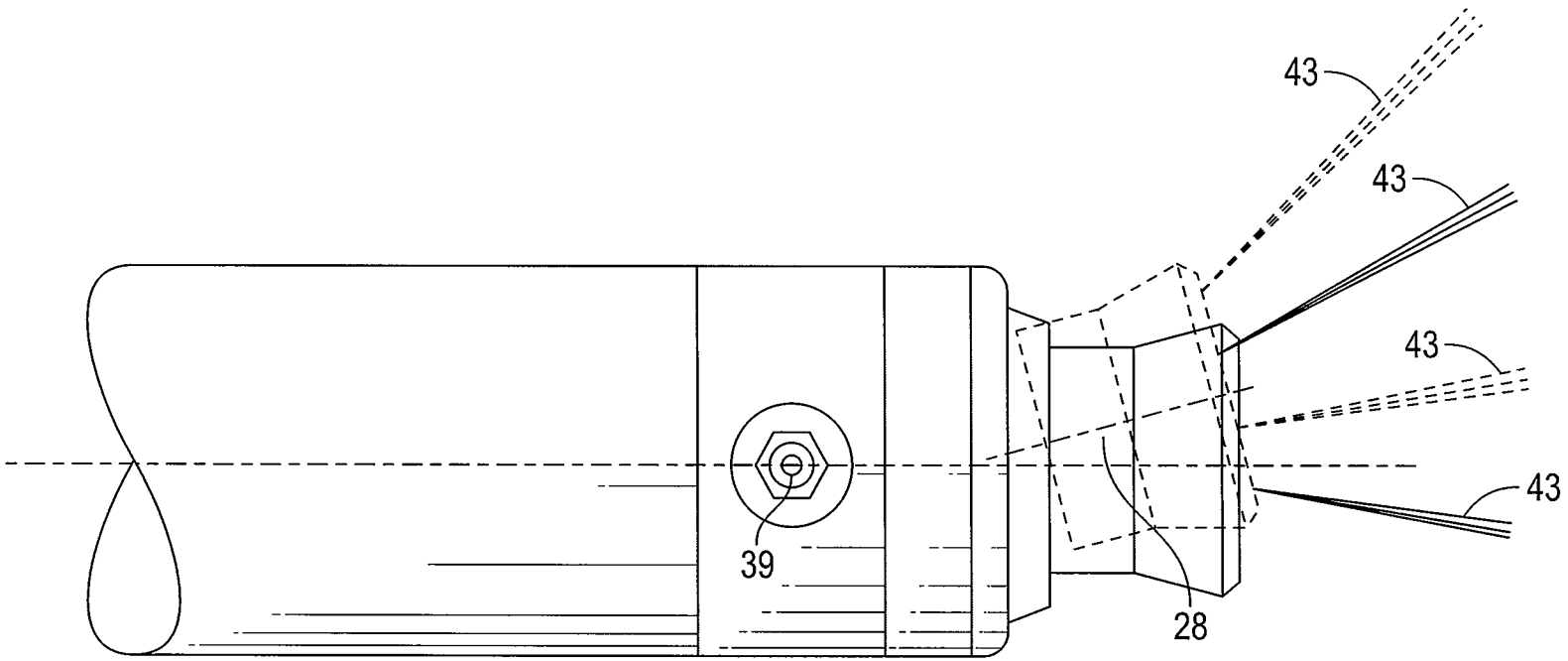
FIG. 6 is a side view of an embodiment of a multi-function drill head with a device for cutting straight bores, radius bores, and side panels.

Referring now to FIG. 6, fluid may be seen flowing out of the water jet cutters 43 of the swivel head 28. The swivel head 28 may be either oriented for straight drilling, or rotated for radius bore drilling. A side panel cutting water jet 39 may also be seen.

Figure 7:
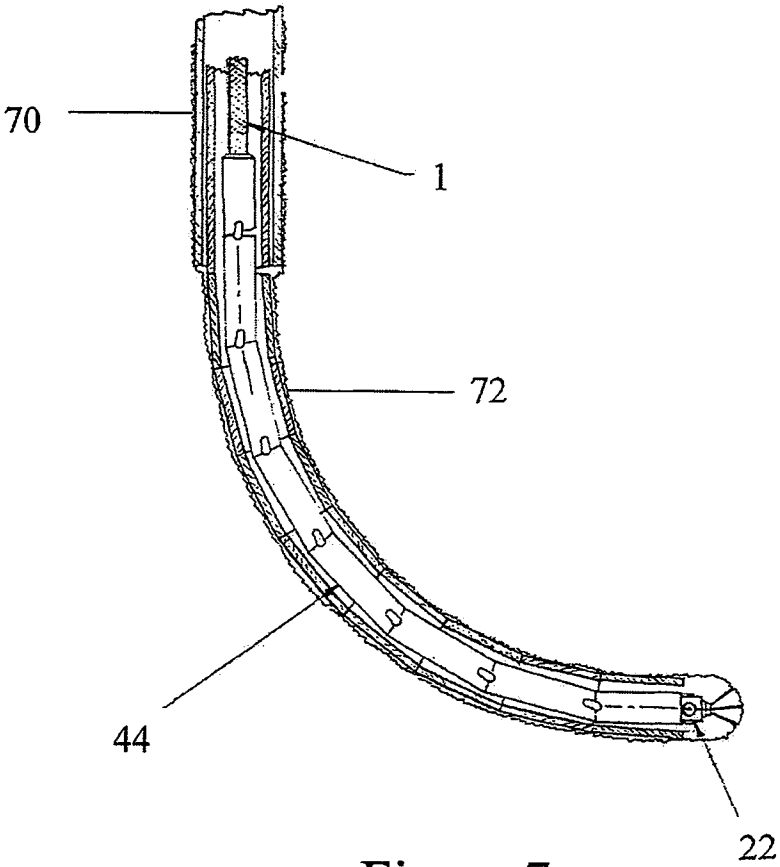
FIG. 7 illustrates an embodiment of an ultra-short radius bore drilling system.

Referring now to FIG. 7, the high-pressure hose 1 is protected by one or more linked jackets 44, a casing 72, and an outer well casing 70. The casing 72 also protects the radius cut from encroachment or wear. Different numbers of jackets 44 (one or more) and different jacket lengths may be used depending on the application and/or the condition of the strata to be encountered. The linked jackets 44 may rotate, tilt, or move with respect to one another. Thus, the linked jackets 44 may be angularly articulable with respect to one other to allow for radius bore drilling. The linked jackets 44 surround the high-pressure hose 1 when the hose 1 is underground to protect the hose from rocks, mud, water, oil, gas, and other natural or unnatural elements. Thus, only the drill head housing 22 is exposed to the natural or unnatural elements found underground.

Figure 8:
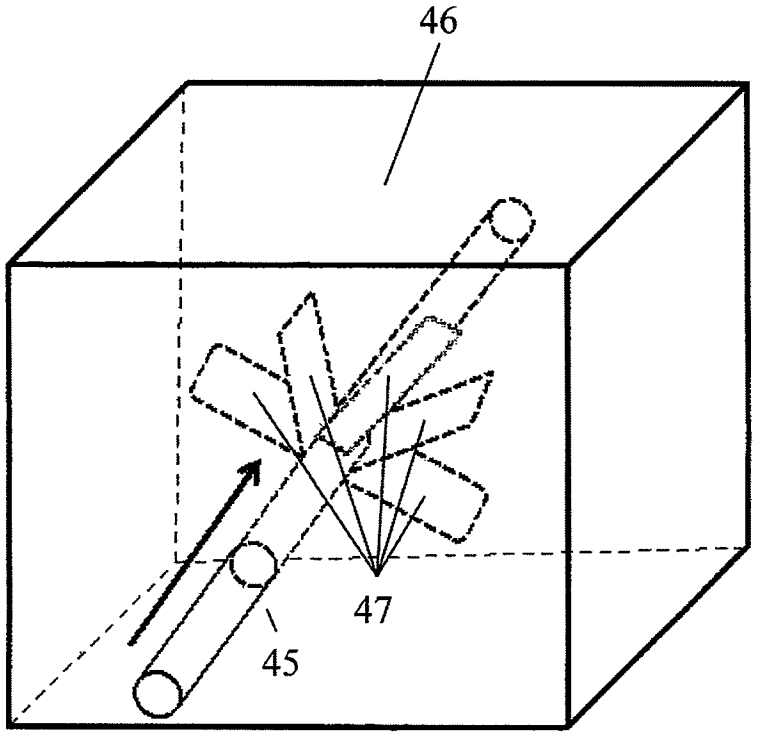
FIG. 8 is a perspective view of an embodiment of a borehole with panels.

Referring now to FIG. 8, a horizontally extending borehole 45 has been cut into an oil and gas reservoir 46 with the present invention. Extending from the borehole are multiple panels 47 to enhance the effective permeability of the oil and gas reservoir 46.

Figures 9A, 9B:
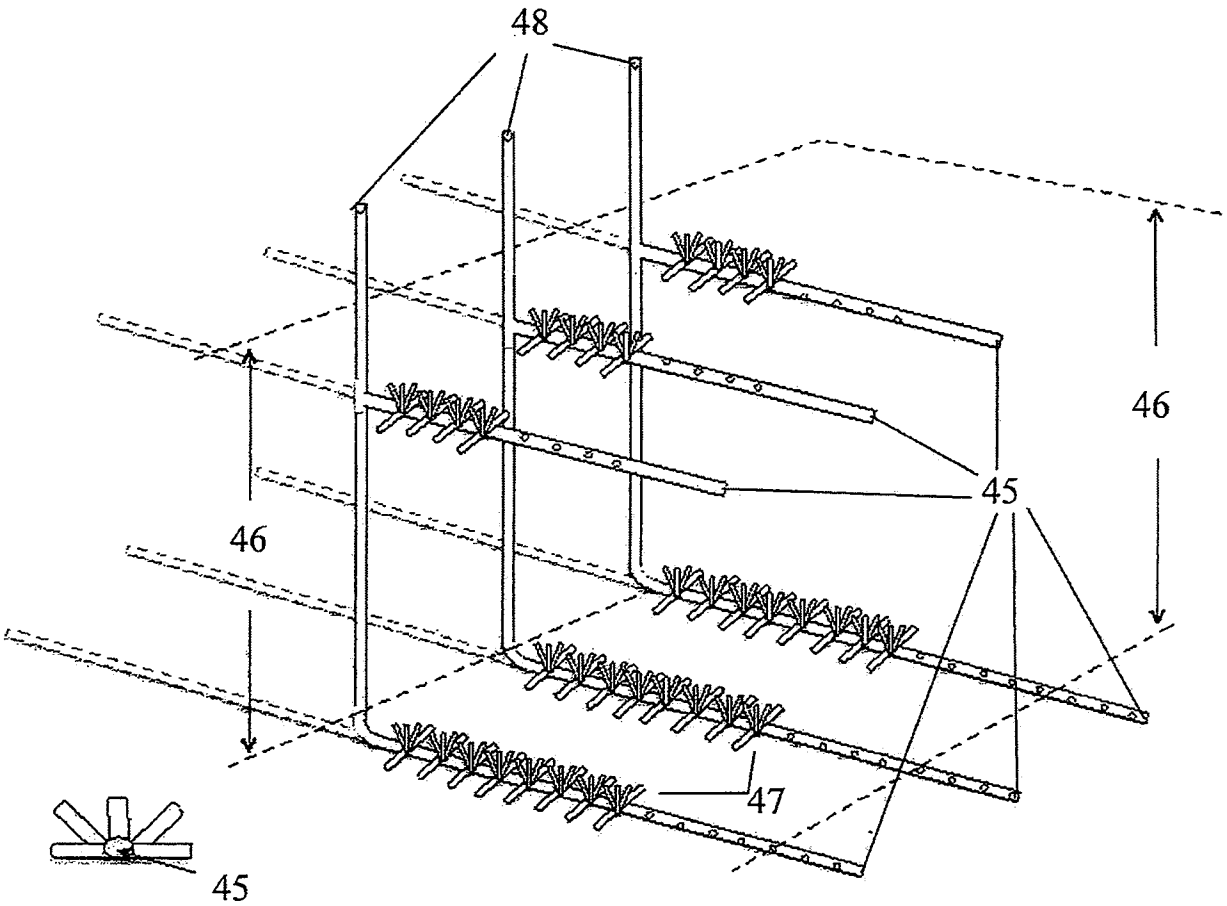
FIG. 9A is a perspective view of an embodiment of an oil and gas reservoir with multiple boreholes and panels.
FIG. 9B is front sectional view of an embodiment of a borehole with panels.

FIG. 9A shows a perspective view of an oil and gas reservoir 46 with boreholes 45 and panels 47. In this embodiment, multiple horizontally extending boreholes 45 have been cut into the oil and gas reservoir 46 using one embodiment of the drill system of the present invention. The boreholes extend horizontally from vertical wellbores 48. Extending from each horizontally extending borehole 45 are multiple panels 47 to enhance the effective permeability of the oil and gas reservoir 46. The figure shows how effective permeability may be enhanced at multiple locations and along multiple spatial dimensions throughout the oil and gas reservoir 46. FIG. 9B shows a side view of a borehole 45 with multiple panels 47.

Figure 10:
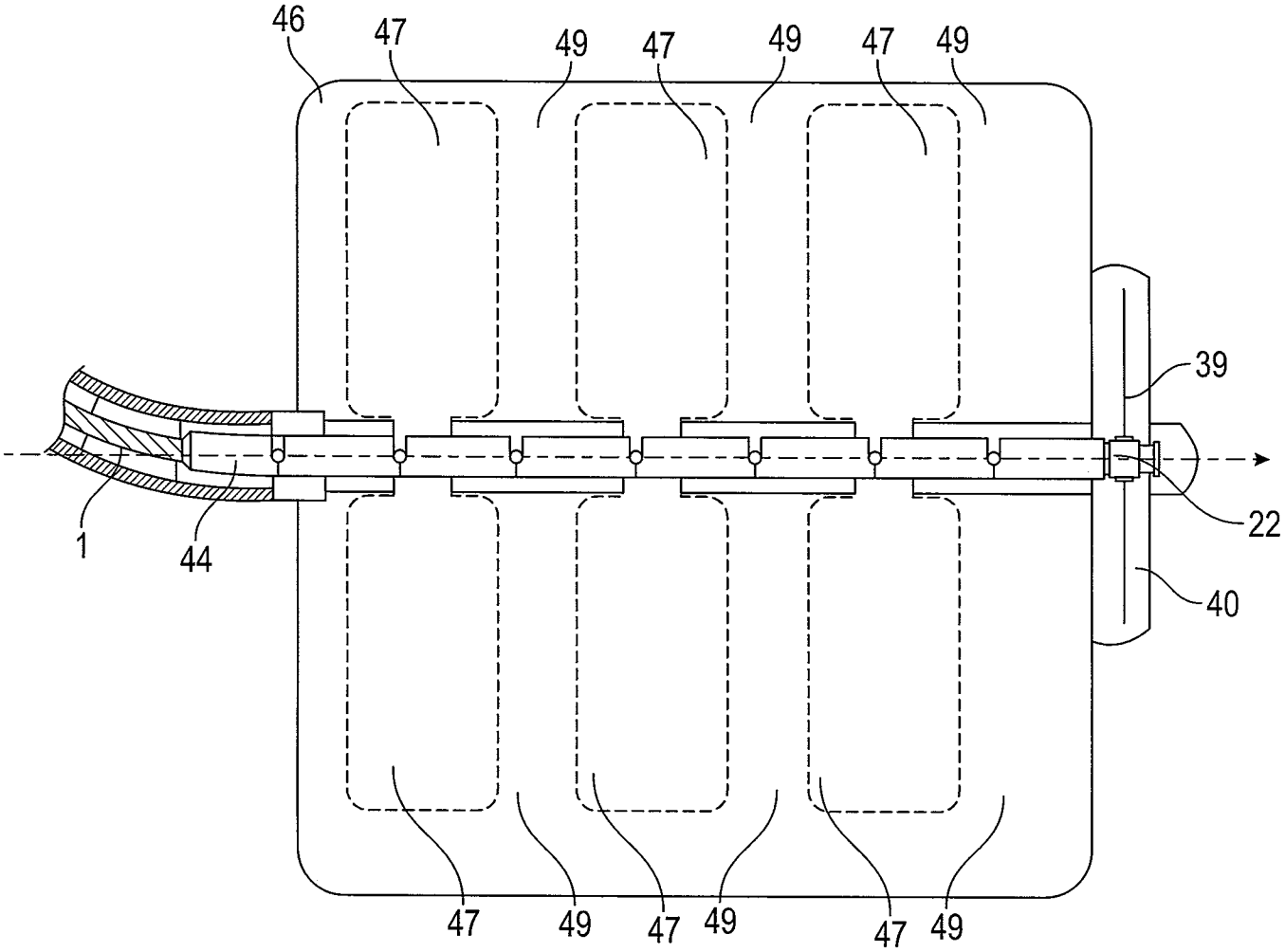
FIG. 10 is a side view of an oil and gas reservoir with an embodiment of side panels extending from a borehole.

Referring now to FIG. 10, multiple panels 47 cut into the oil and gas reservoir 46 may be seen extending from the single horizontally extending borehole 45. In this example the panels 47 are separated by pillars 48 of undisturbed rock forming part of the oil and gas reservoir 46. The panels 47 have been cut by the drilling system of the present invention, embodied here by the drill head housing 22 and the high-pressure hose 1 protected by the linked jackets 44. In this image the system is being used to cut two additional panels 47, using side panel cutting water jets 39, 40.

Figure 11A:
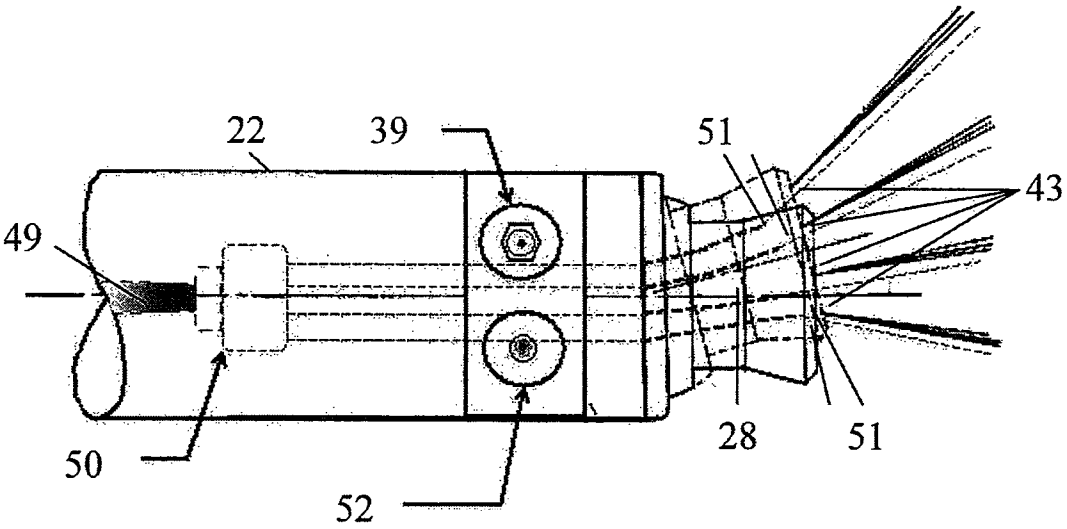
FIG. 11A is a side view of an embodiment of a multi-function drill head with water jets and lasers.

Referring now to FIG. 11A, fluid may be seen flowing out of the water jet cutters 43 of the swivel head 28. The swivel head 28 may be either oriented for straight drilling, or rotated about fifteen degrees for radius bore drilling. A side panel cutting water jet 39 may also be seen. In this embodiment, an incoming laser beam 49 is distributed, by a laser distributor swivel 50 inside the drill head housing 22, to laser cutters 51 located on the swivel head 28 and/or to a side panel cutting laser 52. Because the laser cutters 51 are located on the swivel head 28, they may be used for either straight drilling or radius bore drilling, depending on the orientation of the swivel head 28, in the same way as the water jet cutters 43.

Figure 11B:
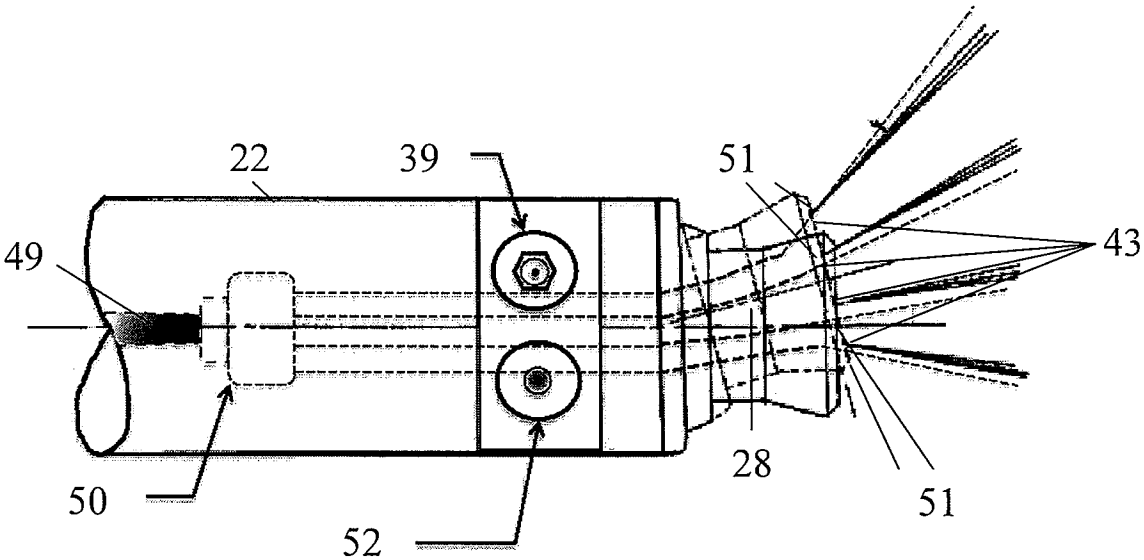
FIG. 11B is a side view of an embodiment of a multi-function drill head with water jets and lasers.

Referring now to FIG. 11B, fluid may be seen flowing out of the water jet cutters 43 of the swivel head 28. The swivel head 28 may be either oriented for straight drilling, or rotated about fifteen degrees for radius bore drilling. A side panel cutting water jet 39 may also be seen. In this embodiment, an incoming laser beam 49 is distributed, by a laser distributor swivel 50 inside the drill head housing 22, to laser cutters 51 located on the swivel head 28 and/or to a side panel cutting laser 52. Because the laser cutters 51 are located on the swivel head 28, they may be used for either straight drilling or radius bore drilling, depending on the orientation of the swivel head 28, in the same way as the water jet cutters 43.

Figure 13:
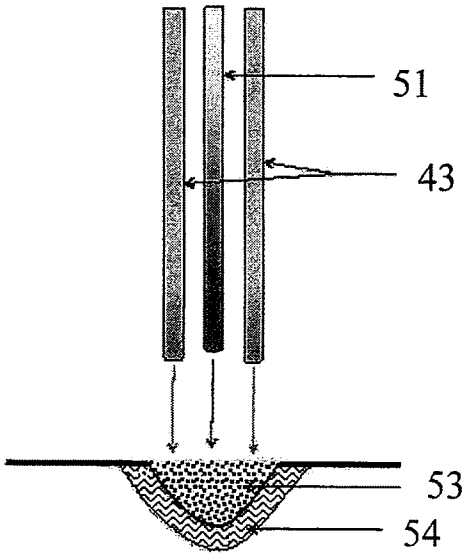
FIG. 13 is a side sectional view of water jets and lasers on a drill of an embodiment of the present invention.
Figure 12:
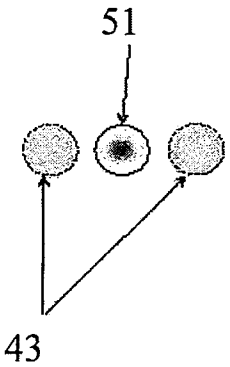
FIG. 12 is a front elevation view of an embodiment of water jets and lasers on a drill.

Referring now to FIGS. 12 and 13, one possible arrangement of cutting implements on the swivel head is shown. In particular, this embodiment comprises a single laser cutter 51 and two water jet cutters 43. A central portion 53 of the bore is excavated by spalling, while a peripheral portion 54 of the bore is excavated by cracking.

Figure 15:
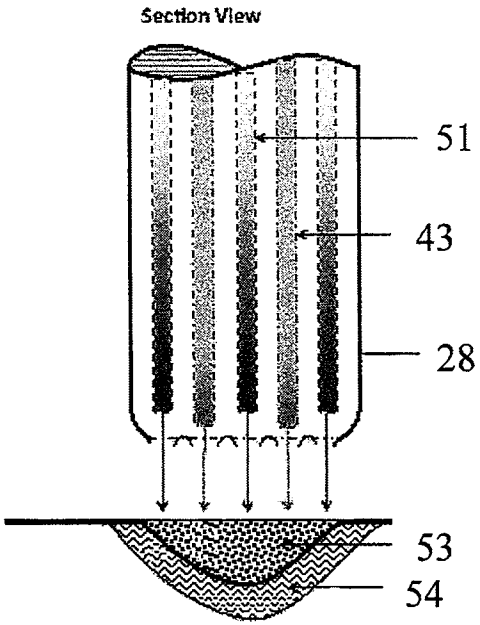
FIG. 15 is a side sectional view of water jets and lasers on a drill of an embodiment of the present invention.
Figure 14:
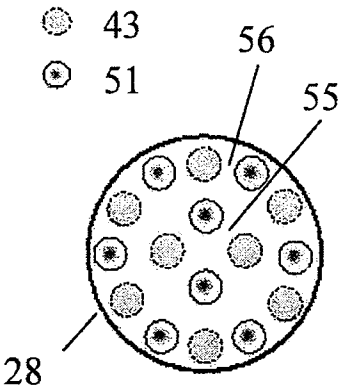
FIG. 14 is a front elevation view of an embodiment of water jets and lasers on a drill.

Referring now to FIGS. 14 and 15, one possible arrangement of cutting implements on the swivel head 28 is shown. In particular, this embodiment comprises an inner circular arrangement 55 of two laser cutters 51 and two water jet cutters 43, and an outer circular arrangement 56 of six water jet cutters 43 and six laser cutters 51, arranged alternatingly. A central portion 53 of the bore is excavated by spalling, while a peripheral portion 54 of the bore is excavated by cracking.

Figure 17:
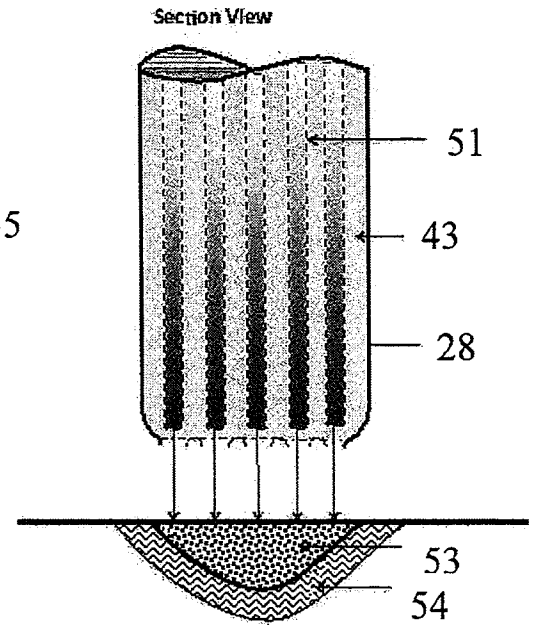
FIG. 17 is a side sectional view of water jets and lasers on a drill of an embodiment of the present invention.
Figure 16:
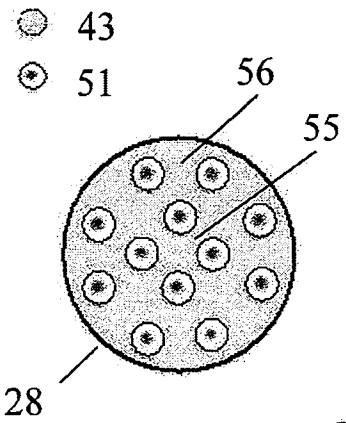
FIG. 16 is a front elevation view of an embodiment of water jets and lasers on a drill.

Referring now to FIGS. 16 and 17, one possible arrangement of cutting implements on the swivel head 28 is shown. In particular, this embodiment comprises an inner circular arrangement 55 of four laser cutters 51 and an outer circular arrangement 56 of eight laser cutters 51, surrounded by a single large water jet cutter 43. A central portion 53 of the bore is excavated by spalling, while a peripheral portion 54 of the bore is excavated by cracking.

Referring now to FIG. 18, one possible arrangement of cutting implements on the swivel head 28 is shown. In particular, this embodiment comprises an inner circular arrangement 55 of four laser cutters 51, a middle circular arrangement 57 of eight water jet cutters 43, and an outer circular arrangement 56 of six water jet cutters 43 and six laser cutters 51, arranged alternatingly. This embodiment may be used, for example, to excavate small drill holes.

Figure 19:
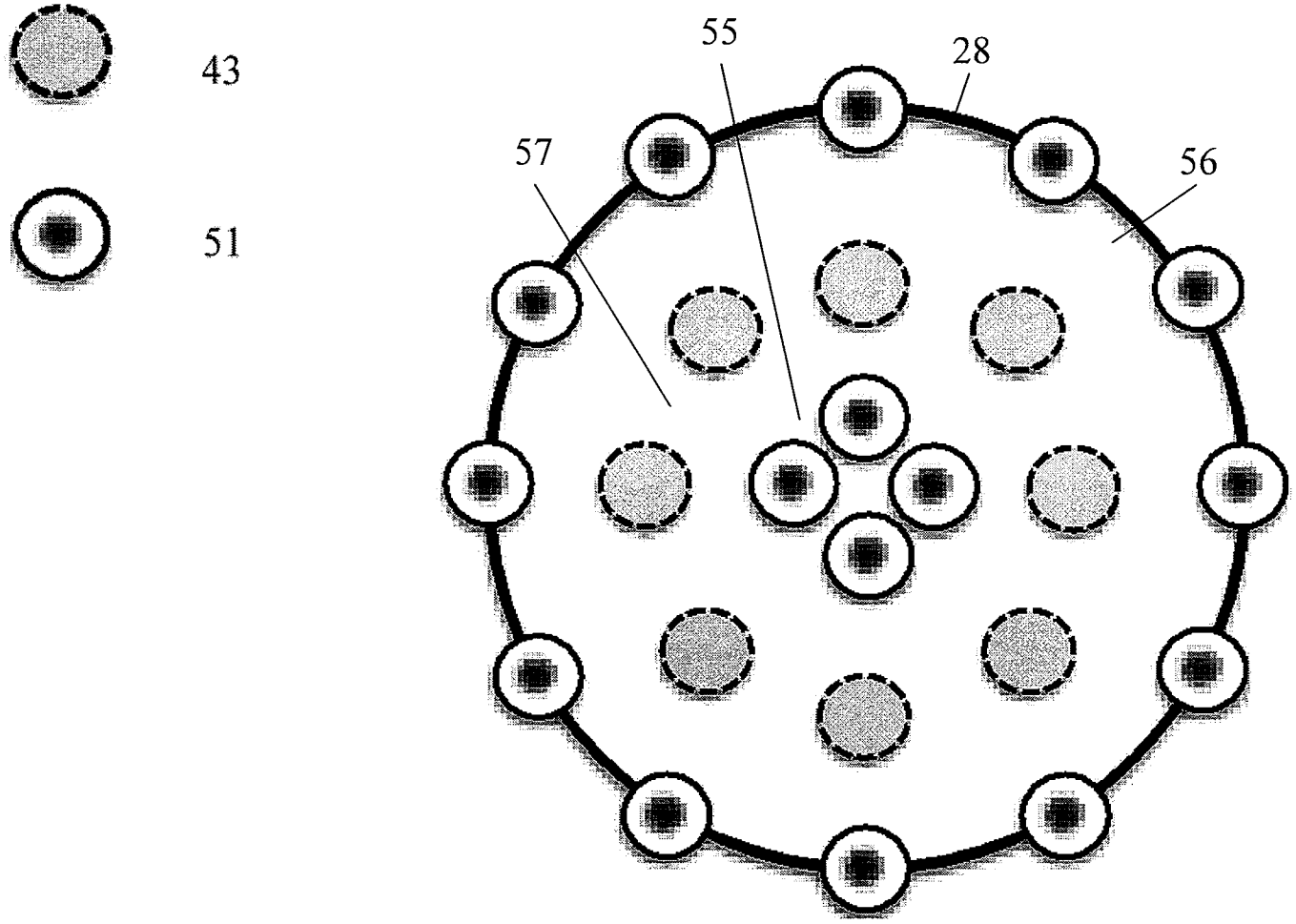
FIG. 19 is a front elevation view of an embodiment of water jets and lasers on a drill.

Referring now to FIG. 19, one possible arrangement of cutting implements on the swivel head 28 is shown. In particular, this embodiment comprises an inner circular arrangement 55 of four laser cutters 51, a middle circular arrangement 57 of eight water jet cutters 43, and an outer circular arrangement 56 of twelve laser cutters 51. This embodiment may be used, for example, to excavate small drill holes.

Referring now to FIG. 20, one possible arrangement of cutting implements on the swivel head 28 is shown. In particular, this embodiment comprises an innermost circular arrangement 58 of four laser cutters 51, an inner circular arrangement 55 of four water jet cutters 43, an outer circular arrangement 56 of eight combination water jet/mechanical tool cutters 59, and an outermost circular arrangement 60 of six water jet cutters 43 and six laser cutters 51, arranged alternatingly. This embodiment may be used, for example, to excavate an all-geological or alternating geological formation.

Referring now to FIG. 21, one possible arrangement of cutting implements on the swivel head 28 is shown. In particular, this embodiment comprises an innermost circular arrangement 58 of four laser cutters 51, an inner circular arrangement 55 of eight water jet cutters 43, a middle circular arrangement 57 of eight combination water jet/mechanical tool cutters 59, an outer circular arrangement 56 of eight combination water jet/mechanical tool cutters 59, and an outermost circular arrangement 60 of eight laser cutters 51 and eight water jet cutters 43, arranged alternatingly. This embodiment may be used, for example, to excavate a large opening, or for tunnel and rise drilling.

Referring now to FIG. 22, an embodiment of the swivel head 28 is shown. In particular, this embodiment comprises an inner circular arrangement 55 of two laser cutters 51 and two water jet cutters 43 arranged alternatingly, and an outer circular arrangement 56 of six water jet cutters 43 and six laser cutters 51, arranged alternatingly. The inner circular arrangement 55 and the outer circular arrangement 56 are each independently rotatable. In this case, the inner circular arrangement 55 rotates counterclockwise, and the outer circular arrangement 56 rotates clockwise.

Figure 23:
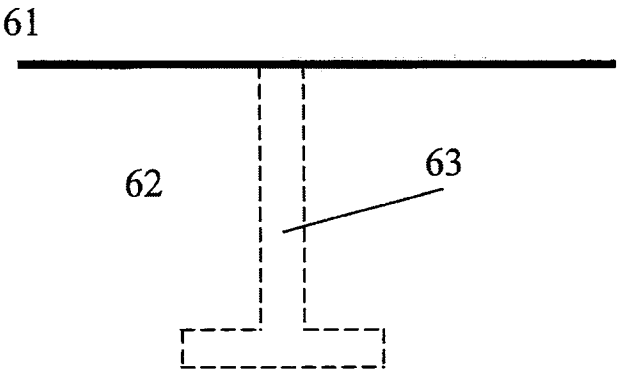
FIG. 23 shows one application of an embodiment of a drilling system of the present invention.

Referring now to FIG. 23, a land surface 61 and strata 62 underlying the land surface 61 are shown. The drilling system of the present invention is used to cut a T-shaped structural space 63 into the strata 62. The T-shaped structural space 63 may, for example, receive concrete, thus forming part of the foundation of a building.

Figure 24A:
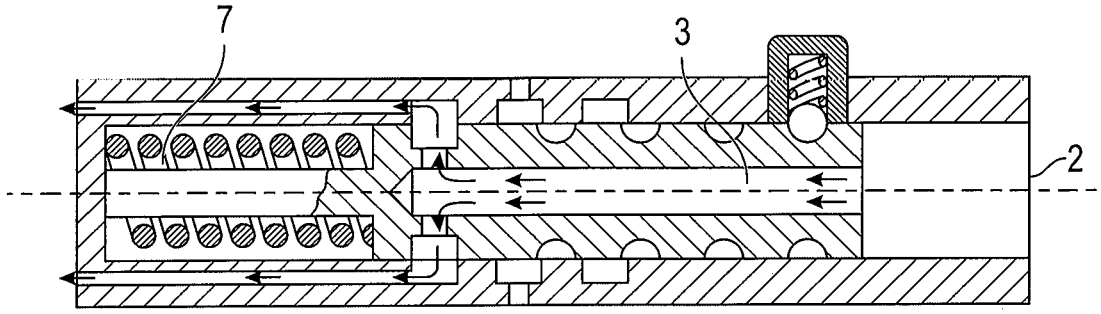
FIGS. 24A, 24B, 24C, and 24D are cross-sectional views of an embodiment of a valve placed different operating modes.
Figure 24B:
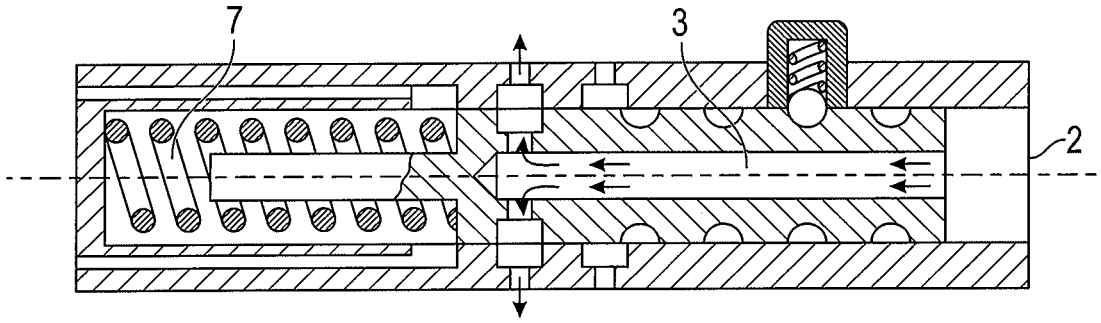
Figure 24C:
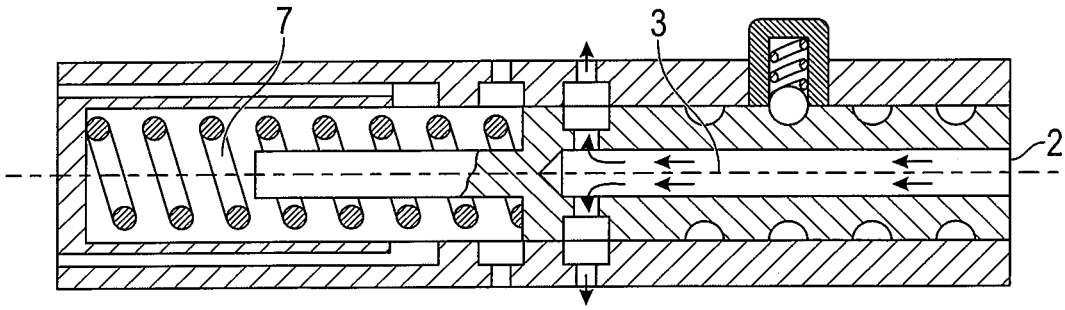
Figure 24D:
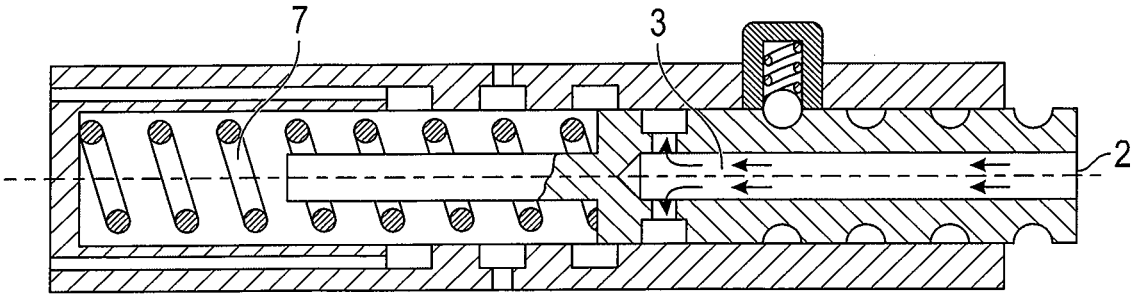

Referring now to FIGS. 24A through 24D, FIG. 24A shows the valve assembly 2 in a very high-pressure mode. The spool 3 compresses the spring 7 to the maximum extent. This position may correspond to, among others, a radius bore drilling mode or a straight drilling mode. FIG. 24B shows the valve assembly 2 in a high-pressure mode. The spool 3 compresses the spring 7 to a substantial extent. This position may correspond to, among others, a straight drilling mode or a side panel cutting mode. FIG. 24C shows the valve assembly 2 in a low-pressure mode. The spool 3 compresses the spring 7 to a slight extent. This position may correspond to, among others, a side panel cutting mode or a propulsion mode. FIG. 24D shows the valve assembly 2 in a very low-pressure mode. The spool 3 compresses the spring 7 to a minimal extent, or not at all. This position may correspond to, among others, an off mode.

Figure 25:
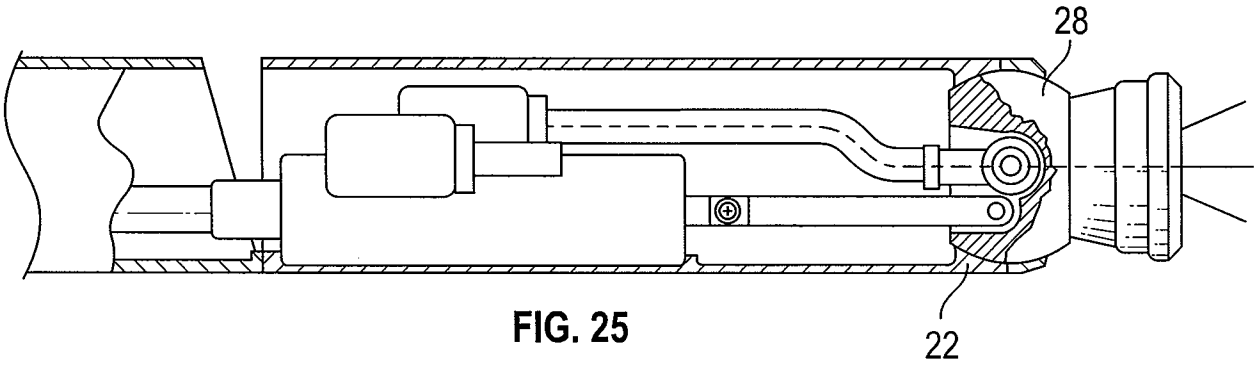
FIG. 25 is a cross-sectional view of an embodiment of a drill head in a straight drilling mode.
Figure 26:
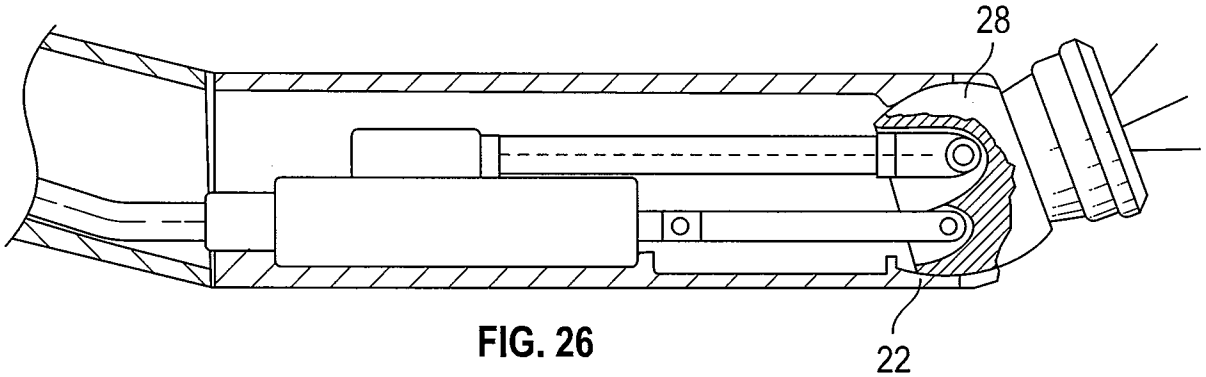
FIG. 26 is a cross-sectional view of an embodiment of a drill head in a radius bore drilling mode.

Referring now to FIGS. 25 and 26, FIG. 25 shows the drill head when the system is placed in a straight drilling mode. The swivel head 28 is oriented in the same direction as the longitudinal axis of the drill head housing 22. FIG. 26 shows the drill head when the system is placed in a radius bore drilling mode. The swivel head 28 is oriented at an angle relative to the longitudinal axis of the drill head housing 22.

Figures 27, 28:
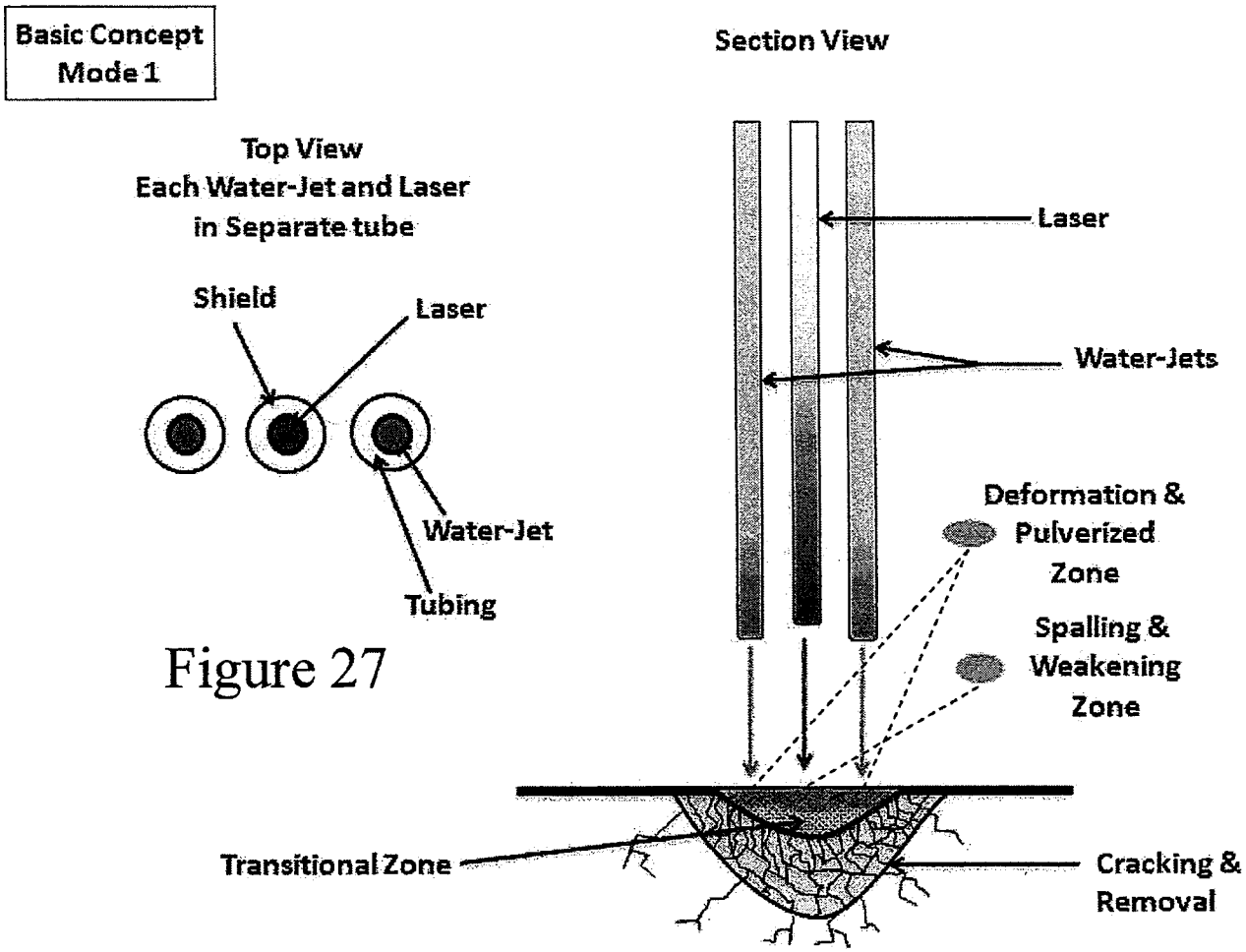
FIG. 27 is a front elevation view of an embodiment of water jets and lasers on a drill.
FIG. 28 is a side sectional view of water jets and lasers on a drill of an embodiment of the present invention.

FIGS. 27 and 28 show one embodiment of cutting implements on the swivel 28. In particular, this embodiment of the swivel head 28 comprises a single laser cutter 51 and two water jet cutters 43. A central portion 53 of the bore is excavated by spalling and weakening (using the laser) and deformation and pulverization (using the water jets), while a peripheral portion 54 of the bore is excavated by cracking and removal.

Figure 29:
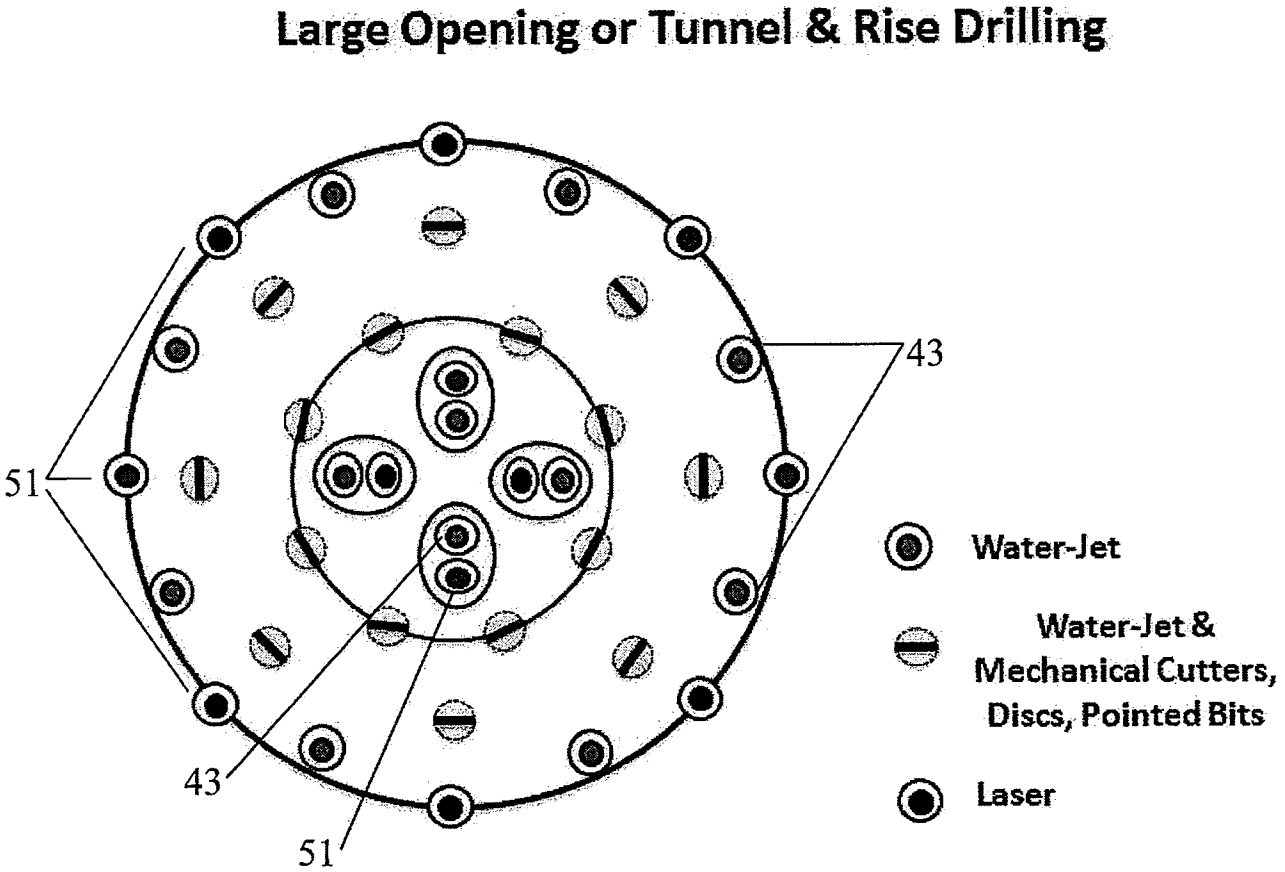
FIG. 29 is a front elevation view of an embodiment of water jets, lasers, and combination water jet/mechanical tool cutters on a drill.

Referring now to FIG. 29, one embodiment of cutting implements on the swivel head 28 is shown. In particular, this embodiment of the swivel head 28 comprises an innermost circular arrangement 58 of four laser cutters 51 and four water jet cutters 43, arranged in four pairs of a water jet cutter 43 and a laser cutter 51, spaced at about 90-degree intervals; an inner circular arrangement 55 of eight combination water jet/mechanical tool cutters 59; an outer circular arrangement 56 of eight combination water jet/mechanical tool cutters 59, and an outermost circular arrangement 60 of eight laser cutters 51. This embodiment may be used, for example, to excavate a large opening, or for tunnel and rise drilling.

Figure 30:
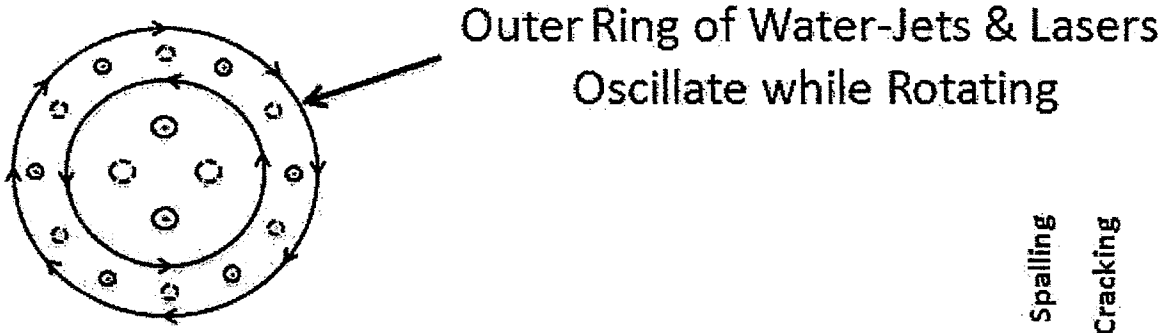
FIG. 30 is a front elevation view of an embodiment of a water jet and/or laser multi-function drill head having two concentric, rotatable, circular arrangements.
Figure 31:
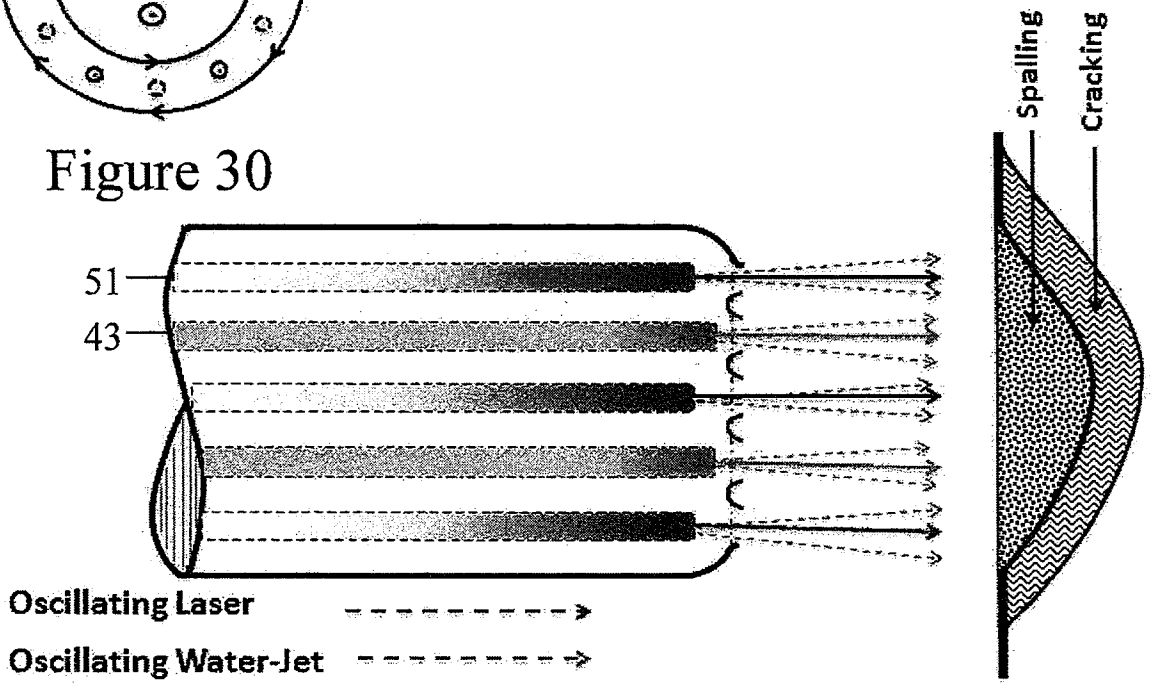
FIG. 31 is a side sectional view of water jets and lasers on a drill of an embodiment of the present invention.

Referring now to FIGS. 30 and 31, an embodiment of the swivel head 28 is shown. In particular, this embodiment comprises an inner circular arrangement 55 of two laser cutters 51 and two water jet cutters 43 arranged in an alternating pattern, and an outer circular arrangement 56 of six water jet cutters 43 and six laser cutters 51, arranged in an alternating pattern. The inner circular arrangement 55 and the outer circular arrangement 56 are each independently rotatable. In this case, the inner circular arrangement 55 rotates counterclockwise, and the outer circular arrangement 56 rotates clockwise. A central portion 53 of the bore is excavated by spalling, while a peripheral portion 54 of the bore is excavated by cracking.

Figure 32A:
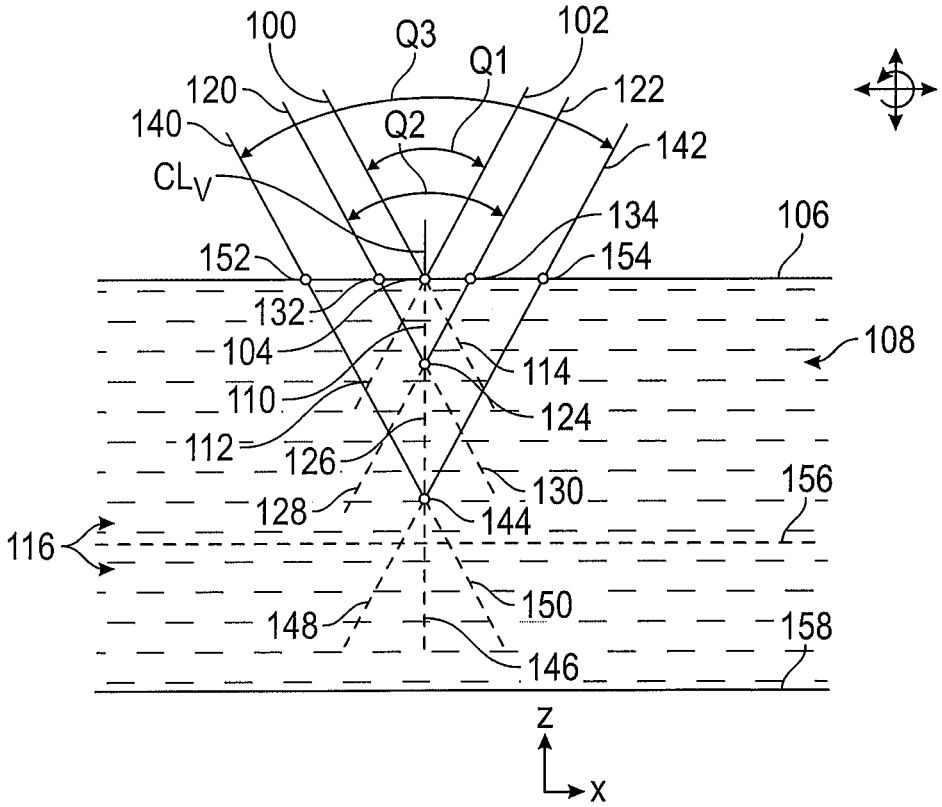
FIG. 32A is a cross-sectional view of one embodiment of impinged laser beams.

FIG. 32A is a cross-sectional view of one embodiment of impinged laser beams positioned on their target material 116. The target material 116 has an upper boundary 106 on an upper end and a lower boundary 158 on a lower end. In some embodiments, all six laser beams 100, 102, 120, 122, 140, 142 may be turned on and pointed at the target material 116 at the same time such that two laser beams 100, 102 intersect at a first impingement point 104, two laser beams 120, 122 intersect at a second impingement point 124, and two laser beams 140, 142 intersect at a third impingement point 144. In other embodiments, at time t1 a first laser is positioned toward the target material 116 such that its laser beam 100 is at a first angle Q1 relative to the laser beam 102 of a second laser. The angle Q1 is between about 10 degrees and about 90 degrees. The first and second laser beams 100, 102 intersect at a first impingement point 104 on the target material's upper boundary 106. The angle Q1 of the laser beams is dependent upon where the user wants the two beams to intersect. This intersection point (also called an "impingement point" herein) may be at the upper boundary 106 of the target material 116, or well into the target material 106. In the embodiment shown, the first laser beam 100 and the second laser beam 102 are positioned at substantially the same angle A1 relative to a vertical centerline $CL_V$, where A1=Q1/2. However, in other embodiments, one laser beam 100, 102 may be at an angle greater than A1 while the other laser beam 100, 102 is at an angle less than A1 such that the sum of the two angles equals Q1. After or below the first impingement point 104, residual portions 110, 112, 114 of the laser beams 100, 102 continue into the target material 116. The residual portion 110 extending downwardly along the vertical axis may be a combined beam 110 that has enhanced strength compared to the first laser beam 100 and the second laser beam 102 alone.

At time t2 the first laser is positioned toward the target material 116 such that its laser beam 120 is at a second angle Q2 relative to the laser beam 122 of the second laser. The angle Q2 is between about 10 degrees and about 90 degrees. The first and second laser beams 120, 122 intersect at a second impingement point 124 below the target material's upper boundary 106. The first laser beam 120 crosses the upper boundary 106 of the target material 116 at a point 132 and the second laser beam 122 crosses the upper boundary 106 of the target material 116 at a point 134. In the embodiment shown, the first laser beam 120 and the second laser beam 122 are positioned at substantially the same angle A2 relative to a vertical centerline $CL_V$, where A2=Q2/2. However, in other embodiments, one laser beam 120, 122 may be at an angle greater than A2 while the other laser beam 120, 122 is at an angle less than A2 such that the sum of the two angles equals Q2. After or below the impingement point 124, residual portions 126, 128, 130 of the laser beams 120, 122 continue into the target material 116. The residual portion 126 extending downwardly along the vertical axis may be a combined beam 126 that has enhanced strength compared to the first laser beam 120 and the second laser beam 122 alone.

At time t3 the first laser is positioned toward the target material 116 such that its laser beam 140 is at a third angle Q3 relative to the laser beam 142 of the second laser. The angle Q3 is between about 10 degrees and about 90 degrees. The first and second laser beams 140, 142 intersect at a third impingement point 144 below the second impingement point 124. The first laser beam 140 crosses the upper boundary 106 of the target material 116 at a point 152 and the second laser beam 142 crosses the upper boundary 106 of the target material 116 at a point 154. In the embodiment shown, the first laser beam 140 and the second laser beam 142 are positioned at substantially the same angle A3 relative to a vertical centerline $CL_V$, where A3=Q3/2. However, in other embodiments, one laser beam 140, 142 may be at an angle greater than A3 while the other laser beam 140, 142 is at an angle less than A3 such that the sum of the two angles equals Q3. After or below the impingement point 144, residual portions 146, 148, 150 of the laser beams 140, 142 continue into the target material 116. The residual portion 146 extending downwardly along the vertical axis may be a combined beam 146 that has enhanced strength compared to the first laser beam 140 and the second laser beam 142 alone. The portion of the target material that is being hit by the laser beams 100, 102, 120, 122, 140, 142 is called the weakened zone 108. The lower boundary 156 of the weakened zone 108 is shown by the line 156.

The drill head according to embodiments of the present invention includes at least one laser, and preferably two or more lasers. The advantages of the impinged laser beams include that the cutting power of the lasers at the impingement points is greater than at locations other than the impingement points. Additionally, the impinged laser beams save energy and are a more efficient use of the lasers. Additionally, the angles of the laser beams 100, 102, 120, 122, 140, 142 can be adjusted to move the impingement point 104, 124, 144 up and down and left to right, which allows the user to cut or alter target material 116 in different locations. The target material 116 can be cut in any sequence, meaning top to bottom (i.e., impingement point 104 first, then impingement point 124, then impingement point 144) or bottom to top (i.e., impingement point 144 first, then impingement point 124, then impingement point 104). Alternatively, the target material 116 can be cut horizontally, where the second impingement point would be to the left or right of the first impingement point and at the same depth as the first impingement point. Additionally, any combination of the above order or any other cutting order can be used depending on the geological formation of the target material 116.

Figure 32B:
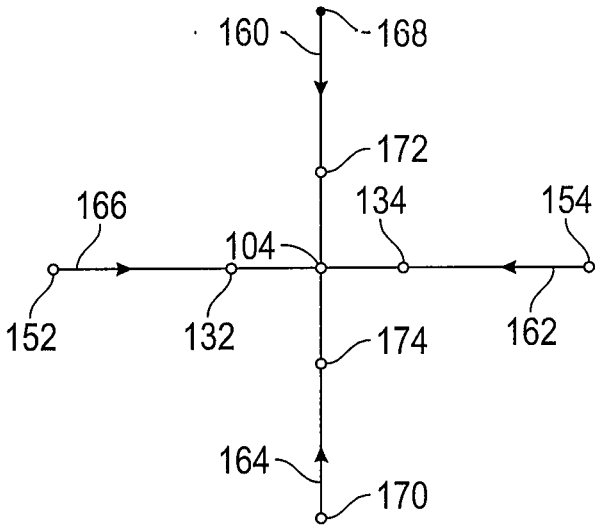
FIG. 32B is a top plan view of one embodiment of impinged laser beams.

FIG. 32B is a top plan view of one embodiment of impinged laser beams positioned on their target material and the dots shown are in the plane of the upper boundary (106 in FIG. 32A) of the target material (116 in FIG. 32A). In one embodiment, four laser beams 160, 162, 164, 166 are used to cut or alter the target material and are positioned at different angles at different times. Additionally, any number of laser beams 160, 162, 164, 166 (i.e., one laser beam to four laser beams) may be pointed at the target material at any given time. For example, at time t1, one laser beam 160 may be pointed at the target point 104. Alternatively, at time t1 two laser beams 160, 164 may be pointed at the target point 104 and thus create an impingement point 104. Alternatively, at time t1 the other two laser beams 162, 166 may be pointed at the target point 104 and thus create an impingement point 104. Alternatively, at time t1 all four laser beams 160, 162, 164, 166 may be pointed at the target point 104 and thus create an impingement point 104. Still further, any combination of two or three laser beams 160, 162, 164, 166 may be pointed at the impingement point 104 at time t1 in some embodiments.

At time t2, any combination of one to four laser beams 160, 162, 164, 166 may be pointed at a target/impingement point (not shown in FIG. 32B, point 124 in FIG. 32A) positioned directly below target/impingement point 104 such that the first laser beam 160 crosses the upper boundary of the target material at point 172, the second laser beam 162 crosses the upper boundary of the target material at point 134, the third laser beam 164 crosses the upper boundary of the target material at point 174, and the fourth laser beam 166 crosses the upper boundary of the target material at point 132. Accordingly, the portion of the first laser beam 160 shown between points 172 and 104 is in the target material (i.e., below the upper boundary of the target material) and is angled downward at the target/impingement point (point 124 in FIG. 32A); the portion of the second laser beam 162 shown between points 134 and 104 is in the target material (i.e., below the upper boundary of the target material) and is angled downward at the target/impingement point (point 124 in FIG. 32A); the portion of the third laser beam 164 shown between points 174 and 104 is in the target material (i.e., below the upper boundary of the target material) and is angled downward at the target/impingement point (point 124 in FIG. 32A); and the portion of the fourth laser beam 166 shown between points 132 and 104 is in the target material (i.e., below the upper boundary of the target material) and is angled downward at the target/impingement point (point 124 in FIG. 32A).

At time t3, any combination of one to four laser beams 160, 162, 164, 166 may be pointed at a target/impingement point (not shown in FIG. 32B, point 144 in FIG. 32A) positioned directly below target/impingement point 104 such that the first laser beam 160 crosses the upper boundary of the target material at point 168, the second laser beam 162 crosses the upper boundary of the target material at point 154, the third laser beam 164 crosses the upper boundary of the target material at point 170, and the fourth laser beam 166 crosses the upper boundary of the target material at point 152. Accordingly, the portion of the first laser beam 160 shown between points 168 and 104 is in the target material (i.e., below the upper boundary of the target material) and is angled downward at the target/impingement point (point 144 in FIG. 32A); the portion of the second laser beam 162 shown between points 154 and 104 is in the target material (i.e., below the upper boundary of the target material) and is angled downward at the target/impingement point (point 144 in FIG. 32A); the portion of the third laser beam 164 shown between points 170 and 104 is in the target material (i.e., below the upper boundary of the target material) and is angled downward at the target/impingement point (point 144 in FIG. 32A); and the portion of the fourth laser beam 166 shown between points 152 and 104 is in the target material (i.e., below the upper boundary of the target material) and is angled downward at the target/impingement point (point 144 in FIG. 32A).

In an alternative embodiment, ten lasers may be used such that the first and second laser beams intersect at impingement point 104; the third, fourth, fifth, and sixth laser beams are pointed at a target/impingement point (not shown in FIG. 32B, point 124 in FIG. 32A) positioned directly below impingement point 104 such that the third laser beam crosses the upper boundary of the target material at point 172, the fourth laser beam crosses the upper boundary of the target material at point 134, the fifth laser beam crosses the upper boundary of the target material at point 174, and the sixth laser beam crosses the upper boundary of the target material at point 132; and the seventh, eighth, ninth, and tenth laser beams are pointed at a target/impingement point (not shown in FIG. 32B, point 144 in FIG. 32A) positioned directly below impingement point 104 such that the seventh laser beam crosses the upper boundary of the target material at point 168, the eighth laser beam crosses the upper boundary of the target material at point 154, the ninth laser beam crosses the upper boundary of the target material at point 170, and the tenth laser beam crosses the upper boundary of the target material at point 152. In additional embodiments, one or more additional lasers may also be pointed at impingement point 104.

Figure 32C:
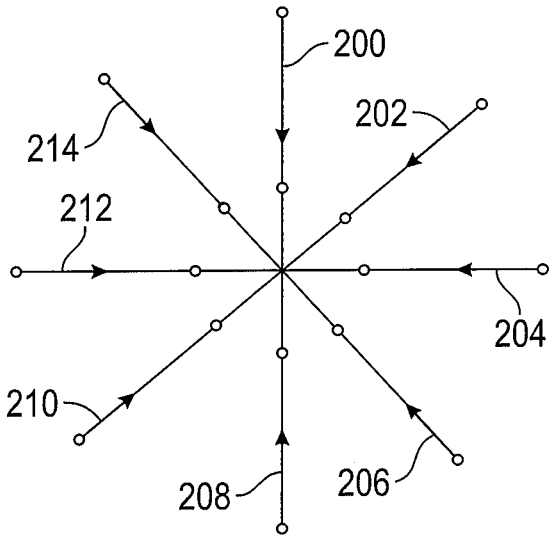
FIG. 32C is a top plan view of another embodiment of impinged laser beams.

In various embodiments, more than four lasers can be used. For example, eight lasers can be used, as shown in FIG. 32C, which is a top plan view of an embodiment of impinged laser beams positioned on their target material. The dots shown are in the plane of the upper boundary (106 in FIG. 32A) of the target material (116 in FIG. 32A). FIG. 32C is similar to FIG. 32B except that four additional laser beams are used to cut or alter the target material. In one embodiment, eight laser beams 200, 202, 204, 208, 210, 212, 214 are used to cut or alter the target material and are positioned at different angles at different times.

Figure 33:
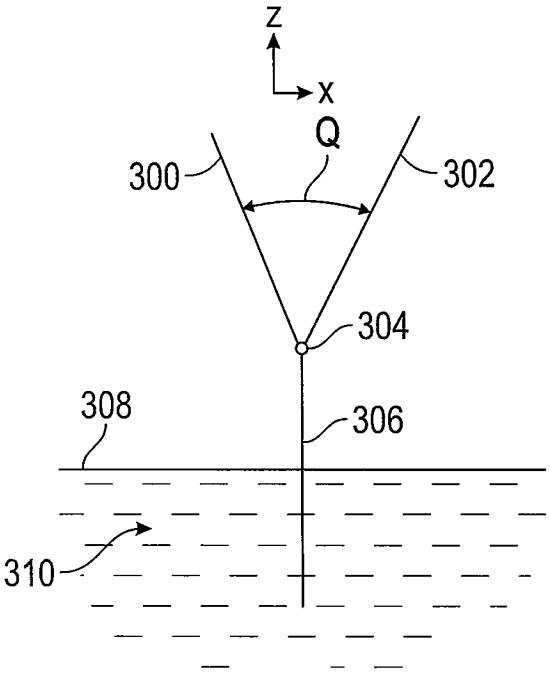
FIG. 33 is a cross-sectional view of another embodiment of impinged laser beams.

FIG. 33 is a cross-sectional view of another embodiment of impinged laser beams. Here, two laser beams 300, 302 are positioned at an angle Q relative to one another, where the angle Q is between about 10 degrees and about 90 degrees. The laser beams 300, 302 intersect at an impingement point 304 above the upper boundary 308 of the target material 310. After the impingement point 304, the laser beams 300, 302 form a combined beam 306 that is stronger and more powerful than each beam 300, 302 alone. The combined beam 306 cuts or alters the target material 310. Additionally, the user can move the combined beam 306 around (e.g., side-to-side and up-and-down) to cut or alter the target material 310 by remotely moving the individual beams 300, 302 and the impingement point 304. In an additional embodiment (not shown), the system also includes two laser jets positioned outside of the laser beams 300, 302 that intersect at an impingement point at or below the impingement point 304. Further, two additional laser beams may be positioned in the Y plane (i.e., perpendicular to laser beams 300, 302 and not shown in this cross-section) and intersect laser beams 300, 302 at impingement point 304.

Figure 34:
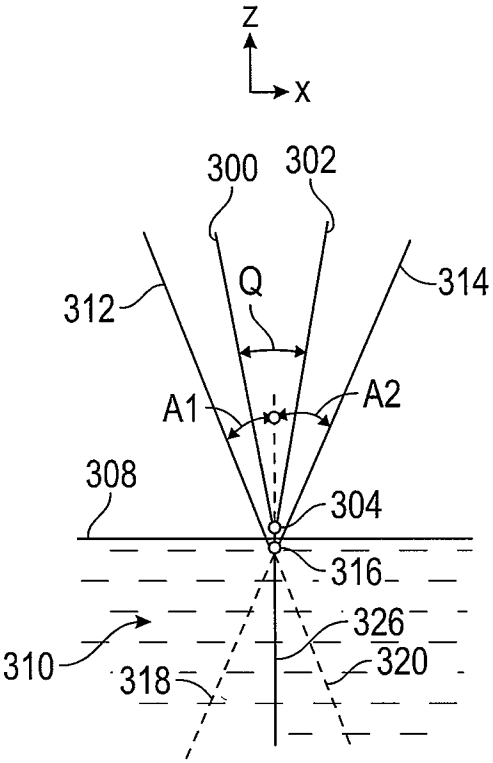
FIG. 34 is a cross-sectional view of one embodiment of impinged laser beams and impinged water jets.

FIG. 34 is a cross-sectional view of one embodiment of impinged laser beams and impinged water jets. In this embodiment, the drill head includes two laser beams 300, 302 and two water jets 312, 314. The laser beams 300, 302 are positioned at an angle Q relative to one another, where the angle Q is between about 10 degrees and about 90 degrees. The laser beams 300, 302 intersect at an impingement point 304 around the upper boundary 308 of the target material 310. The impingement point 304 may be slightly above the upper boundary 308, at the upper boundary 308, or slightly below the upper boundary 308. After the impingement point 304, the laser beams 300, 302 form a combined beam that is stronger and more powerful than each beam 300, 302 alone. The combined beam cuts or alters the target material 310. The water jets 312, 314 are positioned outside of the laser beams 300, 302 because the angle between the water jets 312, 314 is larger than the angle Q. The first water jet 312 is positioned at an angle A1 relative to the vertical axis and the second water jet 314 is positioned at an angle A2 relative to the vertical axis. Thus, A1 plus A2 is greater than Q. The water jets 312, 314 intersect at an impingement point 316 just below the impingement point 304 of the laser beams 300, 302 to push the rock or other target material 310 cut by the combined laser out and away from cutting area. In one embodiment, the combined laser beam is shown by the line 326 because the liquid from the water jets is pushing the rock and target material 310 out. In some embodiments, a portion of the fluid of the water jets 312, 314 continues along its original path as shown by lines 318 and 320. In other embodiments, a portion of the fluid of the water jets 312, 314 combines to form a combined stream as shown by line 326. In still further embodiments, the line 326 is a combined laser beam and a combined fluid stream. The combined beam/stream 326 can cut or alter the target material 310 and push the cut material away from the cutting zone. The laser beams 300, 302 initiate weakening and fractures in the target material 310 and the water jets 312, 314 remove the weakened material. Additionally, the water jets 312, 314 enhance and compliment the laser beams 300, 302 by forming the combined beam/stream 326, which is a magnified bundle of energy. In some embodiments, the laser beams 300, 312 strike the target material 310 first and then shortly thereafter the water jets 312, 314 strike the target material 310 at or near the laser beam impingement point 304 such that the laser beams 300, 302 crack the target material 310 and the water jets 312, 314 shatter and remove the shattered target material 310. In alternative embodiments, the water jets 312, 314 strike the target material 310 first and then shortly thereafter the laser beams 300, 302 strike the target material 310 at or near the water jet impingement point 316. In some embodiments (not shown), the laser beams 300, 302 and water jets 312, 314 have the same impingement point. If the laser beams 300, 302 and water jets 312, 314 have the same impingement point, then typically one will strike first and the other will strike second such that the laser beams 300, 302 and water jets 312, 314 are not striking the exact same location at the same time. However, although unlikely, there may be situations where both the laser beams 300, 302 and water jets 312, 314 need to strike the same impingement point at the same time. Various inputs of the drill head can be adjusted depending on the drilling conditions, target material, and desired outcomes, for example: the laser energy level, the water jet pressure, the water jet flow volume, angle Q of the laser beams, the angles A1, A2 of the water jets, and the locations of the impingement points. In some embodiments, percussive jets are used in place of the water jets 312, 314. Further, two additional laser beams may be positioned in the Y plane (i.e., perpendicular to laser beams 300, 302 and not shown in this cross-section) and intersect laser beams 300, 302 at impingement point 304.

Figure 35:
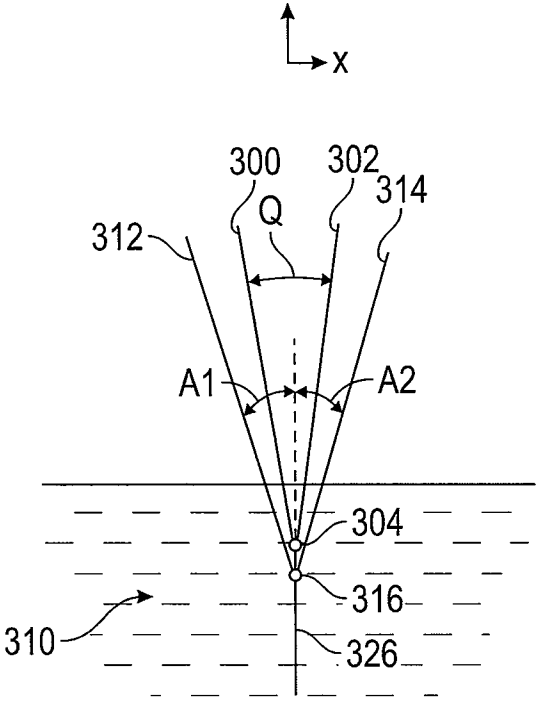
FIG. 35 is a cross-sectional view of one embodiment of impinged laser beams and impinged water jets.

FIG. 35 is a cross-sectional view of one embodiment of impinged laser beams and impinged water jets. FIG. 35 may be the system of FIG. 34, but shown at a later point in time, i.e., FIG. 34 is at time t1 and FIG. 35 is at time t2. In FIG. 35, the drill head includes at least two laser beams 300, 302 and at least two water jets 312, 314. The laser beams 300, 302 are positioned at an angle Q relative to one another, where the angle Q is between about 10 degrees and about 90 degrees. The laser beams 300, 302 intersect at an impingement point 304 below the upper boundary 308 of the target material 310. After the impingement point 304, the laser beams 300, 302 form a combined beam that is stronger and more powerful than each beam 300, 302 alone. The combined beam cuts or alters the target material 310. The water jets 312, 314 are positioned outside of the laser beams 300, 302 because the angle between the water jets 312, 314 is larger than the angle Q. The first water jet 312 is positioned at an angle A1 relative to the vertical axis and the second water jet 314 is positioned at an angle A2 relative to the vertical axis. Thus, A1 plus A2 is greater than Q. The water jets 312, 314 intersect at an impingement point 316 just below the impingement point 304 of the laser beams 300, 302 to push the rock or other target material 310 cut by the combined laser out and away from cutting area. In one embodiment, the combined laser beam is shown by the line 326 because the liquid from the water jets is pushing the rock and target material 310 out of the cutting zone and thus does not continue as a combined stream. In other embodiments, a portion of the fluid of the water jets 312, 314 combines to form a combined stream as shown by line 326. In still further embodiments, the line 326 is a combined laser beam and a combined fluid stream. The combined beam/stream 326 can cut or alter the target material 310 and push the cut material away from the cutting zone. In some embodiments, the laser beams 300, 312 strike the target material 310 first and then shortly thereafter the water jets 312, 314 strike the target material 310 at or near the laser beam impingement point 304 such that the laser beams 300, 302 crack the target material 310 and the water jets 312, 314 shatter and remove the shattered target material 310. In alternative embodiments, the water jets 312, 314 strike the target material 310 first and then shortly thereafter the laser beams 300, 302 strike the target material 310 at or near the water jet impingement point 316. In some embodiments (not shown), the laser beams 300, 302 and water jets 312, 314 have the same impingement point. If the laser beams 300, 302 and water jets 312, 314 have the same impingement point, then typically one will strike first and the other will strike second such that the laser beams 300, 302 and water jets 312, 314 are not striking the exact same location at the same time. However, although unlikely, there may be situations where both the laser beams 300, 302 and water jets 312, 314 need to strike the same impingement point at the same time. Further, two additional laser beams may be positioned in the Y plane (i.e., perpendicular to laser beams 300, 302 and not shown in this cross-section) and intersect laser beams 300, 302 at impingement point 304.

Figure 36:
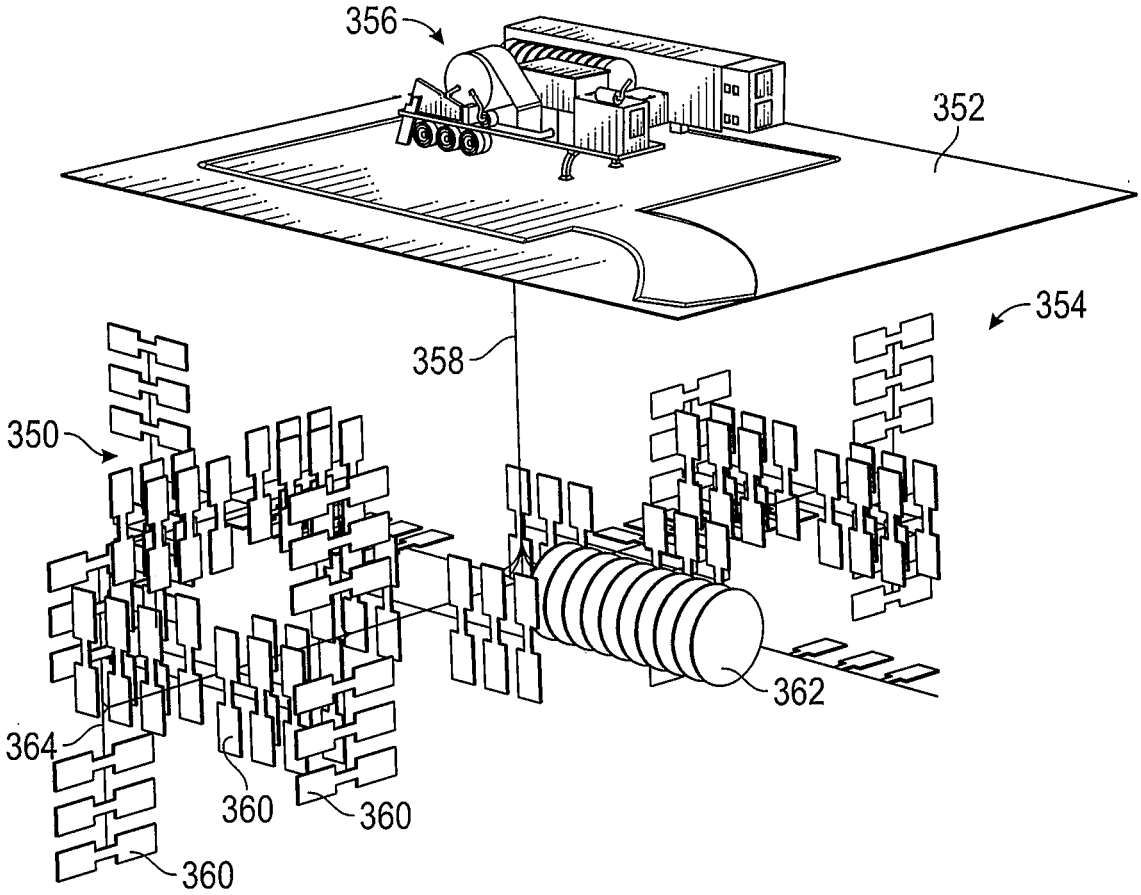
FIG. 36 shows one embodiment of an underground system of panels and holes cut in different shapes and orientations.

FIG. 36 shows one embodiment of a system 350 of panels 360, 362 and holes 358, 364 cut in different shapes and orientations. The system 350 is below the surface 352 in the target material 354 while the drilling equipment 356 is above ground. A well bore or drill hole 358 extends downwardly from the surface 352 and extends in various directions depending on the location of the target resources or minerals (e.g., oil and gas). Additional arms or drill holes 364 extend outwardly from the main well bore 358. The system 350 includes multiple panels 360, 362 in all different directions, orientations, locations, shapes, and sizes. The panels 360, 362 may be traditional rectangular panels 360 or they may be round pancakes 362. The system 350 can include any number of panels 360, 362 in a combination of shapes and sizes.

Figure 37:
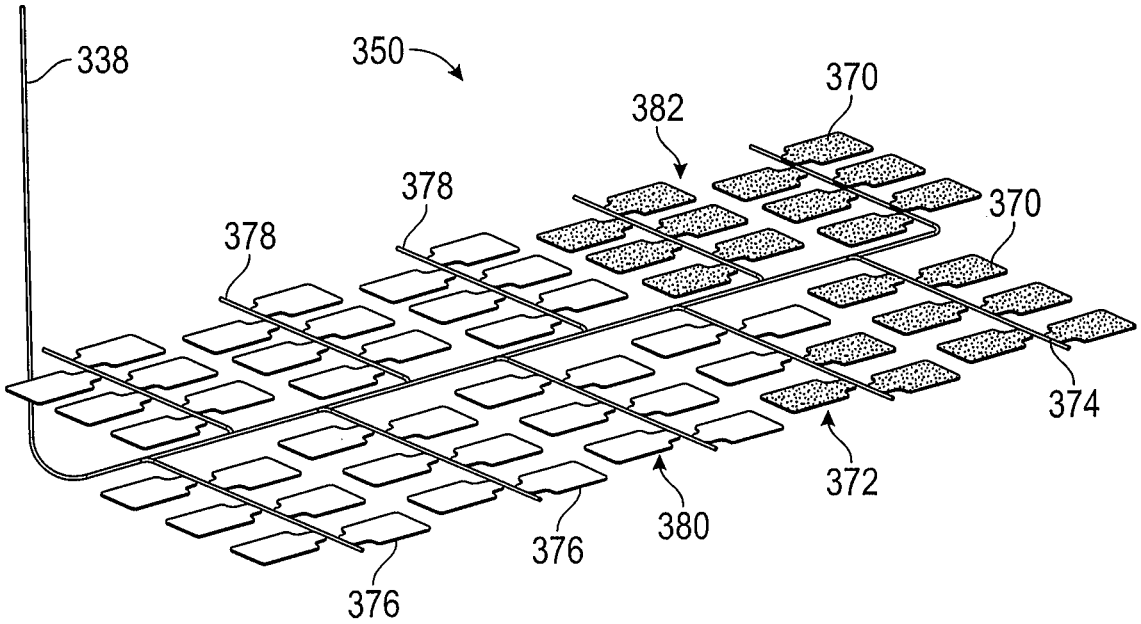
FIG. 37 depicts another embodiment of an underground system of panels and holes.

FIG. 37 depicts another embodiment of an underground system 350 of panels 370 and holes 358, 374 in the process of being cut. A well bore or drill hole 358 extends downwardly from the surface and can extend in various directions depending on the location of the target resources or minerals (e.g., oil and gas). Arms or additional drill holes 374 extend outwardly from the main well bore 358 and multiple panels 370 are cut on each arm 374. Each arm 374 with its multiple panels 370 extending therefrom form a panel group 382. Here, the completed panel groups 382 are positioned on one end of the system 350 and comprise completed panels 370 and completed arms 374. A panel group in progress 372 is shown between the completed panel groups 382 and the planned panel groups 380. Each planned panel group 380 includes a planned arm 378 and planned panels 376. The panels 370, 376 can be cut using lasers, water jets (including percussive water jets), and/or a combination of lasers and water jets.

Figure 38A:
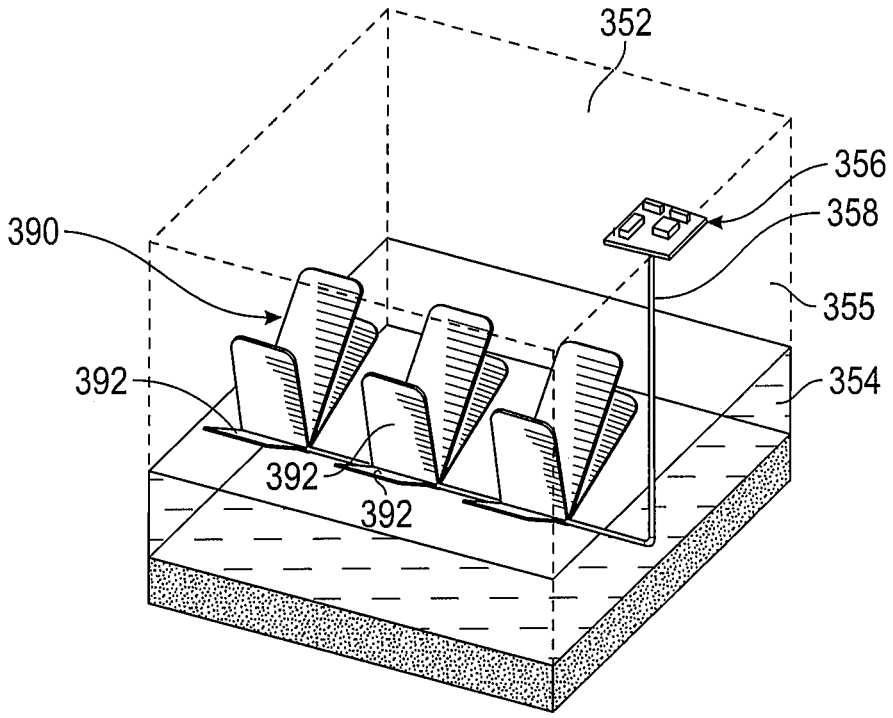
FIGS. 38A-C show one embodiment of butterfly configuration panels.
Figure 38B:
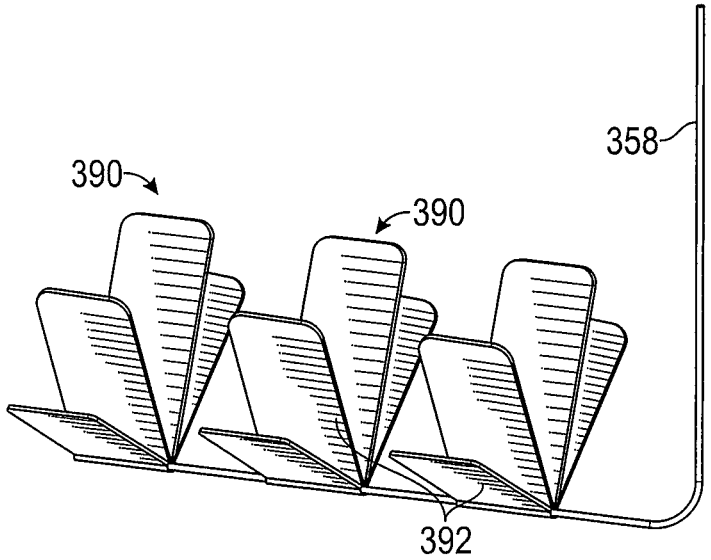
Figure 38C:
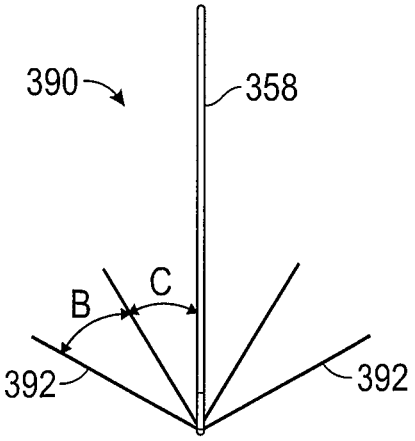

FIGS. 38A-C are one embodiment of butterfly configuration panels 390. The butterfly panels 390 can be cut using lasers, water jets (including percussive water jets), and/or a combination of lasers and water jets. The advantage of butterfly panels is that the user can cut a larger area with only one drill hole. In the past, multiple drill holes were needed to cut the same amount of area. Additionally, the paneling system described herein is between about 10 and 100 times more effective than traditional fracking methods at recovering underground oil and gas.

FIG. 38A is a perspective view of the butterfly panels 390 positioned below the surface 352 and predominantly in the target material 354. A layer of material (often called the "overburden") 355 is positioned between the target material 354 and the surface 352. The drilling equipment 356 is positioned above the surface 352 and a well bore or drill hole 358 extends downwardly from the drilling equipment 356 to the target material 354. The butterfly panels 390 are formed by cutting multiple rectangular panels 392 extending outwardly from the drill hole 358 in different radial directions. In some embodiments, the rectangular panels 392 are only cut above a predetermined horizontal angle. However, in other embodiments, the butterfly panels 390 can be cut on a vertical drill hole 358. Additionally, the rectangular panels 392 can be cut around the entire drill hole axis (i.e., around 360 degrees of the drill hole 358). In other embodiments, the panels 392 can be cut in different shapes, e.g., square, round, oval, etc.

FIG. 38B is a perspective view of the butterfly panels 390, which are formed by cutting multiple panels 392 off of the drill hole 358 in different radial directions. FIG. 38C is a side view of the butterfly panel 390. The butterfly panel 390 includes multiple panels 392 extending radially from a horizontal portion of the drill hole 358. The panels 392 are positioned an angle B from one another and an angle C from the vertical portion of the drill hole 358. The angle B generally ranges from about 10 degrees to about 90 degrees. The angle C generally ranges from about 10 degrees to about 90 degrees. In the embodiment shown, the butterfly panel 390 includes four panels 392. However, any number of panels 392 can be used in different embodiments.

Figure 39:
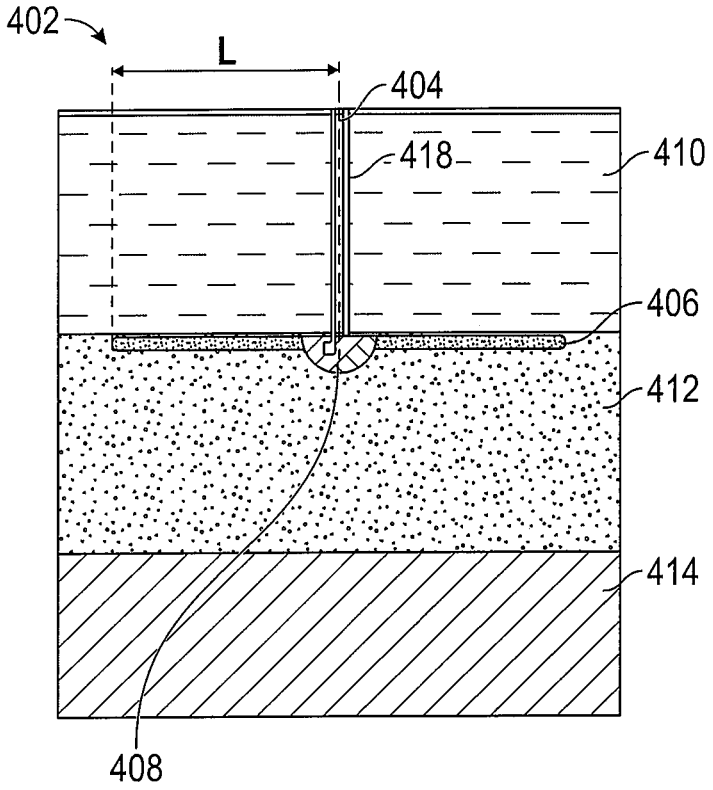
FIG. 39 shows a cavity cut into tar sands at a time early in the extraction process.
Figure 40:
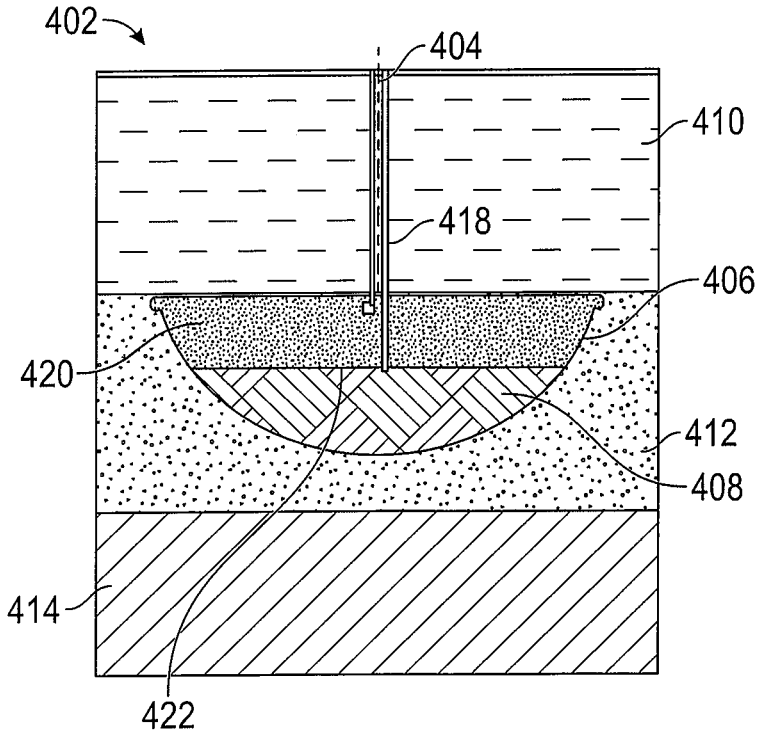
FIG. 40 shows the cavity of FIG. 39 at a later time in the extraction process.

FIGS. 39 and 40 are cross-sectional views of a well bore 404 and a cavity 406 cut into tar sands 412 at two times in the extraction process, where FIG. 39 is at time t1 and FIG. 40 is at time t2. At time t1 during the extraction process 400 an initial cavity 406 is cut just below the overburden 410 and at the top or upper portion of the tar sands 412. The tar sands 412 are sandwiched between the overburden 410 and a lower material 414, which is likely rock of some type. The well bore 404 extends from the surface to the initial cavity 406. The initial cavity 406 has a long/wide and flat shape. For example, the length L of half of the initial cavity 406 may be between about 50 feet and 200 feet. In a preferred embodiment, the initial cavity 406 has a length L from one end to the well bore 404 of between about 75 feet and 150 feet. In a more preferred embodiment, the length L is about 100 feet. The initial cavity 406 is substantially shorter (height-wise) than it is long (lengthwise), meaning that the initial cavity 406 is substantially longer than it is deep. Thus, the initial cavity 406 may have a traditional rectangular or circular panel shape when viewed from above. If the initial cavity 406 is circular, then length L is the radius of the initial cavity 406. Water 408 is pumped into the initial cavity 406. A heater 418 extends down into the initial cavity 406 through the well bore 404 and is positioned at the top of the initial cavity 406 and top of the water 408.

As more warm water 408 and/or steam is pumped into the cavity 406, the water 408 mixes with the tar sands 412 and the cavity 406 gets bigger. FIG. 40 shows the extraction process 402 and the cavity 406 at time t2. The heater 418 extends down through the well bore 404 to the top of the water 408 region to maintain the water's 408 high temperature in the heated region 422. The heated region 422 is the area proximate the heater 418. Because hydrocarbons or oil 420 is less dense than water 408, the oil 420 (also called hydrocarbons herein) rises to the top of the cavity 406 and separates from the rest of the tar sands 412 material. At time t2, the oil 420 is floating on top of the warm water 408. As the water 408 moves downward in the cavity 406 and the oil 420 rises in the cavity 406, the heater 418 extends further into the cavity 406 to maintain its position at the top of the water 408 region. A horizontal drill hole may be drilled past the cavity 406 to increase the effect of the hot water in some embodiments.

Figure 41A:
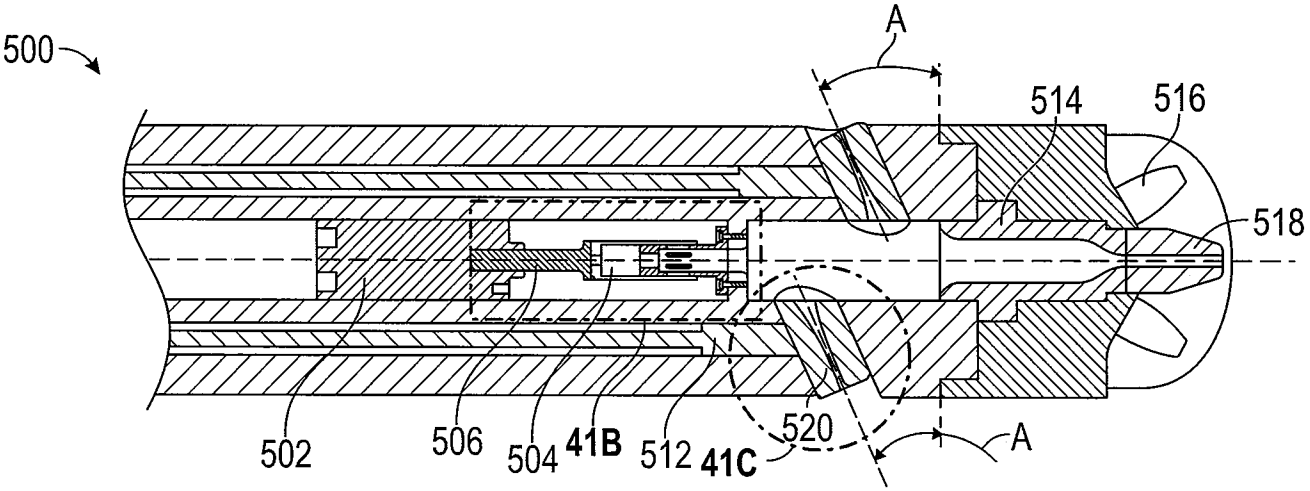
FIGS. 41A-C show one embodiment of a cutter head or drill head.
Figure 41C:
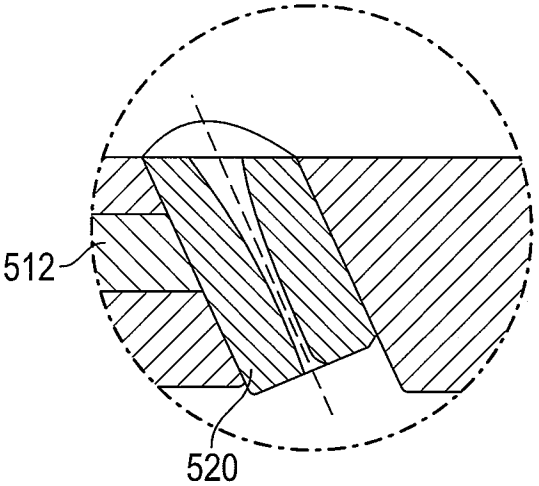
Figure 41B:
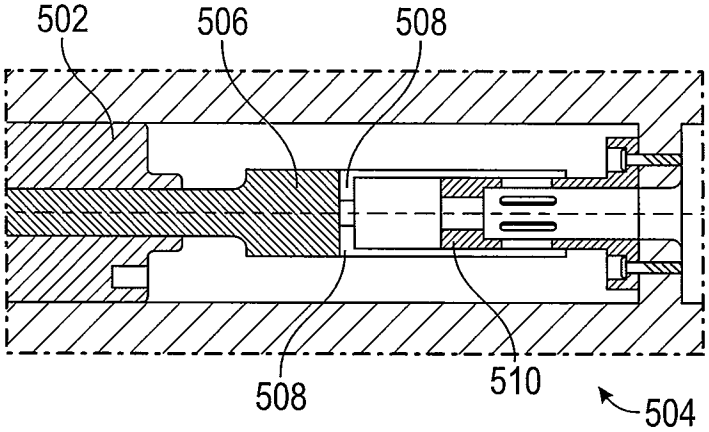

FIGS. 41A-C are cross-sectional views of a drill head or cutter head 500 according to embodiments of the present invention. The head 500 includes a hydraulic motor 502 interconnected to a shaft 506 interconnected to a modulator 504 with a stator 508 and a rotor 510. The drill head or cutter head 500 also includes a valve mechanism 512 and a nozzle insert 520 for cutting from the sides of the head 500. The head 500 further includes a swivel 514, eccentric nozzle 516, and an axial nozzle 518. In one embodiment, the head 500 has a length L between about 10.00 inches and about 20.00 inches. In a preferred embodiment, the head 500 has a length L between about 12.00 inches and 17.00 about inches. In a more preferred embodiment, the cutter head 500 has a length L1 between about 14.40 inches and 14.50 inches. The nozzle insert 520 is at an angle A relative to the vertical axis of the head 500. In some embodiments, the angle A of the nozzle insert 520 is between about 15 degrees and about 40 degrees. The two nozzles inserts are at the same angle A, but pointed in opposite directions to balance the head 500.

While various embodiments of the present invention have been described in detail, it is apparent that modifications and alterations of these embodiments will occur to those skilled in the art. However, it is to be expressly understood that such modifications and alterations are within the scope and spirit of the present invention, as set forth in the following claims. Further, the invention described herein is capable of other embodiments and of being practiced or of being carried out in various ways. It is to be understood that the phraseology and terminology used herein is for the purpose of description and should not be regarded as limiting.

What is claimed is:

1. A drilling system comprising:

a drill string;

a drilling fluid for drilling into a geological formation, wherein the drilling fluid flows through the drill string;

a drill head interconnected to the drill string, the drill head having at least two operating modes, wherein a first operating mode of the at least two operating modes is selected from a group consisting of a straight drilling mode, a radius bore drilling mode, a side panel cutting mode, a propulsion mode, and a non-operational mode, and wherein the drill head comprises a valve assembly comprising:

a housing comprising:

a bore;

a first end;

a first hole;

a second hole;

a first body groove interconnected to the first hole, wherein the first body groove corresponds to the first operating mode; and a second body groove interconnected to the second hole, wherein the second body groove corresponds to a second operating mode of the at least two operating modes; and a spool having an axial bore, a first end, and a second end, wherein the spool is moveable between a first position and a second position, wherein the first end of the spool receives the drilling fluid, and wherein the first position corresponds to a first pressure of the drilling fluid and the second position corresponds to a second pressure of the drilling fluid;

wherein the first operating mode corresponds to the first pressure of the drilling fluid and the second operating mode corresponds to the second pressure of the drilling fluid, wherein the first pressure of the drilling fluid is between about 40 kpsi and about 50 kpsi and the second pressure of the drilling fluid is between about 30 kpsi and about 40 kpsi;

a drill head body having a leading surface and a circumferential surface; and a swivel head interconnected to the leading surface of the drill head body, wherein the swivel head is angularly articulable relative to a longitudinal axis of the drill head body, and wherein the swivel head comprises:

a first fluid jet cutter;

a second fluid jet cutter;

a first laser cutter; and a second laser cutter.

2. The drilling system of claim 1, further comprising a side panel cutting head positioned on the circumferential surface of the drill head body.

3. The drilling system of claim 1, wherein the housing further comprises:

a third hole;

a fourth hole;

a third body groove interconnected to the third hole, wherein the third body groove corresponds to a third operating mode; and a fourth body groove interconnected to the fourth hole, wherein the fourth body groove corresponds to a fourth operating mode.

4. The drilling system of claim 3, wherein:

the third operating mode corresponds to a third pressure of the drilling fluid, and wherein the third pressure is between about 20 kpsi and about 30 kpsi; and the fourth operating mode corresponds to a fourth pressure of the drilling fluid, and wherein the fourth pressure is less than about 20 kpsi.

5. The drilling system of claim 1, wherein the first hole of the housing is positioned on a downstream surface of the housing.

6. The drilling system of claim 1, wherein the first hole of the housing is positioned on a lateral surface of the housing.

7. The drilling system of claim 1, wherein the first hole of the housing is positioned on an upstream face of the housing.

8. The drilling system of claim 1, further comprising a detent assembly for locking the spool in the first position and in the second position, wherein the detent comprises a spring biased against a locking pin, wherein the locking pin is biased against a first notch of the spool when the spool is in the first position and the locking pin is biased against a second notch of the spool when the spool is in the second position, and wherein the locking pin of the detent assembly is selected from a group consisting of a ball, a pin, a sphere, a wheel, and a block.

9. The drilling system of claim 1, further comprising a percussive fluid jet.

10. The drilling system of claim 1, wherein the drill head comprises a laser distributor swivel.

11. The drilling system of claim 1, wherein the drill head body is displaced about fifteen degrees relative to the longitudinal axis of the drill head body.

12. The drilling system of claim 1, wherein the first hole of the housing is positioned on an upstream face of the housing.

13. A drilling system comprising:

a drill string;

a drilling fluid for drilling into a geological formation, wherein the drilling fluid flows through the drill string;

a drill head interconnected to the drill string, the drill head having at least four operating modes, wherein a first operating mode of the at least four operating modes is selected from a group consisting of a straight drilling mode, a radius bore drilling mode, a side panel cutting mode, a propulsion mode, and a non-operational mode, and wherein the drill head comprises a valve assembly comprising:

a housing comprising:

a bore;

a first end;

a first hole;

a second hole;

a third hole;

a fourth hole;

a first body groove interconnected to the first hole, wherein the first body groove corresponds to the first operating mode;

a second body groove interconnected to the second hole, wherein the second body groove corresponds to a second operating mode of the at least four operating modes;

a third body groove interconnected to the third hole, wherein the third body groove corresponds to a third operating mode of the at least four operating modes; and a fourth body groove interconnected to the fourth hole, wherein the fourth body groove corresponds to a fourth operating mode of the at least four operating modes; and a spool having an axial bore, a first end, and a second end, wherein the spool is moveable between a first position and a second position, wherein the first end of the spool receives the drilling fluid, and wherein the first position corresponds to a first pressure of the drilling fluid and the second position corresponds to a second pressure of the drilling fluid;

wherein the first operating mode corresponds to the first pressure of the drilling fluid, the second operating mode corresponds to the second pressure of the drilling fluid, the third operating mode corresponds to a third pressure of the drilling fluid, and the fourth operating mode corresponds to a fourth pressure of the drilling fluid;

wherein the first pressure of the drilling fluid is between about 40 kpsi and about 50 kpsi, the second pressure of the drilling fluid is between about 30 kpsi and about 40 kpsi, the third pressure of the drilling fluid is between about 20 kpsi and about 30 kpsi, and the fourth pressure of the drilling fluid is less than about 20 kpsi;

a drill head body having a leading surface and a circumferential surface; and a swivel head interconnected to the leading surface of the drill head body, wherein the swivel head is angularly articulable relative to a longitudinal axis of the drill head body, and wherein the swivel head comprises:

a first fluid jet cutter;

a second fluid jet cutter;

a first laser cutter; and a second laser cutter.

14. The drilling system of claim 13, further comprising a side panel cutting head positioned on the circumferential surface of the drill head body.

15. The drilling system of claim 13, wherein the first hole of the housing is positioned on a downstream surface of the housing.

16. The drilling system of claim 13, wherein the first hole of the housing is positioned on a lateral surface of the housing.

17. A drilling system comprising:

a drill string;

a drilling fluid for drilling into a geological formation, wherein the drilling fluid flows through the drill string;

a drill head interconnected to the drill string, the drill head having at least four operating modes, wherein a first operating mode of the at least four operating modes is selected from a group consisting of a straight drilling mode, a radius bore drilling mode, a side panel cutting mode, a propulsion mode, and a non-operational mode, and wherein the drill head comprises a valve assembly comprising:

a housing comprising:

a bore;

a first end;

a first hole;

a second hole;

a first body groove interconnected to the first hole, wherein the first body groove corresponds to the first operating mode; and a second body groove interconnected to the second hole, wherein the second body groove corresponds to a second operating mode of the at least four operating modes;

a spool having an axial bore, a first end, and a second end, wherein the spool is moveable between a first position and a second position, wherein the first end of the spool receives the drilling fluid, and wherein the first position corresponds to a first pressure of the drilling fluid and the second position corresponds to a second pressure of the drilling fluid, wherein the first operating mode corresponds to the first pressure of the drilling fluid and the second operating mode corresponds to the second pressure of the drilling fluid; and a detent assembly for locking the spool in the first position and in the second position, wherein the detent comprises a spring biased against a locking pin, wherein the locking pin is biased against a first notch of the spool when the spool is in the first position and the locking pin is biased against a second notch of the spool when the spool is in the second position, and wherein the locking pin of the detent assembly is selected from a group consisting of a ball, a pin, a sphere, a wheel, and a block;

a drill head body having a leading surface and a circumferential surface; and a swivel head interconnected to the leading surface of the drill head body, wherein the swivel head is angularly articulable relative to a longitudinal axis of the drill head body, and wherein the swivel head comprises:

a first fluid jet cutter;

a second fluid jet cutter;

a first laser cutter; and a second laser cutter.

18. The drilling system of claim 17, further comprising a side panel cutting head positioned on the circumferential surface of the drill head body.

19. The drilling system of claim 17, wherein the drill head comprises a laser distributor swivel.

20. The drilling system of claim 17, wherein the drill head body is displaced about fifteen degrees relative to the longitudinal axis of the drill head body.

* * * * *